US005477041A

United States Patent [19]

Miron et al.

[11] Patent Number: 5,477,041

[45] Date of Patent: Dec. 19, 1995

[54] ADAPTABLE ELECTRONIC KEY AND LOCK SYSTEM

[75] Inventors: Nancy C. Miron, Royal Oak; Vance E. Neff, Birmingham, both of Mich.

[73] Assignee: Computerized Security Systems, Incorporated, Troy, Mich.

[21] Appl. No.: 36,556

[22] Filed: Mar. 24, 1993

Related U.S. Application Data

[63] Continuation-in-part of Ser. No. 661,542, Feb. 26, 1991, Pat. No. 5,198,643.

[51] Int. Cl.[6] ..... E05B 49/00

[52] U.S. Cl. ..... 235/382; 340/825.31; 235/382.5

[58] Field of Search ..... 340/825.31, 825.32; 235/382, 382.5

[56] References Cited

U.S. PATENT DOCUMENTS

| | | | |
|---|---|---|---|
| 3,906,447 | 9/1975 | Crafton | 340/825.31 |
| 3,984,658 | 10/1976 | Cannon | 340/825.31 |
| 4,385,231 | 5/1983 | Mizutani et al. | 235/382 |
| 4,392,133 | 7/1983 | Lundgren | 340/825.31 |
| 4,644,484 | 2/1987 | Flynn et al. | 340/825.31 |
| 4,727,368 | 2/1988 | Larson et al. | 340/825.31 |
| 4,912,310 | 3/1990 | Uemura | 235/382 |
| 5,083,122 | 1/1992 | Clark | 340/825.31 |
| 5,260,551 | 11/1993 | Wiik et al. | 340/825.31 |

FOREIGN PATENT DOCUMENTS

| | | |
|---|---|---|
| 2-259853 | 10/1990 | Japan . |
| 4-30208 | 2/1992 | Japan . |

*Primary Examiner*—John Shepperd

*Attorney, Agent, or Firm*—Reising, Ethington, Barnard & Perry

[57] ABSTRACT

A locking system is utilized to control the locking and unlocking of a lock, such as on a door. The lock includes a magnetic card reader for reading a coded key card into a lock computer which in turn determines functions of and access to the lock. The key card includes a key code, key level code, and key record number stored thereon. The lock includes a memory accessed by the computer which is partitioned and includes a level storage area with level records identified by a lock level code and operational information for the level, and a key storage area for storing lock key records identified by a lock record number and associated with at least one lock level for storing key information associated with the record number. The computer validates a key card by reading and comparing the key level code to the lock level code to determine the level and the key record number to one of the lock record numbers identified with the level in the key storage area. The key code is representative of a real time based on time of issuance, and validation occurs by comparing a lock time to the key code. Additional functions include invalid and valid day operation, diagnostic operation for errors, interrogation for lock information, display keys for displaying lock conditions, and key expiration times to limit access time to the lock.

25 Claims, 36 Drawing Sheets

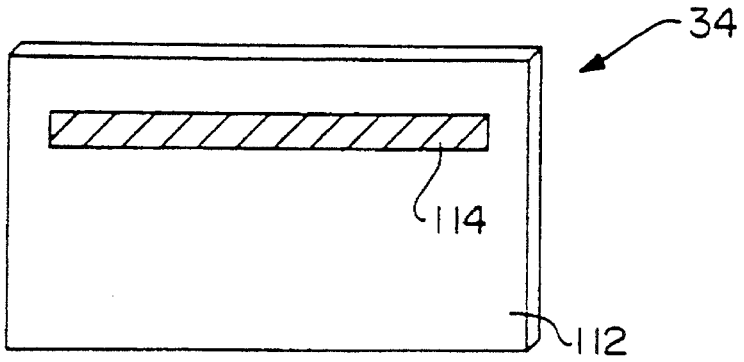
FIG. 3a
FIG. 3b
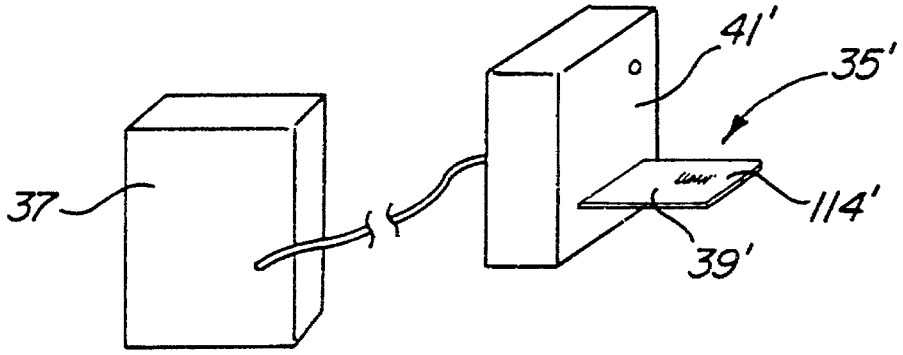
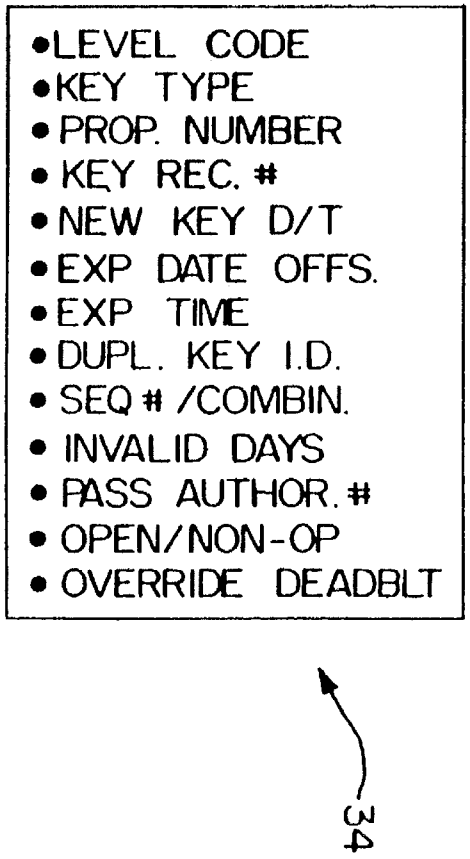
FIG. 7

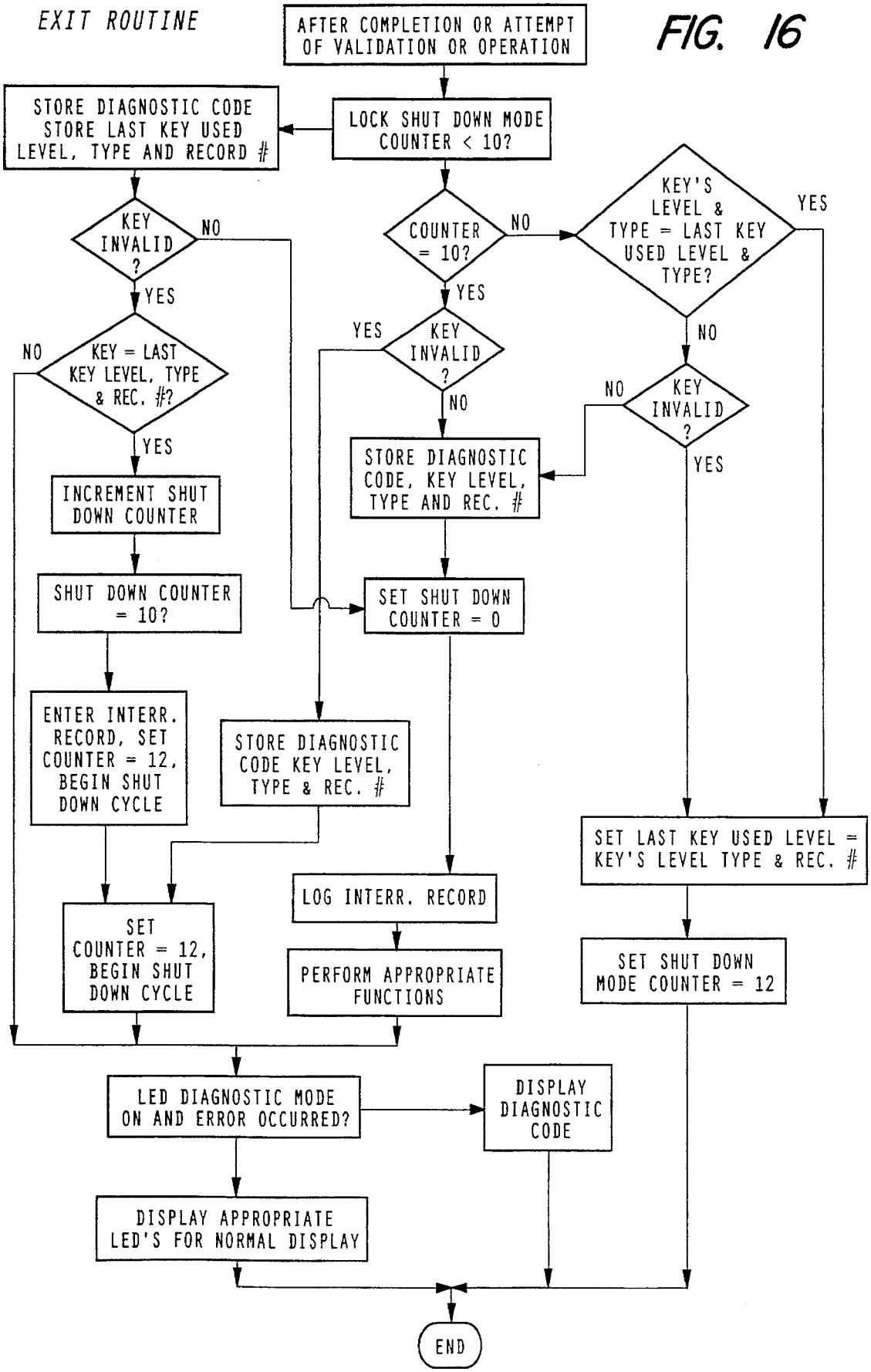
EXIT ROUTINE
AFTER COMPLETION OR ATTEMPT OF VALIDATION OR OPERATION
FIG. 16
STORE DIAGNOSTIC CODE STORE LAST KEY USED LEVEL, TYPE AND RECORD #
LOCK SHUT DOWN MODE COUNTER < 10?
KEY INVALID ?
NO
YES
COUNTER = 10?
NO
YES
KEY'S LEVEL & TYPE = LAST KEY USED LEVEL & TYPE?
YES
NO
KEY = LAST KEY LEVEL, TYPE & REC. #?
NO
YES
KEY INVALID ?
YES
NO
KEY INVALID ?
NO
YES
INCREMENT SHUT DOWN COUNTER
STORE DIAGNOSTIC CODE, KEY LEVEL, TYPE AND REC. #
SHUT DOWN COUNTER = 10?
SET SHUT DOWN COUNTER = 0
ENTER INTERR. RECORD, SET COUNTER = 12, BEGIN SHUT DOWN CYCLE
STORE DIAGNOSTIC CODE KEY LEVEL, TYPE & REC. #
SET LAST KEY USED LEVEL = KEY'S LEVEL TYPE & REC. #
LOG INTERR. RECORD
SET COUNTER = 12, BEGIN SHUT DOWN CYCLE
PERFORM APPROPRIATE FUNCTIONS
SET SHUT DOWN MODE COUNTER = 12
LED DIAGNOSTIC MODE ON AND ERROR OCCURRED?
DISPLAY DIAGNOSTIC CODE
DISPLAY APPROPRIATE LED'S FOR NORMAL DISPLAY
END

LED DIAGNOSTIC MODE

ADAPTABLE ELECTRONIC KEY AND LOCK SYSTEM

This is a continuation-in-part of application Ser. No. 0/661,542 filed on Feb. 26, 1991, now U.S. Pat. No. 5,198, 643.

FIELD OF THE INVENTION

This invention relates to security devices; more particularly, it relates to a computer controlled locking system especially adapted for use as a door lock.

BACKGROUND OF THE INVENTION

Hotels, office buildings and the like require door locks on a large number of individual rooms. In a hotel, for example, the door lock of each guest room should have a different key for successive guests. Also, at a given time, a guest room door lock must be operable by different keys assigned to hotel personnel, such as the maid, housekeeper and other levels of hotel management. For security purposes, the keys for each lock must be readily changeable.

In the prior art, locking systems for hotels and the like have been developed which utilize electronic code responsive logic circuits for operation of a lock mechanism.

U.S. Pat. No. 3,906,447, issued Sept. 16, 1975 in the name of Crafton discloses a security system for locks and keys wherein the entrance of an area is controlled by an electronic lock mechanism responsive to a digital coded key. A key code is stored in each lock mechanism and is compared with the key code on a digital coded key. If correspondence exists, entrance to the secured area is granted. Imprinted on the key is an order code which corresponds to the time the key is issued. The lock mechanism operates to compare the order code on the key presented to it with the time of presentation, and if the time difference is within a predetermined time interval, the key code on the key is set to the lock mechanism. Furthermore, the time of departure code is imprinted on the key when issued and is entered into the lock mechanism when the order code is presented thereto. When the departure time is reached, the lock mechanism automatically changes at random the stored key code, thus preventing the guests from entering the room. Also included is the provision for a pass key. The room register associated with pass key circuitry at each lock mechanism contains a common arbitrary room number. The grace period is set equal to the length of the work shift and the time of departure is set to correspond to the end of the work shift.

U.S. Pat. No. 4,385,231, issued May 24, 1983 in the name of Mizutani et al discloses a lock system for use with cards. Cards have recorded thereon a secret number, a plurality of subnumbers, a specifying code for selecting at least one of the subnumbers, and an effective period. The lock includes a card reader, a memory for storing a secret number, specifying code and effect period, and a processing unit for unlocking. When the secret number on the card is identical to that in memory, unlocking occurs. If the secret number on the car is not identical with the secret number in the memory, the processor checks whether or not the secret numbers are in predetermined relation established with use of the subnumbers selected by the specifying code in the memory from among the plurality of subnumbers on the card, and gives an unlocking instruction and stores in memory for renewal of the secret number, the effective period and the specifying code on the card.

U.S. Pat. No. 4,644,484, issued Feb. 17, 1987 in the name of Flynn et al discloses an access control system utilizing a clock. A card reader has a crystal controlled time based clock. Entry is granted when the proper information is entered to the card reader through a key. The card reader is operable to provide access control of the secured area according to a schedule operable relative to the card reader clock without external reference signals. A dipswitch is used to compensate for crystal variations. Software adjustment is provided to the time base clock.

A general object of this invention is to provide an improved security device which is especially adapted for use in controlling a door lock mechanism and which overcomes certain disadvantages of the prior art.

SUMMARY OF THE INVENTION

The invention is utilized in a locking system of the type comprising a lock including a locking means to place the lock in a locked or unlocked condition and a microcomputer including memory. A plurality of keys of different types each may have a key code and a key level code stored thereon. The memory has a control program stored therein for program control of the microcomputer. A key reader is coupled with the microcomputer and is adapted to coact with any one of the keys to read the key code and level code stored thereon into the microcomputer. An electrically controlled actuator for controlling the locking means is coupled with an output of the microcomputer.

The keys include a selected key having a valid day code stored thereon indicative of which days of the week the key will be operative to unlock the locking means. The lock includes clock means for producing a clock signal indicative of real time. The memory means includes a timing register for storing real time and day based on the clock means. The microprocessor operates under program control for receiving the valid day code from the selected key and for comparing same with the timing register to allow operation of the lock means when the valid day code has a predetermined relation with the day stored in the timing register, and to prevent operation of the lock means when the valid day code does not have a predetermined relation to the day stored in the timing register such that the selected key designates valid days of operation allowing different keys to designate and operate on different days.

The keys also includes a selected key having a key offset time stored thereon and a key time stored thereon indicative of a time of issuance. The memory means also includes an expiration field for storing an expiration time based on the key expiration time. The microcomputer operates under program control for reading the key offset time and key time to calculate the expiration time by summing the key expiration time with the key time and for operating the lock when the real time is less than the expiration time and for inhibiting operation of said lock when the real time is greater than expiration time.

The keys also include a selected key having a function thereon. The memory includes an information code area for storing a plurality of codes identifying different operational information of the lock. The lock includes a plurality of light means for visually displaying a plurality of codes by change in combination and repetition of the light means. The microcomputer operates under program control for reading the selected key and the function and for obtaining one of the information codes based on the function to display the information code by illuminating the light means in a predetermined combination and repetition.

The keys also include a display key having a function field thereon for designating conditions in the lock to be monitored. The memory includes a code storage area for storing a plurality of codes to identify different lock conditions occurring in the lock. The lock includes a plurality of light means for visually displaying a plurality of codes by change in combination and repetition of the light means. The microcomputer operates under program control for reading the display key and the function field to monitor the lock conditions identified by the function field and status thereof in the lock, and for displaying the condition by control of the light means.

The keys include a selected operation key for operating the lock, and a diagnostic key for operating a diagnostic mode of the lock to provide error information. The memory includes an information code area for storing a plurality of error codes identifying different errors potentially occurring in the lock in response to reading any keys. The lock includes a plurality of light means for visually displaying a plurality of codes by change in combination and repetition thereof. The microcomputer operates under program control for reading the diagnostic key to set the lock in diagnostic mode and for reading the operation key to determine an error in execution thereof, and for obtaining one of the plurality of error codes based on the error in execution to display the code by the light means when the lock is in diagnostic mode.

DESCRIPTION OF THE DRAWINGS

A complete understanding of this invention will be obtained for the detailed description that follows when taken with the accompanying drawings.

FIG. 3A shows a standard magnetically coded key;

FIG. 3B shows a special key apparatus for interrogation;

FIG. 7 illustrates typical fields on a standard key;

FIGS. 9A, 9B, 10A-1, 10A-2, 10B-1, 10B-2, 10C, 10D, 10E, 10F, 10G, 10H, 10I, 10J, 10K, 10M, 1-N, 10O, 10P, 11-13, 14A-1 14A-2, 14B, 14C, and 15-18 show flow charts representing the control program of the microcomputer.

BEST MODE FOR CARRYING OUT THE INVENTION

Figure 1:
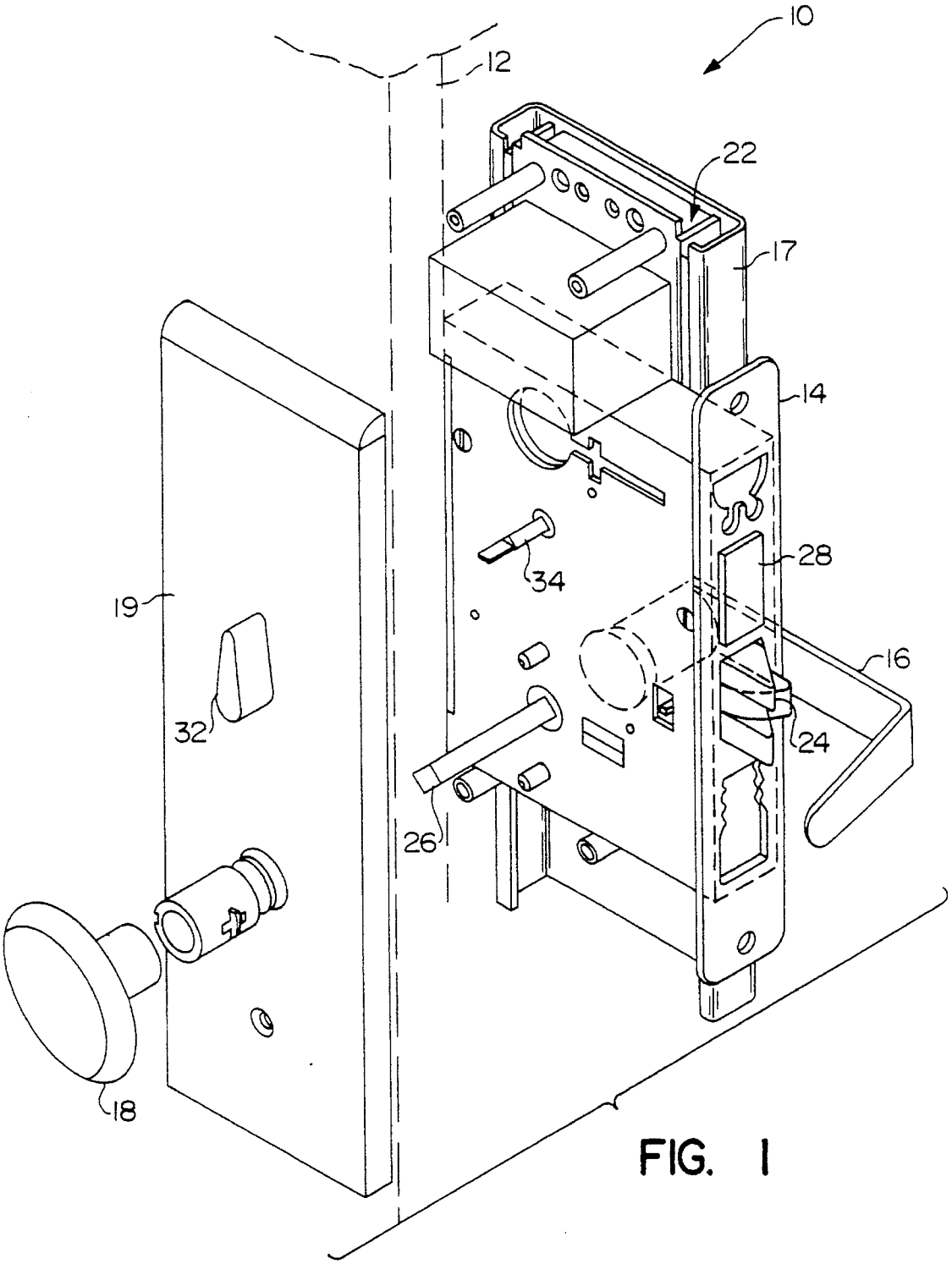
FIG. 1 shows a door lock embodying this invention installed on the door.

Referring now to the drawings, there is shown an illustrative embodiment of the invention in the microcomputer lock control system for use in the door locks of a hotel or other housing structure. It will be appreciated as the description proceeds that the invention is useful in many other applications and may be utilized in different embodiments.

Mechanical Lock Components

FIG. 1 shows the locking system or control system of this invention installed in a door lock as used in a hotel. The door lock 10 is installed on a door 12. It comprises, in general, a conventional mortise lock 14 installed in the door 12, an outside doorknob 16, an inside doorknob 18, and a lock control system 22. An external lock plate 17 and internal lock plate 19 are secured about the lock 10. The lock 10 is provided with a locking means in the form of a conventional retractable latch 24 which is operable by the doorknob shaft 26 which may be actuated directly by the inside doorknob 18 or may be operated through the lock control system 22 by the outside doorknob 16. The lock 10 also includes a deadbolt 28 which is actuatable by a deadbolt handle 32 on the inside of the door through the dead bolt shaft 34. Also, as provided in the conventional lock 14, the dead bolt 28 is retracted concurrently with the retraction of the bolt 24 by actuation of the inside or outside doorknob. A key 34, in the form of a magnetically coded key, is a part of the lock control system 22 for initiating the manual control of the lock, as will be described in detail subsequently.

Figure 2A:
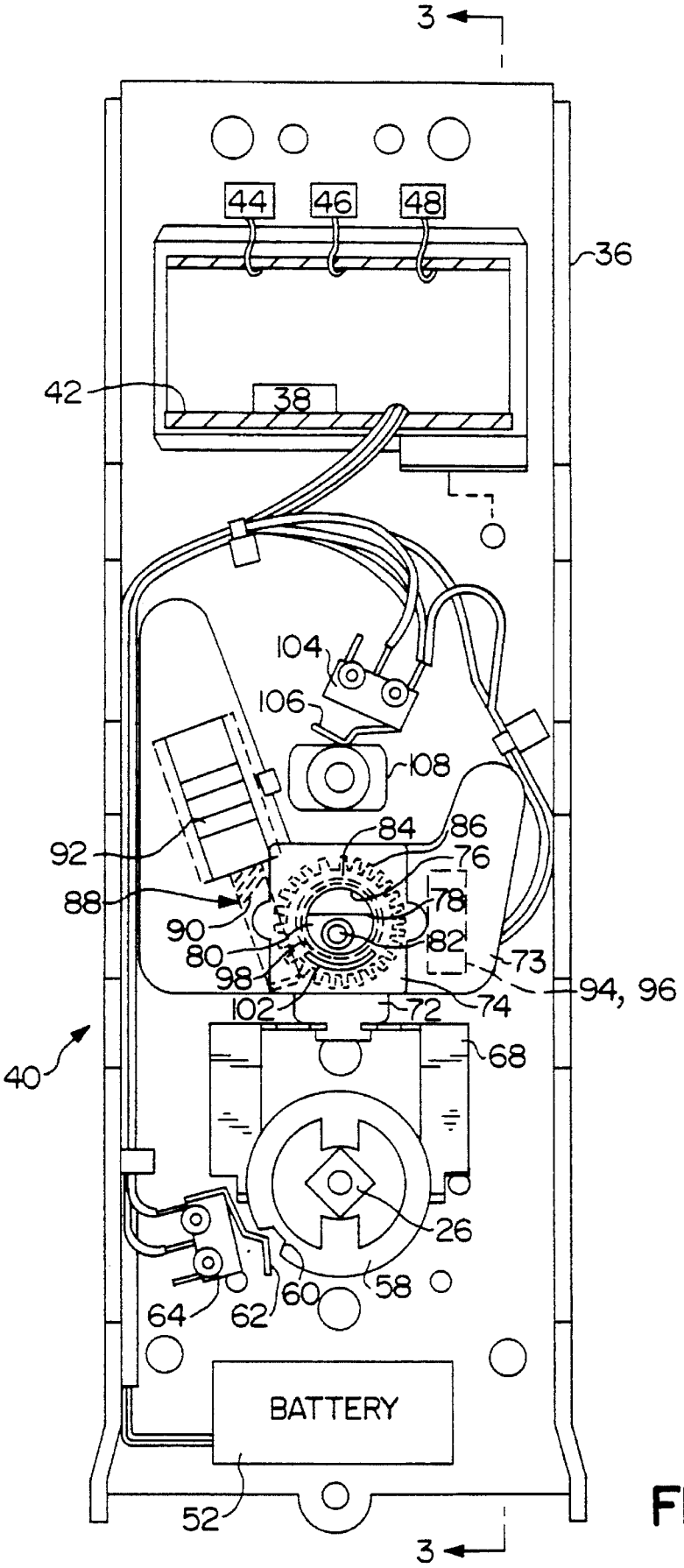
FIG. 2A is a front elevational view, partially in section, of the lock control mechanism.
Figure 2B:
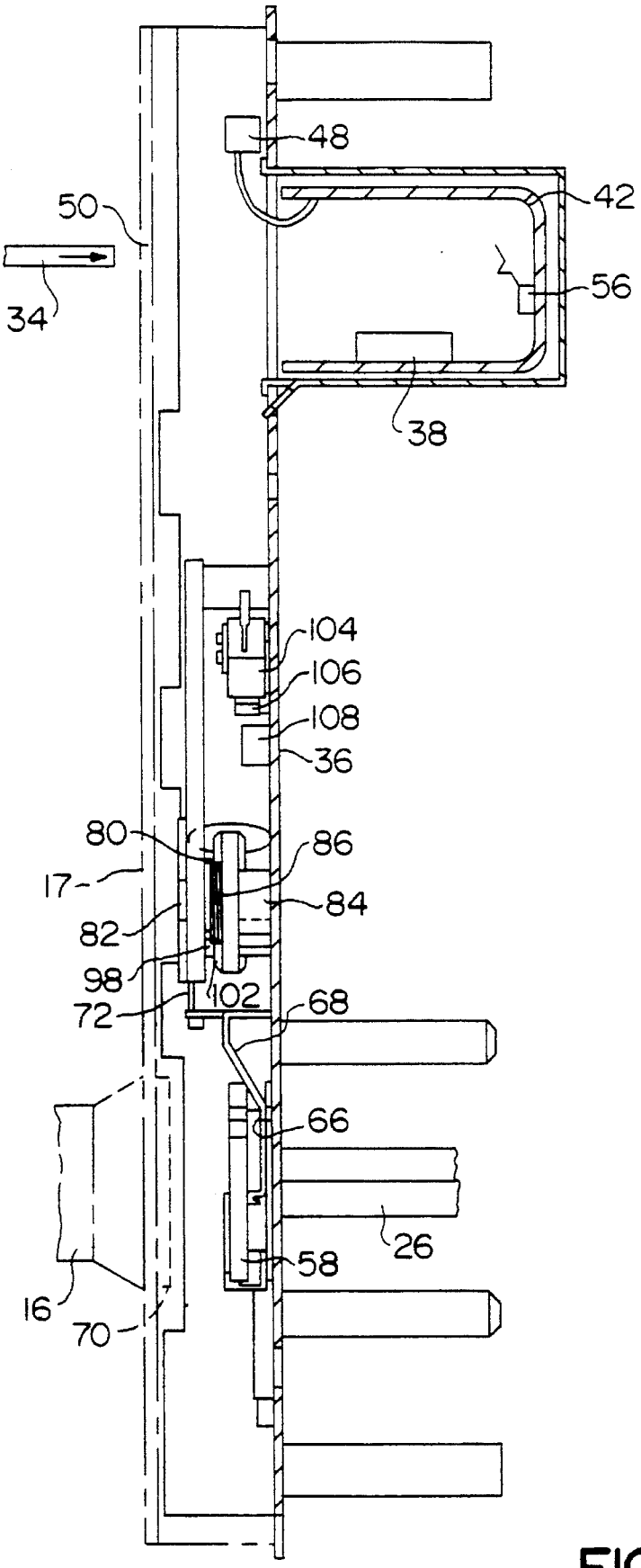
FIG. 2B is a side view, partially in section, showing parts of the lock control mechanism.

The lock control system 22 is shown in greater detail in FIGS. 2A and 2B. In general, it comprises a lock body 36 which houses a key reader 38, an electrically controlled actuator or a lock control mechanism 40 and a microcomputer circuit board 42. It also houses a set of indicator lamps comprising green LED 44, a yellow LED 46 and a red LED 48 which are viewable through apertures 50 in the lock body. A pair of batteries 52 are installed in the body 36.

Key Reader and Switch

The key reader 38 includes a slot 54 adapted to receive the key 34 and a key switch 56 which is actuated to a closed condition upon full insertion of the key 34 and it is actuated to an open condition upon withdrawal of the key. The key switch 56 is activated when a key 34 or other item is inserted which in turn wakes up the lock and prepares the lock to read the data on the key 34. The key reader 38 is a magnetic key reader adapted to pick up the magnetically coded information or bits on the key 34 and will be described in greater detail subsequently.

Knob Turn Actuator and Switch

The door knob shaft 26 is non-rotatably connected to a shaft clutch member 58. The clutch 58 is generally disk shaped with a notch 60 therein. The notch 60 receives a contact arm 62 of a knob turn switch 64. In its non-rotated and nonopening mode, the contact arm 62 rests within the notch 60. Upon rotation of the door knob shaft 26 to rotate the clutch 58, the switch 64 is activated by movement of the contact arm 62 out of the notch 60. The knob turn switch 64 is activated when the knob shaft 26 is turned approximately 9' to 10', and is deactivated upon return of the knob shaft 26 to the same location. Both motions will activate the lock if it is not already activated. The clutch 58 includes a perimeter groove 66. A shift fork 68 includes arms pivotally secured within the perimeter groove 66. The shift fork 68 pivots in opposite directions for moving the clutch 58 in the retracted and extended position. The outside door knob 16 includes a shank clutch 70 connected thereto. The clutch 58 matingly engages the shank clutch 70 in its extended position allowing unlocking of the door and disengages same to prevent opening of the door. A slide member 72 is fixedly attached to the shift fork 68 for pivoting same in the opposite directions. The slide member 72 is slideably retained on a support plate 73 by a bracket 74. The bracket 74 includes a circular aperture 76 therethrough, and the slide member 72 includes a rectangular aperture 78. An actuation gear 80 includes a tab 82 extending therefrom for engaging said apertures 76, 78. The actuation gear 80 is rotatably controlled by and operatively connected to a worm gear 84. A spring 86 is connected about the gears 80, 84 for biasing the actuation gear 80 to follow movement of the worm gear 84. As the worm gear 84 rotates in a first direction, the actuation gear 80 follows moving the tab 82 in an upward direction therefore pulling the slide member 72 and extending the clutch 58. As the worm gear 84 rotates in a second and opposite direction, the opposite operation occurs retracting the clutch 58. The worm gear 84 includes coacting teeth 86 for engaging a worm shaft 88 having threads 90 thereon.

Motor/Solenoid Actuation

A motor 92 rotates the worm shaft 88 in a first direction therefore causing rotation of the worm gear 84, and rotates in a second direction to move the worm gear 84 in the opposite direction. A solenoid may be utilized wherein the solenoid is connected directly to the shift fork 68 for controlling the pivotal movement.

Motor Switches

In the motor embodiment, included are two motor turn switches 94, 96. A first motor switch 94 is connected adjacent the worm gear 84 such that actuation and rotation to a first stroke actuates the motor switch 94 for turning the motor off. The worm gear 84 includes a tab 98 which engages the switch 94 upon rotation to a predetermined position. The second motor switch 96 is connected adjacent the actuation gear 80 for providing a limit signal upon rotation back to the normal state indicating a stroke. The actuation gear 80 includes a tab 102 extending therefrom for engaging the switch 96 upon rotation back to the starting position. The unlock motor switch 94 is activated when the motor 92 has run fully in the forward direction to unlock the door such that the lock shuts off the motor 92. When it begins to run in the reverse direction, the switch 94 is deactivated. The locked motor switch 96 is activated when the motor 92 runs fully in the reverse direction to lock the door. When it begins to run in the forward direction, the switch 96 is deactivated.

Dead Bolt

The lock control mechanism 42 also includes a dead bolt switch 104 which is adapted to develop a signal indicative of whether the dead bolt is thrown or retracts. The switch 104 includes an arm 106 adjacent an elongated rotating member 108 attached to the dead bolt shaft 34 wherein when the dead bolt 28 is thrown, the switch 104 is closed by contact of the arm 106 with member 108. When the dead bolt 28 is retracted, the switch 104 is open.

Lock Control Circuitry

Figure 4A:
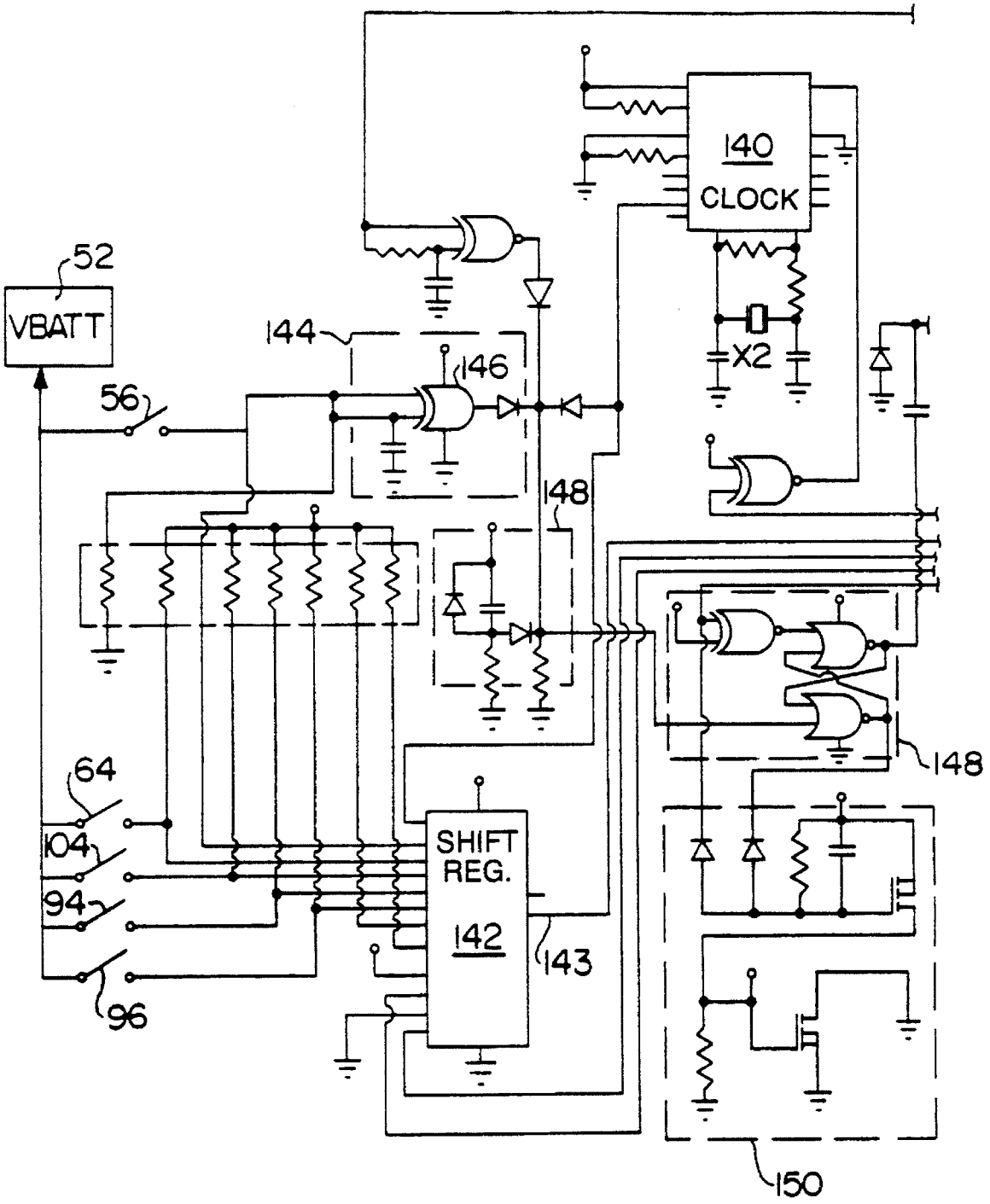
FIGS. 4A–4B show the microcomputer and the electronic control circuit.
Figure 4B:
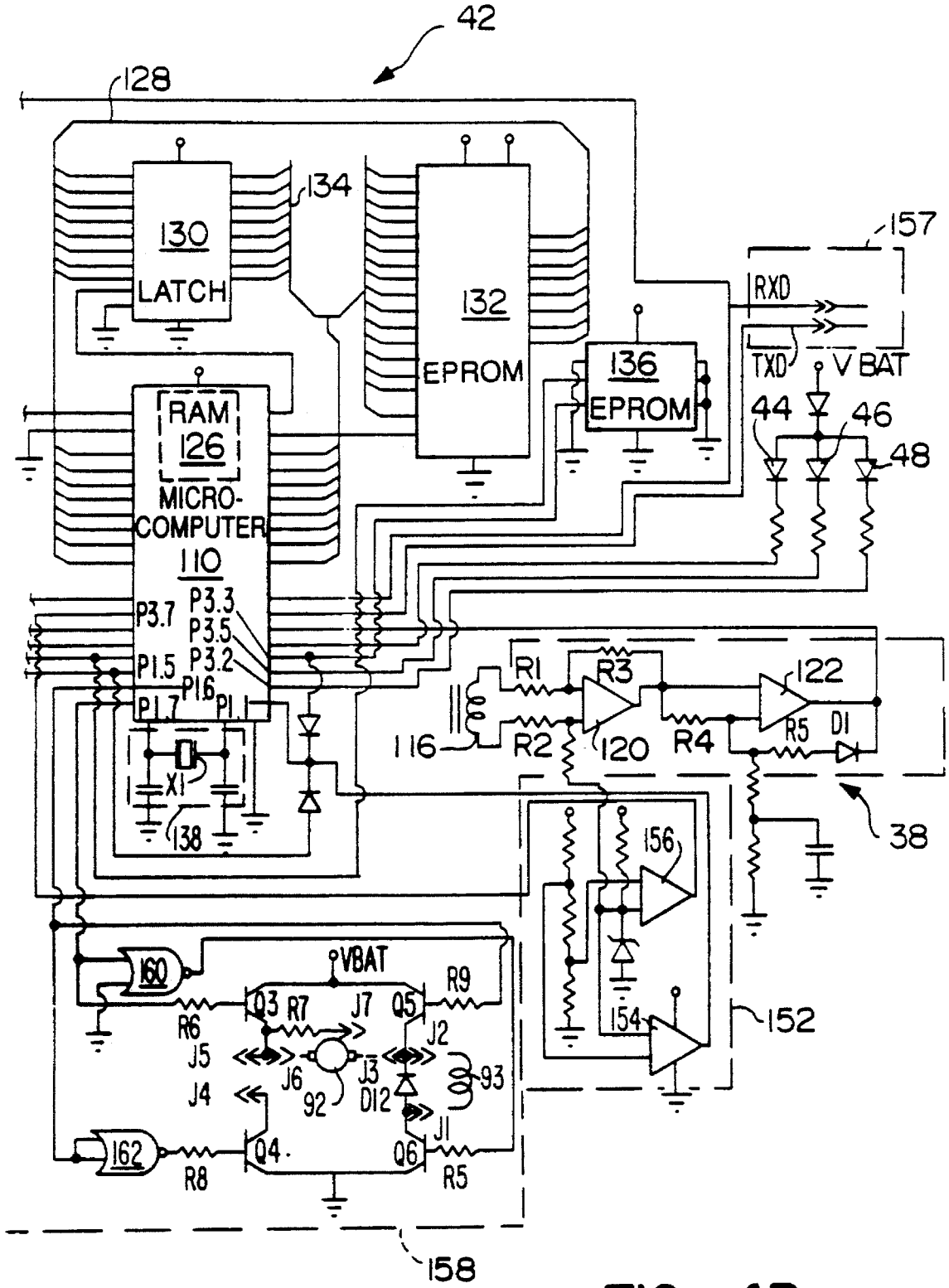

Referring now to FIGS. 4A and 4B, the microcomputer lock control circuit 42 will be described. The microcomputer 110 is a single chip, eight bit microcomputer; in the illustrative embodiment, it is a series N80C31BH made by AMD. The key reader 38 is controlled by and provides input to the microcomputer 110 as follows.

As described above, the recorded code on the key 34 is read from the key in a single stream of data. For this purpose, the magnetic key reader 38 is provided as shown in the schematic diagram of FIGS. 4A and 4B. The magnetic key reader 38 comprises a magnetic tape read head 116 which coacts respectively with the recording track 114 on the magnetic stripe of the key. The read head 116 suitably takes the form of a conventional stereo pick up or read head. The magnetic read head 116 is connected with a differential amplifier circuit wherein the signal from the magnetic read head 116 is received through a pair of resistors R1, R2 to the inverting and noninverting inputs of an operational amplifier 120 having feedback through the resistor R3, and the output connected to the inverting input of the second operational amplifier 122 having its noninverting input connected through a resistor R4 to the output of the first operational amplifier 120. Feedback is provided between the output and the noninverting input through a resistor R5 and diode D1 series wherein the output produces the digital signal which is transmitted to the microcomputer 110. The key switch 56 is actuated to a closed condition upon full insertion of the key and it is actuated to an open condition upon withdrawal of the key. Thus, the data stream which is produced by the magnetic read head 116 from the recording track 114 on the key 34 is read into the microcomputer 110 upon withdrawal motion of the key. The motion of the key 34 causes a signal voltage to be induced in the read head 116 in accordance with the recorded magnetic signal on the respective track 114.

Figure 5:
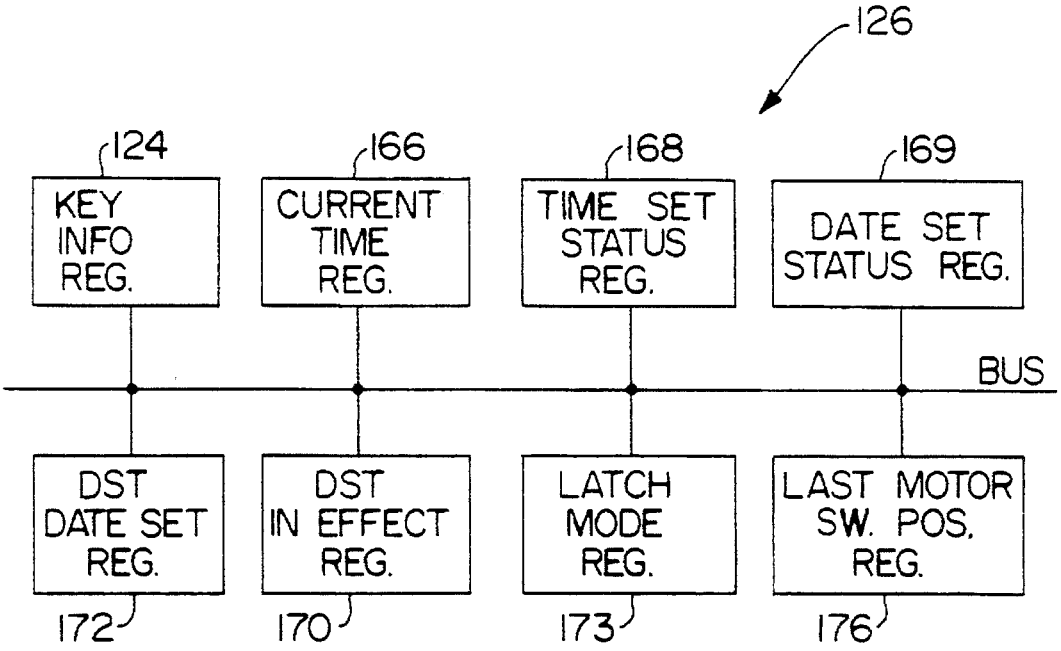
FIG. 5 shows the RAM storage areas.
Figure 6:
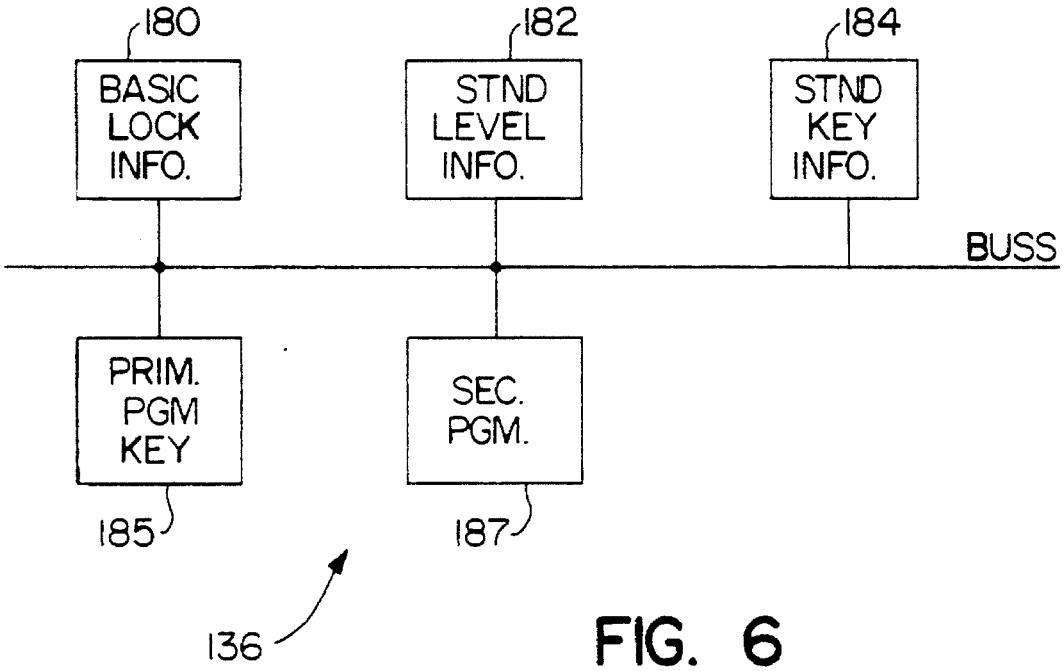
FIG. 6 shows the EEPROM storage areas.
Figure 8:
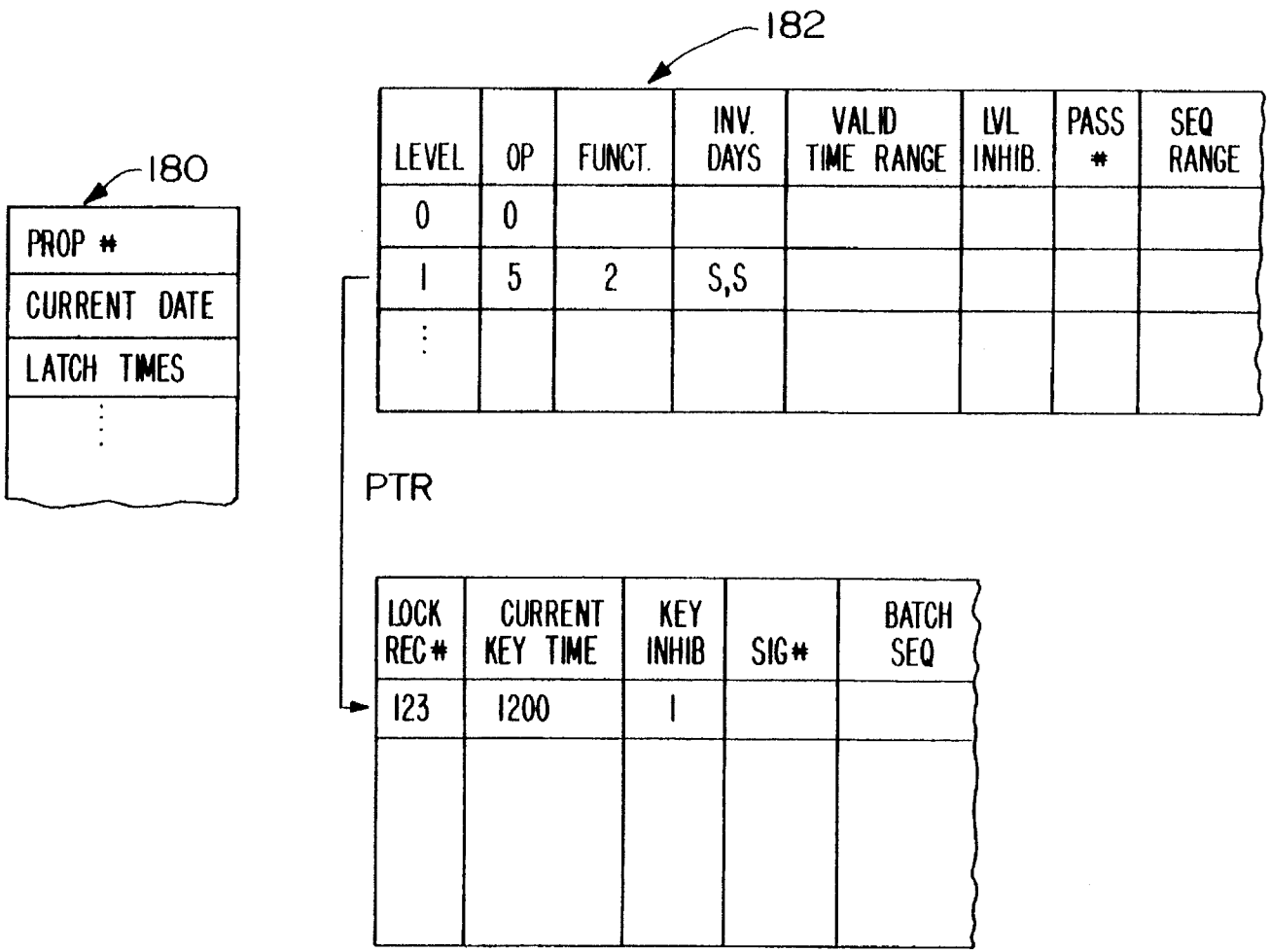
FIG. 8 illustrates an example of the standard lock memory areas.

The 147 bits received from the key 34 are stored in a key information register 124 in the random access memory (RAM) 126 of the microcomputer 110 (See FIG. 5).

The key information is read into the microcomputer 110 from the key reader 38 and is temporarily stored in the key information register 124. The key information includes coded information of various fields depending on the key recognition code field and key type field. All keys include common fields to determine the key types which are initially identified from the key code, as subsequently discussed.

The microcomputer 110 includes the RAM 126. The microcomputer 110 is connected to an address bus 128, which is connected to an eight bit octal latch 130 of the type MC74HC573ADWR2 manufactured by Motorola. The address bus 128 is also connected to a 32K×8 bit EPROM 132 of the type AM27X128-150JC made by AMD. The data from the latch 130 and PROM 132 are transmitted to the microcomputer 110 over a data bus 134. Also included is an EEPROM 136 of the type X24LC04S by XICOR which is in direct communication with the microcomputer 110. The microcomputer 110 controls the green, yellow, and red LEDs 44, 46, 48 through its P3.3, P3.5 and P3.2 ports. The microcomputer 110 includes an oscillator circuit 138 for providing timing thereto by a crystal quartz oscillator X1 operating at 5.5 MHz. A real time clock 140 is of the type MC14521BD by Motorola for maintaining real time of the system and triggering the microcomputer 110 every 64 seconds. The clock 140 includes an external crystal controlled oscillator X2 operating at 32.78 Kz. A serial shift register 142 of the type MC74HC165D by Motorola samples the data from the key switch 56, knob turn switch 64, dead bolt switch 104 and motor switches 94, 96, and produces the serial input 143 to the microcomputer 110 as to their statuses. The key switch 56 is also connected to a wake-up circuit 144 including an exclusive OR gate 146 which provides a wake up pulse to a power supply circuit 148. If the battery 52 is disconnected, the pulse will reset the power to the microcomputer 110 upon insertion of a key 34. A power switching circuit 150 is controlled by the microcomputer from its output P1.5 for powering the external memory components 132, 136 when required for access. Otherwise, in order to conserve battery power, power is eliminated from these devices until needed. A low battery shut down circuit 152 is connected to the battery 52 for monitoring when the battery charge falls below a first predetermined magnitude, and for shutting down the circuit when it falls below a second predetermined magnitude. A first comparator 154 transmits a low battery signal to the Pi.1 input of the microcomputer 110, and a shut down signal is transmitted to the P3.7 input from a second comparator 156. Data and commands may be communicated directly to the microcomputer 110 by a serial input port 157. This may be used for programming, testing, and interrogation.

Actuator Control Circuit

An actuator control circuit 158 is connected with the microcomputer 110 for controlling either the motor 92 or if the lock has a solenoid 93 instead of a motor, it controls the solenoid. Outputs P1.6 and P1.7 from the microcomputer 110 control the driving and direction of the motor 92 (or solenoid 93). A first OR gate 160 is connected to the P1.7 output and to ground for driving a transistor Q6 through a base resistor R5 having its emitter connected to ground and its collector to diode D12 and junction J1.1. The P1.7 output also drives a second transistor Q3 through a base resistor R6 having its emitter connected to the battery voltage and its collector connected through a resistor R7 to junction J7, and to junctions J5 and J6. The output P1.6 is connected to a dual input OR gate 162 for driving through resistor R8 a transistor Q4 having its collector connected to junction J4 and its emitter connected to ground. The output P1.6 also drives through a base resistor R9 a fourth transistor Q5 having its emitter connected to the battery and its collector connected to junction J3 and junction J2, and to diode D1. When the motor 92 is utilized, junction J4 and J5 are connected together, and junctions J1 and J2 are connected together. The motor 92 is connected between junctions J3 and J6. When a solenoid 93 is utilized, junctions J7 and J2 are connected together and the solenoid 93 is connected between junctions J1 and J2. The microcomputer 110 remains in a stand by mode with minimal power supplied thereto to maintain RAM 126 until each 64 seconds occurs or until the key switch 56 activates the system.

Solenoid Hardware

The hardware used in U.S. Ser. No. 426, 502 filed Oct. 23, 1989 in the name of Fraser, and assigned to the assignee of the subject invention discloses the hardware of a lock operated by a solenoid for locking and unlocking same, and is incorporated by reference herein.

Clock

The real time clock 140 is crystal controlled with dividers so that an update of the locks internal time is set every 64 seconds. The EPROM 132 contains all the permanent instructions for the lock input/output and operating program including all routines in program memory. The EPROM 132 is a one-time programmable chip and is programmed prior to being soldered into the lock. The internal RAM 126 is 128K bytes and is used for working space. The lock's internal time is also stored in RAM 126. The EEPROM 136 is 512 bytes and is used for data storage, including all variable program settings and statuses and interrogation records. The EEPROM 136 is updated continuously by the lock since it stores all the changeable information and interrogation records. The EEPROM 136 will also allow memory to be maintained when the batteries are disconnected. Additional EEPROM or EPROM chips may be used if necessary for additional capacity.

Clock and Date Storage

The internal clock current time is stored in a 7 bit register 166 which the lock uses for its internal time which is stored in RAM 126. The crystal X1 outputs a pulse every 64 seconds to update the time. The time is initially in nondaylight savings (non-DST) time. An unprogrammed or unpowered lock or one reconnected to battery power, will first start out with the time of 00:00:00. The time and date can be programmed using keys. As subsequently discussed. The 17 bits of the current time field will support the hour, the minute, and the second.

Additional RAM Registers

As illustrated in FIG. 5, the RAM 126 includes a time set status register 168 which is set by the microcomputer to indicate whether the locks internal clock has been set after powered up. Any time battery power is restored, this bit will always start at zero indicating the time register 166 is not set. Once the locks internal clock time and date are programmed, the microcomputer 110 will set this bit to 1. A date set status register 169 is set by the lock when the date is set in the EEPROM 136.

A DST date set status register 172 indicates whether DST data in the EEPROM is valid for the current clock date year in the EEPROM. A DST in effect status register 170 indicates whether DST is in effect and whether the time is in DST or non-DST time.

The intended latch mode register 173 is a bit which indicates the status the lock should be in (1=unlatched when RAM is lost and 0=latched) when RAM 126 is lost, and always goes back to latched mode. This also checks before the lock ends a key cycle to see if it should relock the door before going into stand by.

The last motor switch position register 176 includes two bits which are used by the lock to determine what the last positions of the motor switches 94, 96 were, e.g., zero equals deactivated, one equals activated. They are used when it checks the motor statuses to determine whether a switch 94, 96 is changing positions during a cycle. The value of this register 176 is set to the statuses of the switches 94, 96 prior to every motor command and are compared to the switch position after every motor command is completed. The lock failure bit field indicates whether a failure has occurred with the mechanical lock indicating lock instructions are not being implemented.

General Key Types and Operation

The key 35 referred to above, will be described in greater detail with reference to FIGS. 3A and 3B. Multiple keys of the type shown in FIG. 3 may be issued for use with the same lock and some will be used with more than lock, as will be described subsequently.

The magnetic key 35 comprises a card 112, suitably of opaque plastic material, which carries a magnetic band or stripe 114. The magnetic stripe 114, in the nature of a stereo recording tape, has a single record track. The track 114 is recorded with an undulating magnetic field which, in analog signal form, represents a sequence of magnetic poles. The track is encoded with a magnetic signal which represents one hundred forty seven bits of information. As will be described subsequently, the magnetic key 35 is read by the key reader 38 which converts the magnetic signals of the track 114 to electrical signals.

With respect to the key, the key 35 is inserted into the lock up to the center line of the read head 116. A certain amount of the space is reserved for no data to insure the read head can locate the beginning and ending of the data bits and the remaining is reserved for the data bits. Up to 147 bits of data are located on the key.

Generally, the different key types are as follows: standard level key, primary program key, secondary program key, program information keys, interrogator key, diagnostic key, and display keys. The standard level key is used for normal purposes such as opening doors, inhibiting keys, electronically locking doors, etc. The primary program key is a special key corresponding to a special lock level that allows higher security programming for the standard levels, such as changing a level's programming or room number, and for programming the general lock area of the EEPROM 136. The key is always used in conjunction with a program information key. The secondary program key is a key corresponding to a special lock level and its only purpose to reprogram the primary program key level when necessary. The program information keys identify and contain the information to be programmed into a lock level or the general lock EEPROM. The interrogator key is used to communicate information of lock information external to the lock. The diagnostic key is used to turn on and off LED diagnostic display mode which visually displays error codes. The display keys allow specified lock conditions to be displayed by LED codes.

EEPROM Format

The EEPROM 136 is divided into eight general areas. A first area is the basic lock information storage area 180 which stores information general to the lock and not to any particular key type. A second area is the standard level information area 182 which stores status and operational information related to a particular key level, which may be associated with a plurality of different keys. A third area is the standard key information area 184 which stores status and identifier information for particular keys by a key record number and which are associated with a particular key level. The remaining areas are the primary program key storage area 185, secondary program key storage area 187, interrogation records area 188, LED diagnostic code area 189, and display key code area 190.

EEPROM—General/Basic Memory

In EEPROM 136, the basic lock information area 180 is divided into condition and status fields. The information initially in the condition fields is preprogrammed into the lock, and the information in the status fields is never programmed into the lock.

The condition fields include the property number field which serves to keep keys from one property from working in another. The internal current date field records the current date in the lock. As the clock time in RAM 126 changes from hour 23 to hour 00, one day is added to this field. Leap years would automatically be determined by the microcomputer. The field includes the month, the day, and the year.

The clock set condition-shift keys field determines how the lock will deal with shift keys if the lock's internal clock has not be set. If the clock set bit field=1, the lock ignores this field. If the clock bit field=0, indicating the internal clock has not been set, the microcomputer 110 checks this field any time a shift key is used. If the value of this field=0, shift keys do not work at all. If the value of this field=1, shift keys work at all hours of the day.

The current day field keeps track of the day of the week.

The invalid day field is a bit used to determine how the microcomputer 110 deals with keys with invalid days or lock levels with invalid days if the lock's current day of week has not been set. If the current day field=0, indicating the day of week has not been set, the microcomputer 110 checks this field any time a key with invalid days is used or a key for level with invalid days is used. If the value of this invalid days field=0, keys with any invalid days in the field or keys to a level with any invalid days will not work at all. If the value of this invalid days field=1, these keys will work all days of the week.

The DST observance field identifies whether and how the lock will deal with DST time changes. The following options are included: field=0, standard time always; field=1, standard USA dates for changes at year on first Sunday in April and first Sunday in October; field=2, standard local dates for changes at year occurrence of particular day of week for set months of year; field=3, nonstandard date changes at year varies every year. The lock maintains its clock time equal to watch time, e.g., changes for DST and back again, and will log an interrogation record when it changes it. When the DST dates set bit=0, the lock's time is not reset until new DST dates have been provided for the proper year.

The DST programmed field indicates if the lock was ever programmed by the program information key.

The DST months/time field applies if the DST Observance field=2. If these fields are zero, the microcomputer 110 assumes that it does not know when DST changes occur and it will always allow the start time to be one hour earlier than the times provided on the key. The field includes the month, the day of week, the day of week occurrence in the month, e.g., 1st, 2nd, 3rd, etc. the hour and the minute.

The DST dates/times field applies if the DST observance field=3. If this field is zero or the dates change every year and the lock's current date is 11 months past the DST start date, the microcomputer 110 assumes that it does not know when DST changes occur and allows the start time to be one hour earlier than the times provided on the key. If the start year field is set to 10, it indicates the dates stay the same every year. If this field is less than 10, the DST date changes have to be programmed into all the locks once a year. The field includes the month, the day, the year, the hour and the minute.

The automatic latch/unlatch field is used to identify the days and times the lock should automatically go into unlatched and a latched modes. When the lock is unlatched, no keys are necessary in order to open the door, however, keys can still be used. When it is latched, the door can only be opened with valid keys. When the lock's internal clock time reaches an unlatch time, the lock automatically goes into unlatch mode. When the latch time is reached, it automatically goes into the latched mode. A plurality of latch and unlatch intervals are allowed and each record consists of four values: Unlatch Day of Week, Unlatch ½ Hour, Latch Day of Week and Latch ½ Hour.

The latch disable field indicates whether the lock ignores the automatic latch and unlatch times. If this bit is 0, it indicates automatic latch/unlatch is in effect, otherwise the lock ignores automatic unlatch and latch records.

The lock hardware mode field defines special lock operation considerations related to physically different hardware. The first two standard modes identify whether a solenoid or motor is in use. In the standard modes, the microcomputer 110 waits for the knob turn switch to consider the door opened. In remote mode, the microcomputer 110 assumes there is no knob turn switch 64 and automatically opens the door. The remote mode is used for elevators and remote locks which do not have a door knob or a switch to identify that the door was physically opened or elevator activated. The field is set as follows: elevator reader/remote reader=0, remote reader with remote motor board=1, solenoid door lock=2, and motorized lock=3.

The status fields include the following fields. The last key level field stores the level of the last key used whether or not it worked. The last key type field stores the key type of the last key used, whether or not it worked. Also included is the diagnostic status field which indicates whether or not the diagnostic mode is on or off.

Interrogation Records

The interrogation storage area 188 stores the information regarding any key which opened the door or affected the state of the lock. Only keys that are valid and were able to complete their intended purpose are logged in the storage area 188.

The interrogation storage area 188 may include any number of maximum records based on the available memory size. Once the maximum number of records have been written, the records will shift through so that a new logged record will replace the oldest record in the storage area 188.

The interrogation records include the following information: level; type; first used date and time; DST status; clock status (if set or not); opening capability, if new key; if new batch; if motor switch problem; low battery condition; number times knob turned; function; function intent; function performed; and last used time. The function, function intent and function performed depend upon the type of key. If a standard key is utilized, the function designates one of the following: not affect lock access, function is to latch/unlatch, function is to elect lock/unlock, function is to inhibit levels. The function intent indicates either latch, unlatch, lock or locked conditions. And the function performed is yes or no.

Special level keys utilize these three fields to indicate resequence key inhibit/uninhibit key and status of inhibit. For the primary and secondary program keys, these fields indicate the status of the key used after this key, i.e., LED diagnostic, nothing, etc.

Key Level and Type Designations

The EEPROM 136 is divided into various areas which are designated by key level recognition code field and key type code field. The type and number of fields are dependent vary for each field.

In general, the level recognition code is comprised of four bits of up to 16 levels, e.g., 0, 1, 2, 3, 4, 5, 6, 7, 8, 9, A, B, C, D, E, F. This field identifies the format of the remaining key's data. The variety of levels allows for a variety of operations by the key.

Level recognition codes 0–D are reserved for standard level keys and some program information keys. Level recognition code E is reserved for the secondary program key which allows reprogramming of the primary program level and, program information keys. The level recognition code F is for the primary program key which allows reprogramming of the lock general EEPROM fields, the secondary program key, remastering or programming the standard levels, interrogation key, display key, and diagnostic key.

The key type code is dependent upon which level recognition code 0–F is chosen.

The level recognition code and key type code combinations are as follows (level recognition code/key type code):

0–D/0 indicates a standard level key and is for general use by a guest or hotel personnel for opening and closing a door;

0–D/2 indicates program information key for level mastering and it identifies and contain the standard level key information to be programmed into or deleted for a lock level, i.e., allow a different room/master key to be programmed into a level. These keys require the primary program key to be first used;

0–D/3 indicates program information key for level programming and it identifies and contains the operational/functional information to be programmed into a lock level. These keys also require the primary program to be first used;

0–D/4 indicates program information key for pass operation mastering;

E/0 indicates the secondary program key and is associated with the lock level and allows reprogramming of the primary program level or allows LED diagnostics to be turned on;

E/1 indicates program information key for the general lock of basic information, and identifies and contain the information to be programmed into the general lock area of the EEPROM or RAM. It will program such things as the lock's basic information property number, lock address and number. This key will always require the primary program key to be first used;

E/2 indicates program information key for programming the internal clock;

E/3 indicates a program information key for a general lock programming for providing daylight savings time (DST) information;

E/4 indicates a program information key for general lock programming for auto latch/unlatch information;

F/0 indicates the primary program key and basically authorizes reprogramming of the lock level. The key is non-opening and does not affect any lock statuses when used. When used alone, the key authorizes use of a program information key or a secondary program key;

F/1 indicates LED diagnostic key which can turn on and off the LED diagnostic mode which displays error codes via the LEDS;

F/5 indicates the display keys for displaying lock information by the LEDs; and F/7 indicates the interrogator key which requests and communicates stored information and statuses to an external computer.

Lock Fields for Standard Key

The standard level lock fields (level recognition code=0–D, key type code=0) are stored in the EEPROM 136. These fields are accessed when a standard key is used.

In addition to the basic lock information area 180, the standard lock level fields codes 0–D stored in the EEPROM are organized as two areas: standard level information area 182, and standard key information area 184.

When the standard key is used, the level recognition code 0–D on the key points to one of the associated levels 0–D stored in EEPROM 136. The levels are independently programmed. All keys associated with a particular lock level, i.e., level 3, will operate according to the information stored in the standard level information area 182 in a particular lock within which it is being used. However, within the level, each key may cause a different operation according to the information stored in the standard key information area 184. It should be understood that a single key designating a single level may operate differently in two different locks, e.g., the level in one lock is programmed with a different operation than the other lock.

The subsequent description of level operations further explains the fields needed for the each operation.

Standard level information fields

The following fields are standard and are therefore included in each level.

The operation field indicates the basic way the level will identify valid keys and indicates how many different keys will operate for the level. The operations include: multiple, variable connector, pass, batch keys and nonoperating. The level function field provides eight functions which define how a key works in a particular lock. Both the operation and function may be further defined by subfunction fields and additional function information field, all of which will be subsequently explained.

The lock valid key time condition field indicates whether the microcomputer 110 uses the key's new and expiration dates and times to determine whether a key should time out or what hours it will work. The fields on the key that are used include the new and expiration times and the expiration date. The following settings can be chosen: field=0, indicates no shift or key expiration ignoring the expiration times and end date; field=1, indicates a shift with no key expiration using the start and end times, while ignoring expiration date; field=2, indicates no shift with key expiration ignoring the new or start time, while using the expiration time and expiration date; field=3 indicates shift with key expiration using the start and end times and end date.

The shift key expiration with lock's time not set field includes a single bit indicating whether to allow shift operation or not when the lock time is not set. The expiration with date not set field is a single bit which indicates whether to allow operation under this condition.

The level invalid days field indicates the days of the week the key level will not be allowed to operate the lock. Each of 7 bits corresponds to a day of the week, i.e., Sunday to Saturday. A 0 value for a bit indicates valid, and a 1 value indicate invalid. The invalid days with lock date not set field indicates whether to allow operation when the day of week field is net set.

The effective lock outs field indicates the lock out types that can electronically lock out the level's keys. Each of 2 bits corresponds to one of the two lock out types. A 0 value for a bit indicates that lock out type would not electronically lock out the level, a 1 value would indicate it would. If a lock out key was used the microcomputer 110 checks this field for all the levels. If the bit corresponding to the type of lock out is set to 1, then the lock changes the lock out status for the level. If the bit is set to 0, it would not.

The override deadbolt field is a single bit which indicates whether the key is to override and remove the physical deadbolt on the door. A 0 value indicates it is not able to override and a 1 value indicate it does override the deadbolt.

The clock reset hassle and lockout field indicates whether the level is affected when the lock's internal clock requires resetting. If so, it indicates how many times the user can continue to use a key with a hassle feature before the key is locked out.

The program group field is used in determining whether the lock level's program group code must match a Program Information—Level Programming key's effective program group code in order for the program key to work. If this field equals 0, it indicates the program group has never been programmed into the lock level and it will accept the program key's program group code as its own regardless of the key's effective program group value. The program group code, is assigned in the computer system and initially programmed into the lock using the Program Information—Level Programming key.

The number of times key used after clock reset hassle counter field is used to count the number of times a key from the level had been used once the lock's clock reset requirement was activated.

The level inhibit status field indicates whether the level's current key is inhibited or not inhibited. The electronic lock out statuses indicates whether the level's keys are electronically locked out by one or more of the electronic lock out keys.

The sequence number range allowed field is programmed with a sequence range. The microcomputer 110 accepts a new key provided the key's sequence number is equal to the lock's sequence number or within the number of progressions identified by this field. If the sequence range number is 1, then the microcomputer 110 will only accept the current or next new key sequence e.g., no new valid keys can be made and skipped by the lock. If the range is between 2 and 15, then 1 to 14 new keys can be made and not used and the microcomputer 110 still accepts the next new key. If the range is 0, then the microcomputer 110 ignores the sequence number as a criteria for validating the key, i.e., provides unlimited skips.

The invalid day operation with lock date not set field indicates if the lock will ignore the invalid day field when the lock date is not set, or prevent operation.

The number of keys mastered in level indicates the number of key record fields identified by record numbers that are stored in the key storage area 184 for the particular level.

The pass number criteria field includes a single bit wherein if the bit=0, only the property number match is required for the pass. If the bit=1, the property number and at least one pass number match is required, The operational times with time not set field includes a bit. If the bit=0, no operation occurs because the operating times can not be determined. If the bit=1, it operates any time.

The operational time criteria field—includes two bits wherein the bits=0, the level operates all the time, and the bits=1, the level operates between specified times of all days of the week. If the bits=2, the level operates between specified time of the day and different times for different days of the week.

The pass operation times with lock date not set field includes one bit.

The pass operation time—in hour and minutes stores the times for pass operation. If only one record, time is in effect each day. If several records, time is associated with day of week, i.e., first record is for Sunday, second record for Monday, etc.

The location of first key record field indicates the location in memory of the first key record associated with the level.

The actual fields utilized are dependent upon and listed under each operation subsection, subsequently discussed.

Standard Key Information Fields

The standard key information area 184 includes the following fields:

lock record number field—indicates the record numbers of the keys which work therein, lock combination code field—contains the key combination which is initially programmed therein, lock current date and time field—stores the new date and time of the last new key accepted for the level by month, day, year, hour, and minute; if the key is a shift key, the time is for shift, sequence number of last new key field—stores the sequence number of the last new key it accepted for the level, key inhibit status field, limited use count field, key expiration based on use field—stores the expiration date if the operation uses the expiration based on key use time in year, month, day, batch used sequence number status field—stores the used and available sequence numbers for batch operation, field is a 32 bit field which only applies if the level is set for Batch Operation. Each bit represents a key sequence number from 1 to 32. If the sequence number's bit is set to 0, it indicates the sequence has not been used. If it is set to 1, it indicates that the sequence number has been used, interrogation record for non-opening key—indicates whether the lock should make a record when a non-opening standard key is used. A 0 value indicates no, a 1 value indicates yes, interrogation record criteria—indicates whether the lock should create a new interrogation record of a key entry, update a current record or do nothing under different circumstances. the following are the possible values: 0=never log entries in records; 1=when key identification number is different than last entry, update last entry record; 2=when key identification number is different than last entry, create new entry record; 3=log every entry in a separate record. A new entry would always be created if the key level was different than the key level for the last entry, if the sequence number change (new key), if a programming key was used or if other non-entry related records need to be logged (such as when the lock changes to unlatch mode)

last key used diagnostics—indicates why the last key used did not allow the door to be opened. This information would only apply when the lock was able to properly read the key. The general lock diagnostics would indicate the level of the last key used, the start and end dates and times on it and the real time it was used so that the interrogator would know which level to look up additional information on. The diagnostic codes indicate a particular reason why the key did not work, as is subsequently discussed. Although multiple conditions may actually apply, the lock would store the first code that applied.

Each level 0–D identified in the standard level information area 182 may have any number of keys associated therewith and operating thereunder. Therefore, the level will point to the first record in the standard key information area 184 associated therewith, and if there is more than one record, the end of each record indicates such.

Standard Operations

The operations available under the standard level, identified by the operations field include the variable features of intra level inhibiting, key expiration based on date used or date made.

The intra level automatic inhibiting indicates that only one key in the level can work at a time, and a new key automatically inhibits all other keys in the level. Without intra level automatic inhibiting, multiple keys can work simultaneously in a level, such as a typical guest door. With regard to expiration, if it is based on the date the key is made, the expiration date will equal the key's new date plus its expiration offset so that different duplicate keys can have different expirations. If expiration is based on the date used in the lock, the key expiration will equal the lock's current date plus key's expiration offset when the key is new, and the lock stores this date in the key expiration based on use field.

The operations include: field=0 for nonoperating operation; field=1 for standard operation without intra level automatic inhibit and expiration based on made date; field=2 for standard operation with intra level automatic inhibit and expiration based on made date; field=3 for standard operation without intra level automatic inhibit and expiration based on used date; field=4 for standard operation with intra level automatic inhibit with expiration based on used date; field=5 for batch operation without intra level automatic inhibit and based on used date; field=6 for batch operation with intra level auto inhibit and based on used date, and field=7 for pass operation without intra level automatic inhibit and expiration based on made date.

Non-Operating Operation

The operation field=0 for nonoperating operation is utilized in levels which are not to be used. Keys to levels with this operation do not preform any function.

Multiple Independent Key Operation

With regard to operation field=1 or 3, multiple independent keys may be used for guest keys, parlor doors, entrance doors, etc. The multiple independent key may be used for multiple or single keys used in doors. With respect to the single key, this is utilized for levels in which only one distinct key with a distinct sequence number is valid at any time. Only one key for the level operates the lock having distinct key record number and sequence number. The level information storage area 182 includes: operation field=1, and the fields as previously discussed, except the pass related fields. The key information storage area 184 stores the following information for the single key record in the level: key record number field, key combination code field, current date and time field, sequence number of last new key field, key inhibit status field, limited use count field, key expiration based on use field.

With respect to the multiple independent key operation, this utilizes more than one key record in the key record area. In other words, for each key programmed into the lock in this level, a record including the fields identified above will be stored in the key information storage area 184 for each key record number. The keys are individually inhibited or uninhibited. This operation is designed to handle entrance doors to buildings or apartments of there applications were there is a need to be able to have a large number of different keys operate the lock but still be able to cancel or temporarily lock out keys individually. A bit field at the end of each additional key record indicates if another key data record exists. Whether operation field=1 or 3 will determine how the lock will determine expiration time, as previously discussed.

Variable Single Key Operation

The variable single key operation field=2 and 4 allows up to eight different keys to operate the level, but only one key at a time. This allows a lock to be assigned to up to eight different room connector arrangements. All the keys on the level are affected as a group by the level statuses, in particular by the lock out and inhibit current statuses. When a key is used, the lock will make sure it is the most recent key by comparing its new date and time to all the keys programmed into the level. An application for this operation is when a guest room connects to more than one other guest room and may be sold to a guest with one, the other or both connecting rooms. For instance, if room 100 is connected to room 101 and is connected to room 102, three different connector keys could be connected, i.e., key number 1 for rooms 100 and 101, key number 2 for rooms 101 and 102, and key number 3 for rooms 100, 101 and 102. The lock for room 100 would be programmed for key record numbers 1 and 3, the lock for room 101 would be programmed for key record numbers 1, 2 and 3 and the lock for room 102 would be programmed for key record numbers 2 and 3. In any particular lock, only record number 1, 2 or 3 operates at any time.

The basic level fields outlined in operation=1 and 3 for multiple independent key operation are utilized. The lock allocates additional memory records according to the number of different keys that are stored. A bit field at the end of each additional key data record indicates if another key record exists. Whether operation field=2 or 4 is used depends on the use of expiration date.

Pass Operation

The pass operation having a field=7 allows an unlimited number of different keys of the same level to operate a lock by being less selective in their requirement of identifying a valid key. Levels with this feature check the keys pass group settings. The key has 12 bits to indicate which of the 12 pass groups it belongs. If the bit for a pass group has a value of one, the key will have that pass group. If it is zero, it does not have that pass group and will not be allowed to enter. The lock fields include the following: operation field, function field, subfunction field, additional function information field, valid time range field, invalid days field, level inhibit status field, electronic lock out statuses field, effective lock outs field, override deadbolt field, program group field, clock reset hassle and lock out field, number times key used during clock hassle field, pass criteria field, operational time criteria field, and operation times field. These are all stored in the level storage area 182.

Batch Operation

The final operation is the batch operation identified by field=5 and 6, which allows a batch of 32 different keys for the same level to be used in the lock in any order and still have the lock be able to identify a new key, current key, or old key. This operation is designed for properties that do not have a computer system to generate keys on a real time basis and require a batch of keys that can be issued in any order to guests without having to keep each key in sequence. A batch of 32 keys with different key sequence numbers but with the same key record number and new date and time are premade for a room. The batch of keys constitutes one batch sequence and represents 32 new guests. The next batch of 32 keys would have a different key record number and/or later new date and time, or use of a program information-mastering key which, cancels out the previous batch of 32 keys. A batch may include duplicate keys with key identification numbers differing, for some of the sequence numbers. This will allow the guests to be issued one or several keys. With respect to the fields, the level includes an additional 32 bit field to track which of the 32 keys in a batch are used or old. The level record contains all of the level fields discussed above, except the pass related fields.

The key storage area 184 includes: record number, new key date and time, key combination code, current sequence number, used sequence numbers, key expiration based on use.

STANDARD LEVEL FUNCTIONS

With regard to the standard level operations, the function fields identify the general purpose of the key associated with the level, the subfunction fields provide additional specification for the function, and the additional function information field is used for additional information needed by some functions. After the key has been validated, the functions and subfunctions are performed. There are included six functions wherein the additional subfunctions and the information are dependent upon the functions selected. The six functions are as follows: field=0 indicates standard function; field=1 indicates inhibit function; field=2 indicates limited times use function; field=3 indicates dual key function; field=4 indicates electronic lock out function; and field=5 indicates latch function. Each will be subsequently explained.

The standard function field=0 may have no special function or may be set up to automatically inhibit the current keys to other levels of the standard function with a specific group number. The subfunction is used to identify the levels group number, or inhibitable group number. Subfunction 0 indicates that the keys to the level are not automatically inhibited nor effected by any key with an inhibit function. Subfunction 1, 2 and 3 indicates the new key from a different level that was programmed with a standard function and additional function information inhibiting group number matching the subfunction group number inhibits the current keys to this-level. In addition, a key with an inhibit function specifying the subfunction group number also inhibits the level's current keys. The additional information field is used to identify the inhibiting group number. This is the group number that new keys to this level would inhibit. Additional function information=0 indicates that the keys to the level should not automatically inhibit keys to other levels. Additional function information=1, 2 and 3 indicates that a new key for the level will inhibit other keys to other levels with a standard function and a subfunction group number that matched this levels additional function information inhibiting group number. If a level's additional function field is greater than 8, a new key will cause the lock to search all other levels and auto inhibit the level if its function=0 and its subfunction=this level's additional function.

Inhibit Function

The inhibit function=1 permanently locks out the current key associated with the levels which have a specific function. When a level is inhibited, the lock will only operate on that level when it receives a new key or the current key is reprogrammed back in. The function can be used to supplement the standard function with the inhibitable group subfunction. Each level can inhibit keys corresponding to different levels and functions if desired. The subfunction identifies the function of a level the key should inhibit. This allows a special inhibit key to inhibit keys to a level programmed with, i.e., the limited time used function. The additional function information field is used to identify the subfunction group number of levels that are programmed with the standard function. Additional function information=0 would indicates that the inhibit key inhibits keys with subfunction groups=1, 2 or 3. It will not inhibit keys to a level with subfunction group number=0. Additional function information 1, 2 or 3 indicates that the inhibit key should only inhibit keys with the subfunction group number matching this field.

Limited Times Used Function

The limited times used function field=2 controls the number of times the key can be used, from 1 to 4. These subfunctions identify the maximum number of times the key can be used, i.e., 1, 2, 3 or 4 times. If a key gets a green LED to open the door, the number times used counter field associated with each key will be incremented. If the counter field is greater than the subfunction, the key will be invalid. New keys reset the counter to 0.

Dual Key Function

The dual key function field=3 requires two keys to be used before the lock can operate, i.e., opening key with a non-opening key or different opening key for the level. The functions statuses can be set to control whether the key overrides a deadbolt or electronic lock out. This function has no subfunction or additional information field. On the first key, the yellow LED slowly flashes. If the second key inserted within 6 seconds, and one of keys is opening, lock will try to open door.

Electronic Lock Out Function

The electronic lock out function field=4 allows a key to electronically lock out all other key levels or selected key levels. When the key is activating the lock out, it can not then open the door. When a key is removing a lock out, it can open the door provided it is an opening key. The subfunction indicates a lock out types, 0 and 1. The lock out types correspond to each level's electronic lock out function statuses and the current statuses. If a lock out key corresponding to a level when this function is used, the microcomputer 110 would check the lock out function status that corresponds to the subfunction lock out type for each of the other levels. In the level that had a 1 for the lock out type, the microcomputer 110 would set the levels current status for the lockout type to a 1. Alternatively, to remove the electronic lock, when an unlock out key is used, the microcomputer 110 would set the level's current status for the lockout type to a 0. While a key is electronically locked out, it will not be able to open the door. When the lockout is removed, the key will again be able to open the door. The additional information field is used to indicate whether the key can only lock, only unlock or toggle the lock out when it is used. The value of 0 indicates only lock, 1 indicates unlock, and 2 alternatively lock and unlocks each time the key is used.

Latch Function

The latch function field=5 allows the lock to be left in a latch or unlatch condition when the door closes. When the lock is in an unlatch mode, the door can be opened without using the key. When it is in the latch mode, a valid key must be used before the door handle can be turned. When a key is latching the door, the key allows the door be opened provided the key was an opening key. The subfunction identifies whether the keys can only latch, only unlatch or toggle between latch and unlatch when a latch key is used. A value of 0 indicates latch, 1 indicates unlatch, and 2 indicates toggle.

Standard Level Keys

The standard level keys are level oriented keys to be used for entry or other normal operations. They operate according to how the lock level is programmed. FIG. 7 illustrates a typical standard level key. They are encoded with the following information fields readable by the lock. The key level recognition code field indicates to the lock which level it is to operate under, i.e., 0–D. The key type code field will equal 0 for the standard key. The opening/nonopening key field is a bit on the key which indicates whether or not the key is to open the door or not. An opening key has the field=1, and a non-opening key has the field=0. The key record number field is an identification number to identify each key for each level. The lock stores and compares this number to know whether the key belongs to it. Duplicate keys have the same record number. The duplicate key identification number field identifies each duplicate key by its own distinct identification number. The new date and time field, also referred to as the key code, stores the new date and time for the key. The field includes the months 1–12, the day 1–31, the year 0–9, the hour 0–23 and the minutes 0–59. If the key is a shift key indicated by the valid time condition field, the new time is the start time. The expiration date offset field is used with the level's valid time range setting and the lock's internal clock to determine whether a key has expired or whether it is being used outside of its shift hours. The expiration offset includes the month, the day, and the additional year. The expiration time field includes the hour, and 0–59 minutes. The property number field. The authorized pass groups field includes 12 bits and is used for the pass door operation. The field on the key indicates which of the 12 pass the key work. Each bit corresponds to one of the twelve pass groups. A value of 1 in the bit gives the key that pass group. The sequence number/key combination code field is a function of the key combination code and a sequence number.

This field is a function of a key combination code and a sequences number. The sequence number identifies the order in which new keys have been made. It progresses in a pseudo random manner with each new key and the lock would check this number to ensure it is within its tolerated range based on what it has stored as the last valid sequence it received. The key sequence number does not appear to progress sequentially. Only the computer system and the lock will know the correct progression. The key combination code is a random code generated by the computer when the first new key is made or the lock is first programmed. This code is only stored in the lock level and the computer. The lock will then contain a random number which will be unknown to our company employees. The random key combination and the sequence number would never be displayed by the computer system. When the computer generates this field for the key, it will be a function of the key continuation code and the sequence number. Since the lock knows the key combination code and the function used to create this field on the key, when it reads the key, it will be able to decipher what the sequence number is. By making this field a function of the two variables, a person would not be able to determine the sequence number or key combination from a key.

The key invalid days field indicates the days of the week the key can not operate any locks. Each of 7 bits corresponds to a day of the week—Sunday to Saturday. A 0 value for a bit indicates a valid day, and a 1 value for a bit indicates an invalid day. The override deadbolt condition field is used with the lock's level programming field override deadbolt. If the override deadbolt field is set to 1 indicating keys to the level override a deadbolt. If the key field is set to 0, the key only overrides a deadbolt if the lock determined the key was a duplicate key. The random number field ensures that duplicate keys are encoded differently. The checksum for the key field is a special checksum value encoded on the key to ensure that an outside person using a key or keys obtained from a property will not have the lock accept it as a valid key. The checksum is an algorithmic function of some of the variable information on the key. Filler bits are irrelevant data and are included to make the total number of bits equal 147.

Main Routine

Figure 9A:
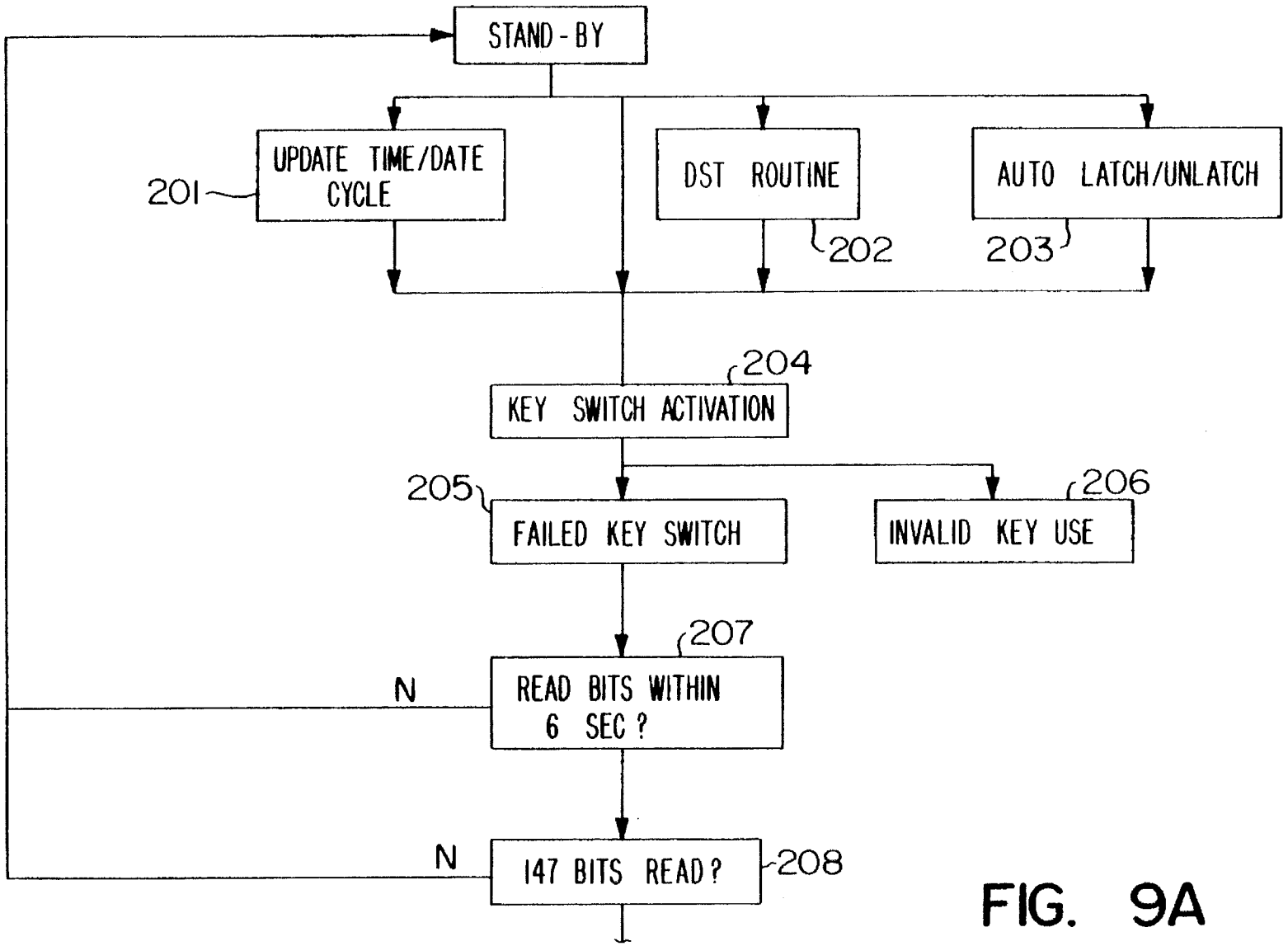
Figure 9B:
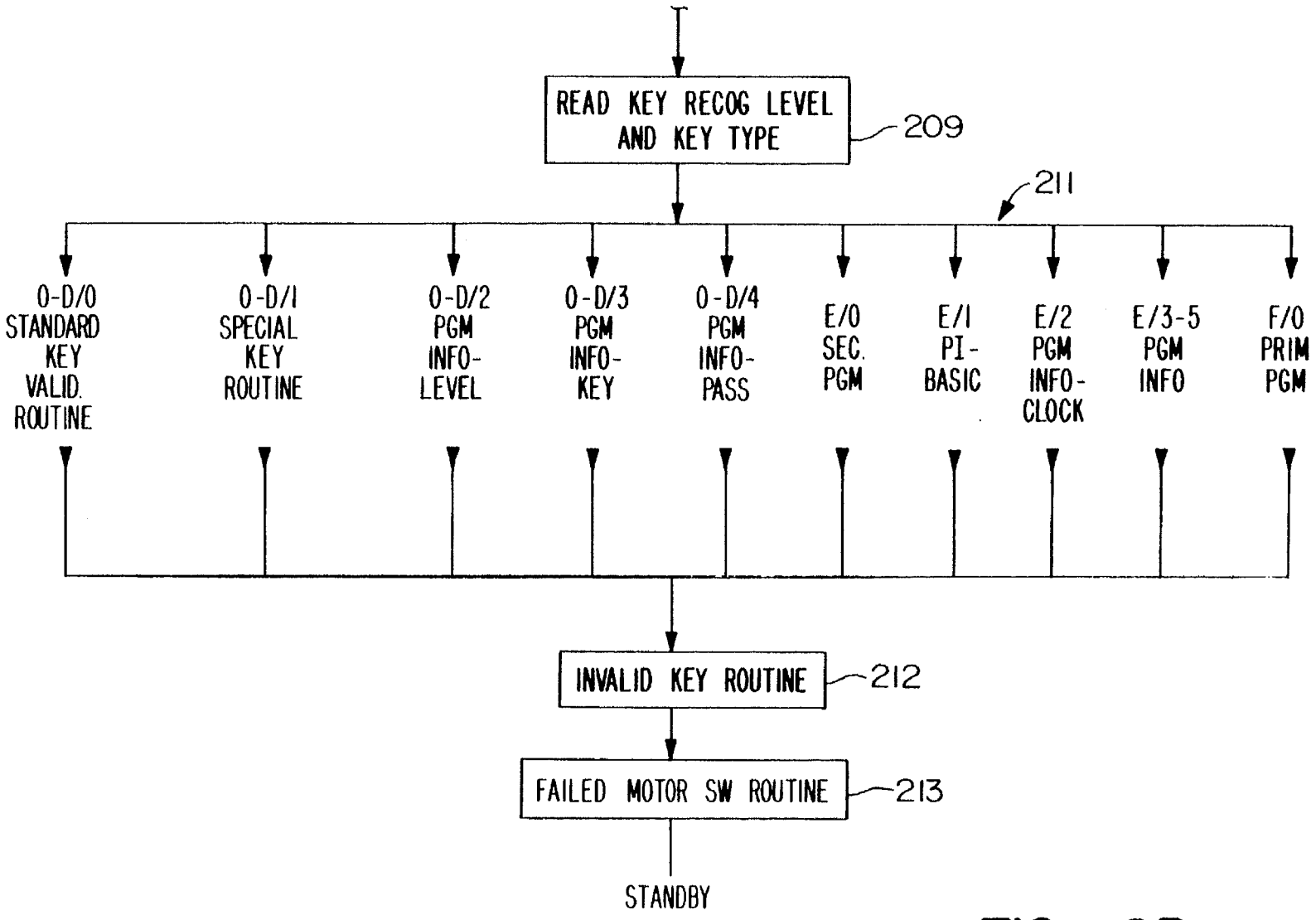

With regard to the overall operation of the lock, a general routine is provided in FIGS. 9A and 9B. The routines continuously operates the update time cycle routine as block 201, DST routine as block 202, automatic latch and unlatch routine as block 203. The lock is woken up upon every 64 cycle period. In response to a key switch activation, the lock prepares to receive data. If no data is received in 6 seconds, the lock goes into standby. Is entered as in block 204. Associated therewith is an invalid key uses test at block 206 if invalid keys are read. If 10 invalid keys are used sequentially, the lock shuts down for 2 cycles, and thereafter sets the counter to 9. If another invalid key is used, shutdown occurs. A valid key must be used when the counter is less than 10 to set the field to 0. A failed key switch routine occurs at block 205. For a valid key to be read, it requires reading of such a key card within 6 seconds of the key switch activation as indicated in block 207. The lock checks to see if 147 bits are read in block 208. If so, the lock reads the record code and key type from the key in order to validate the checksum as indicated in blocks 209–210. At this point, the validation rules for the particular keys differ depending upon the key type, and therefore branch to the following routine indicated by the combinations of level recognition code and key type indicated in block 211. Each individual key is validated and the operations conducted in conjunction with the low battery condition routine, lock knob turn cycle test, and failed motor switch routine as indicated in block 213. The lock allows 6 seconds for the knob to be turned from the green LED illumination indicating validation. The exit routine in block 214 (FIG. 16) stores the diagnostic codes and interrogation records.

Standard Level Key Routine

Figures 1, 10A:
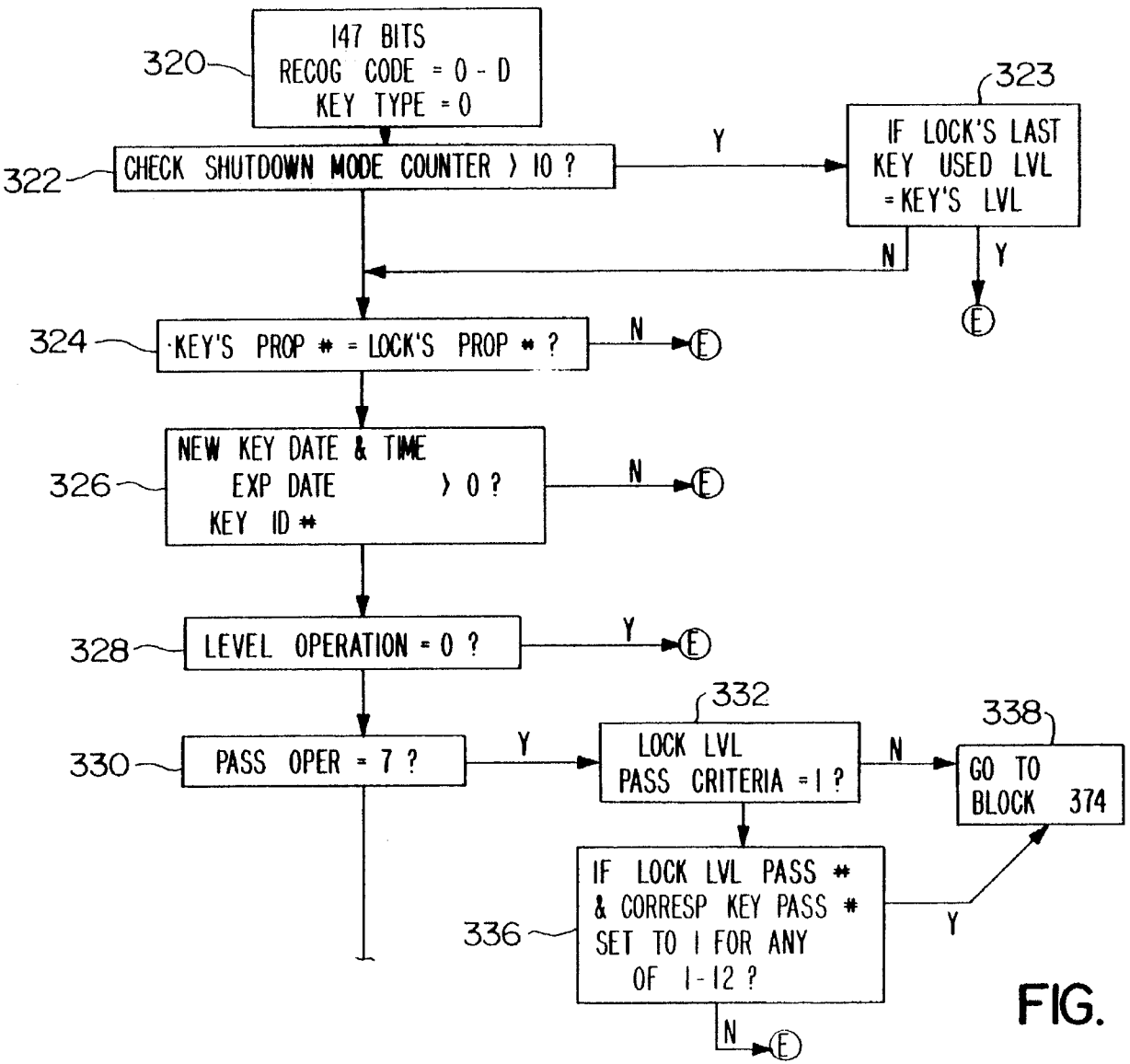
Figures 2, 10A:
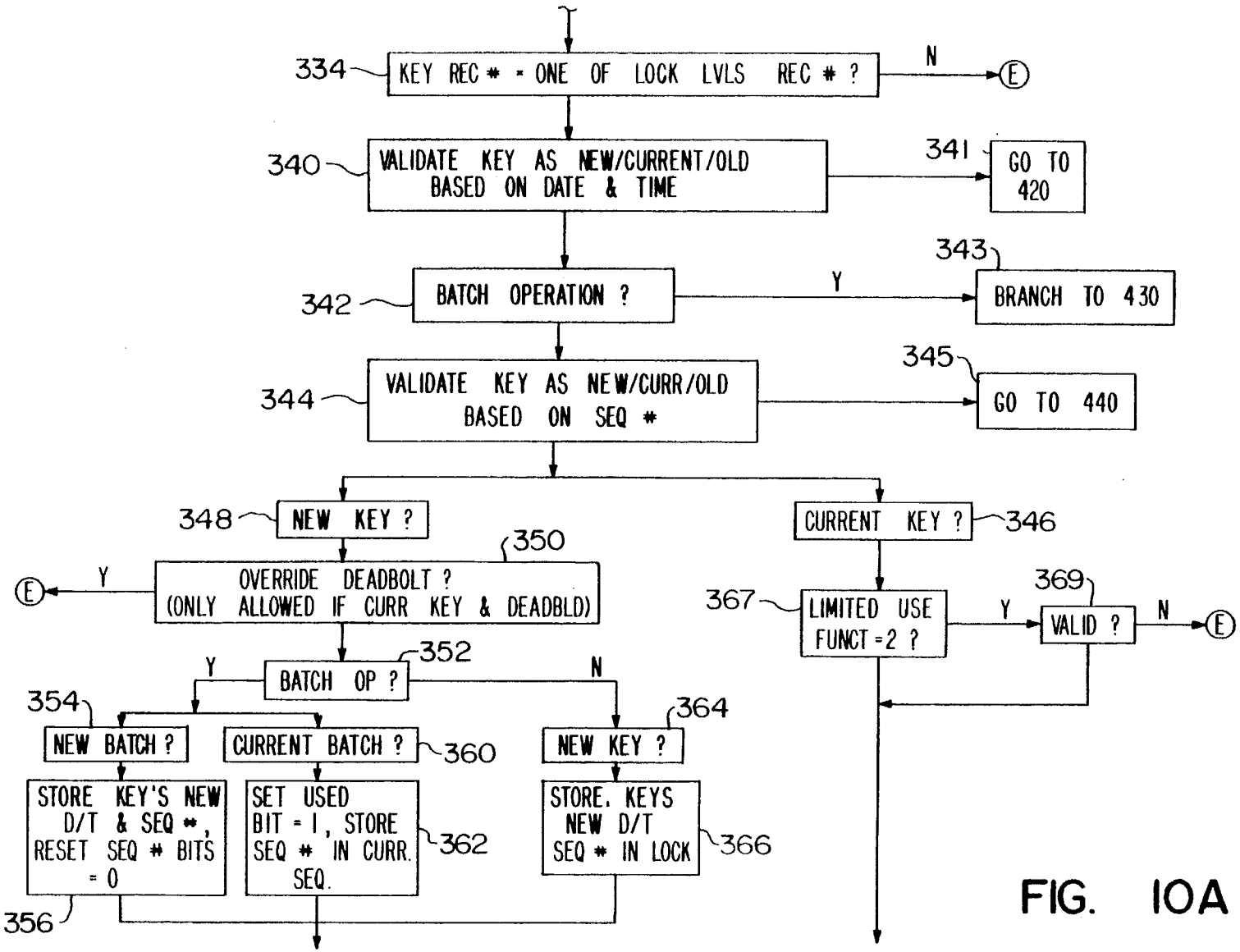
Figures 1, 10B:
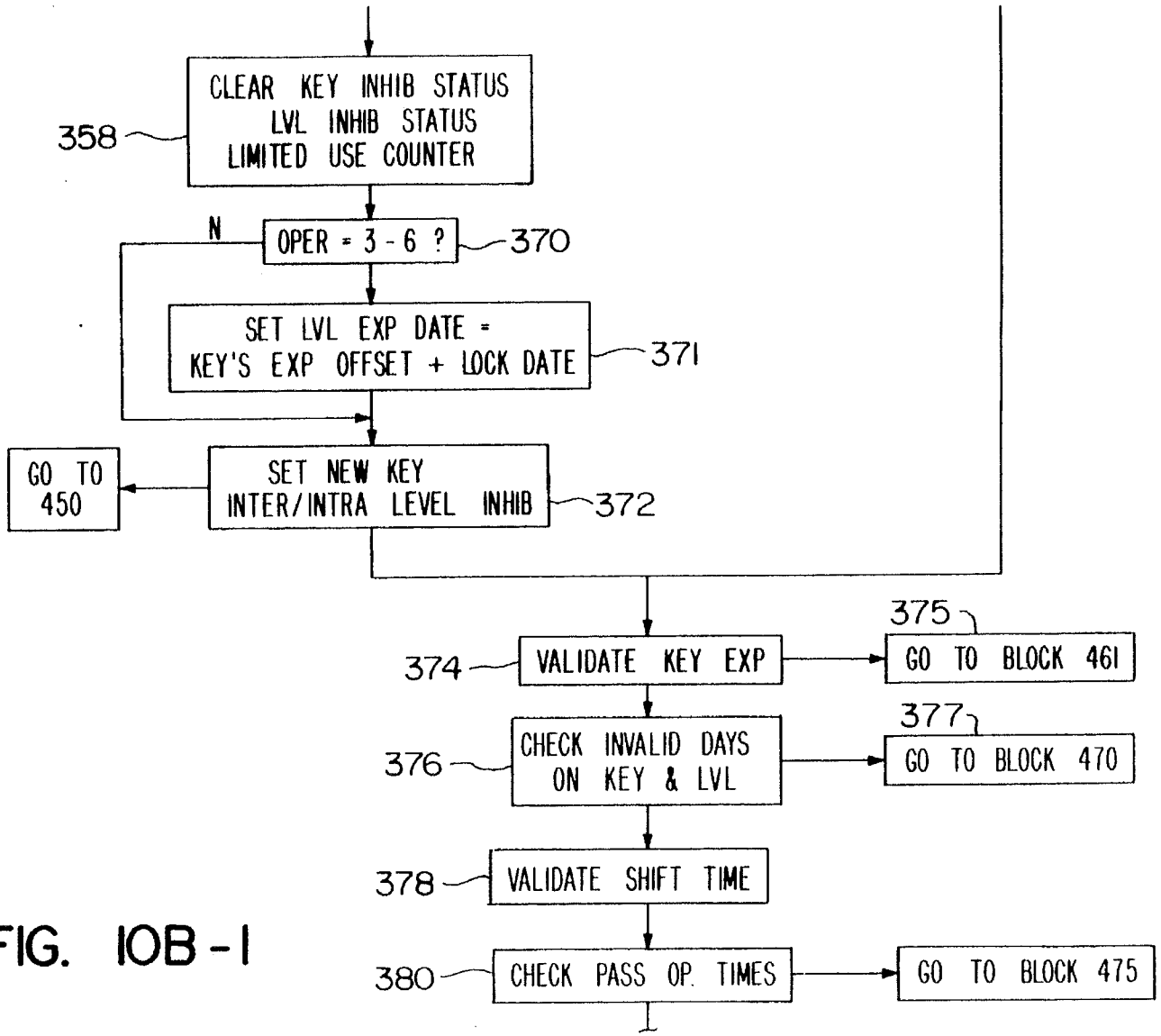
Figures 2, 10B:
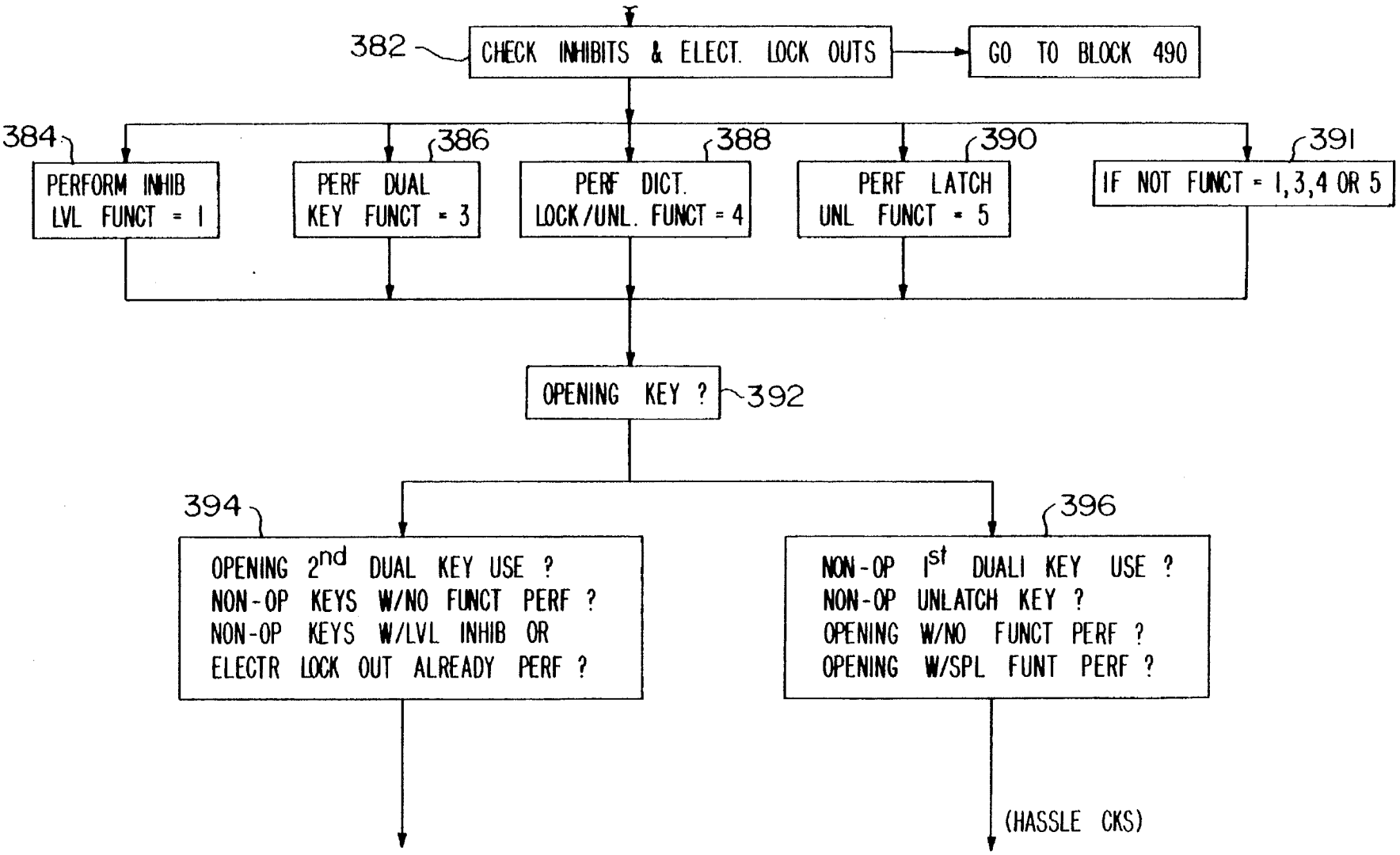
Figure 10C:
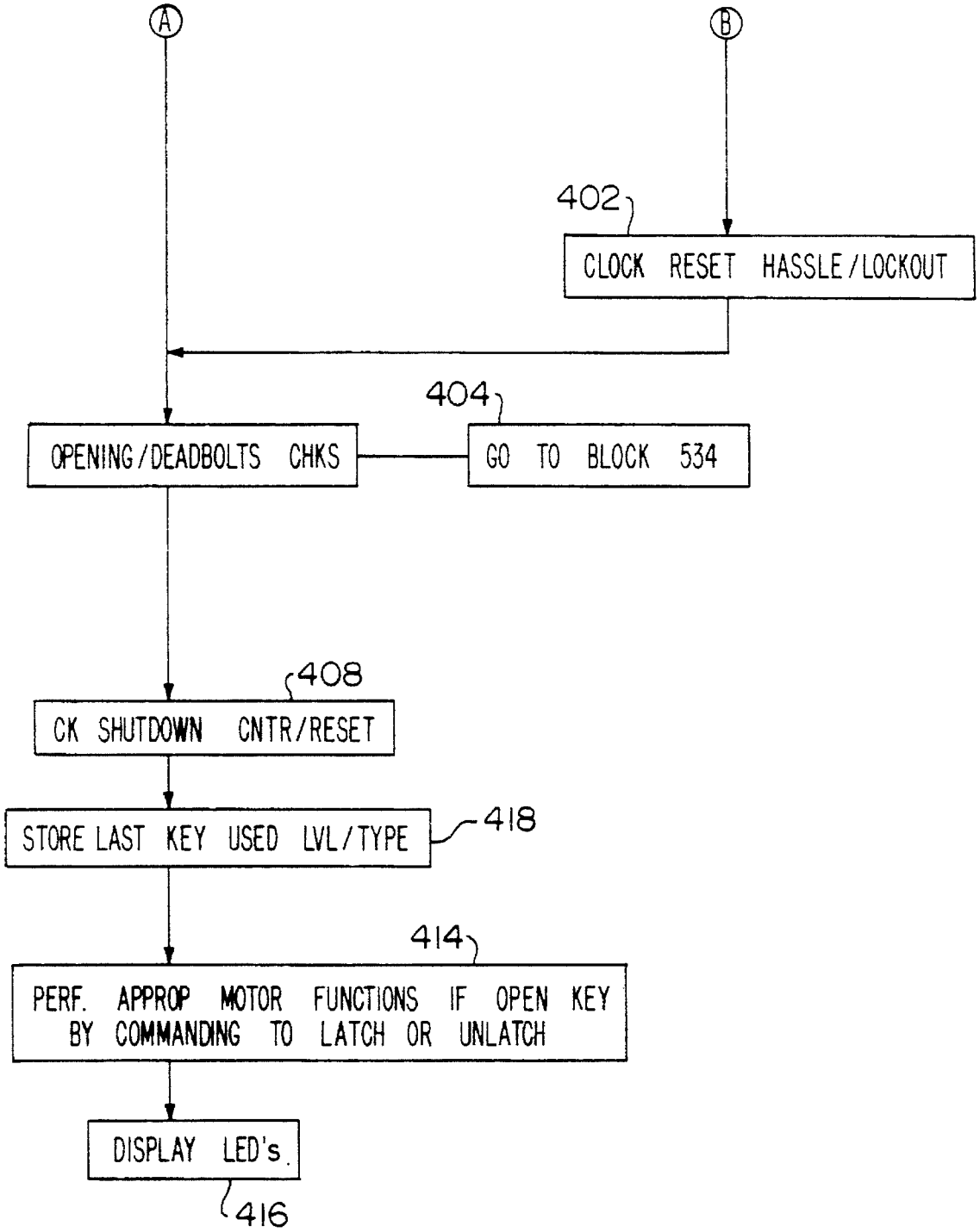
Figure 10D:
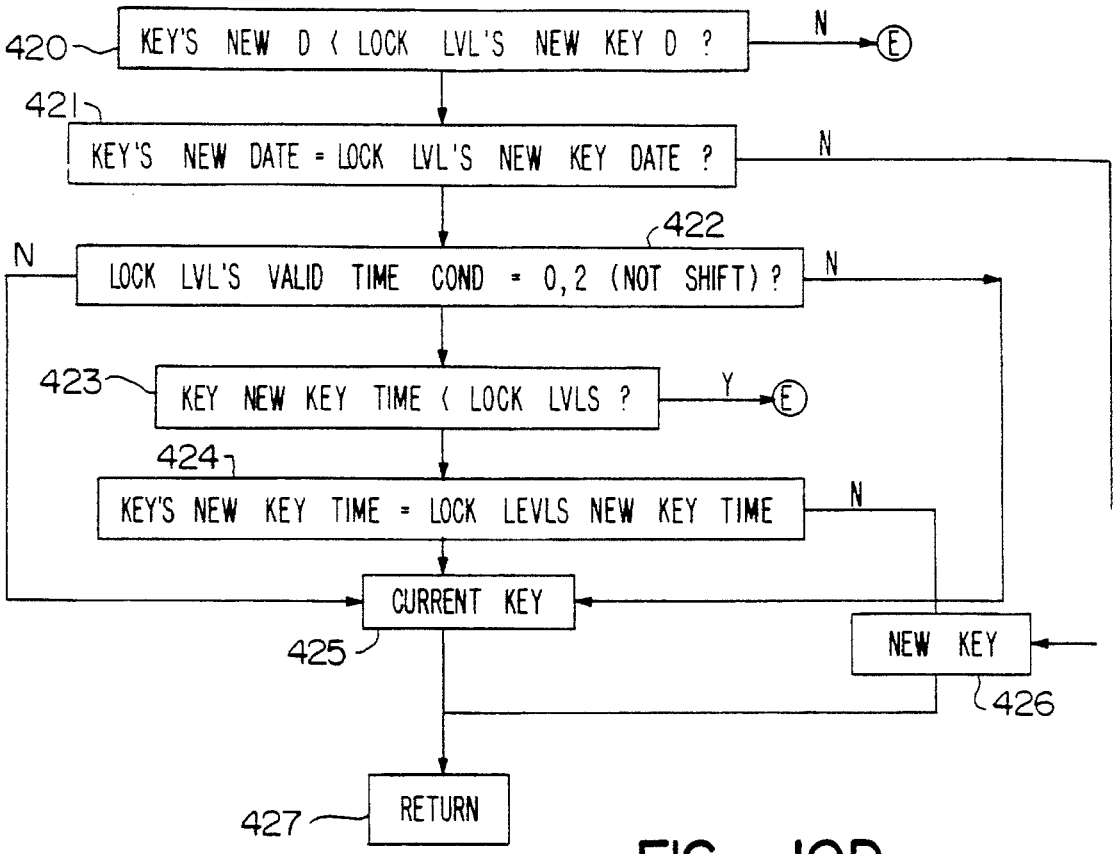
Figure 10E:
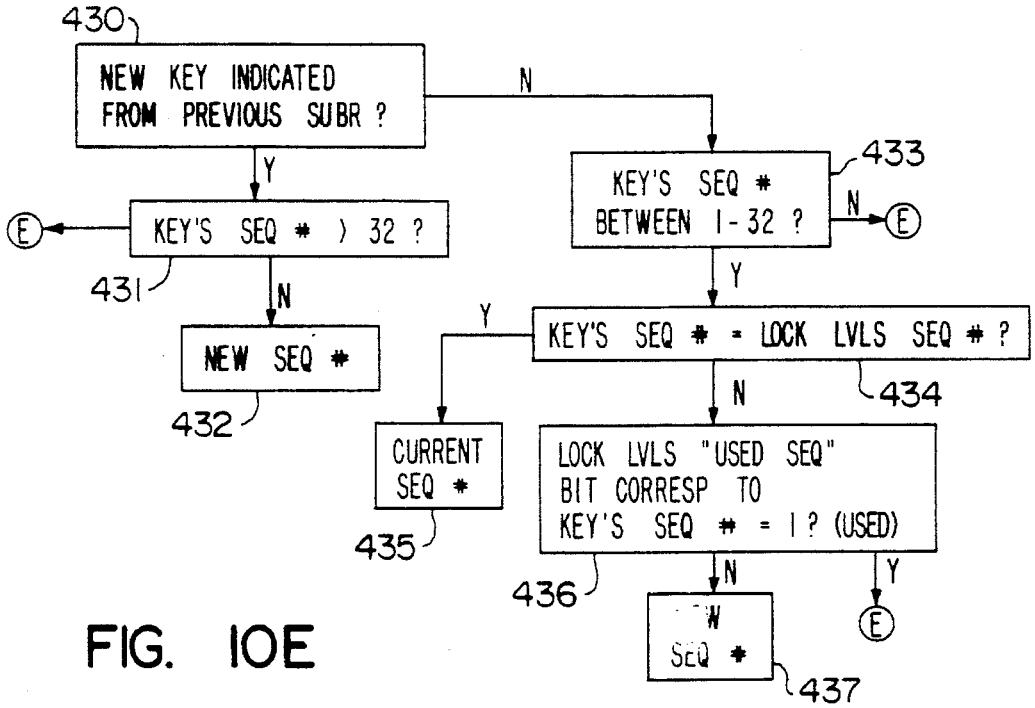
Figure 10F:
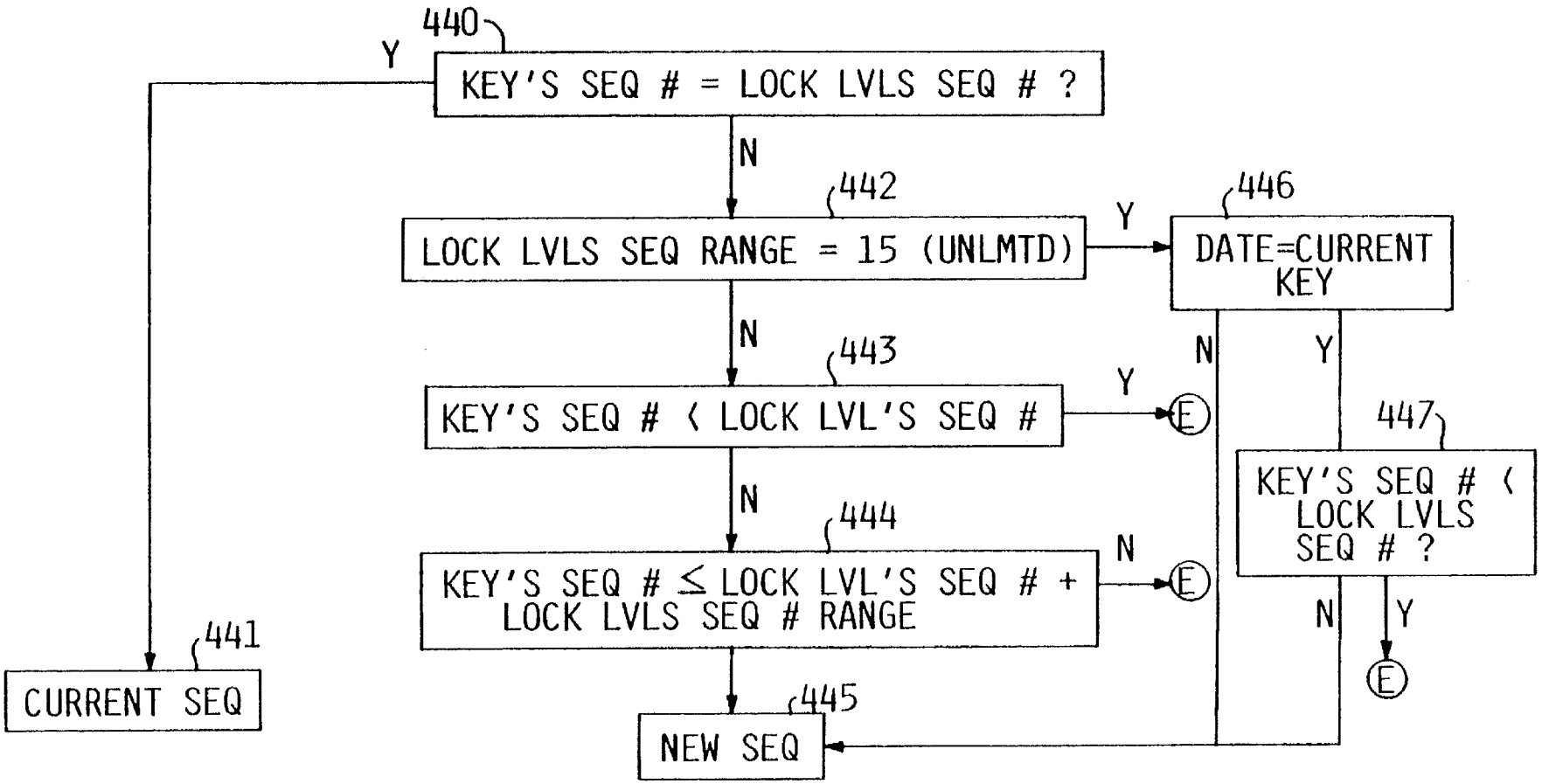
Figure 10G:
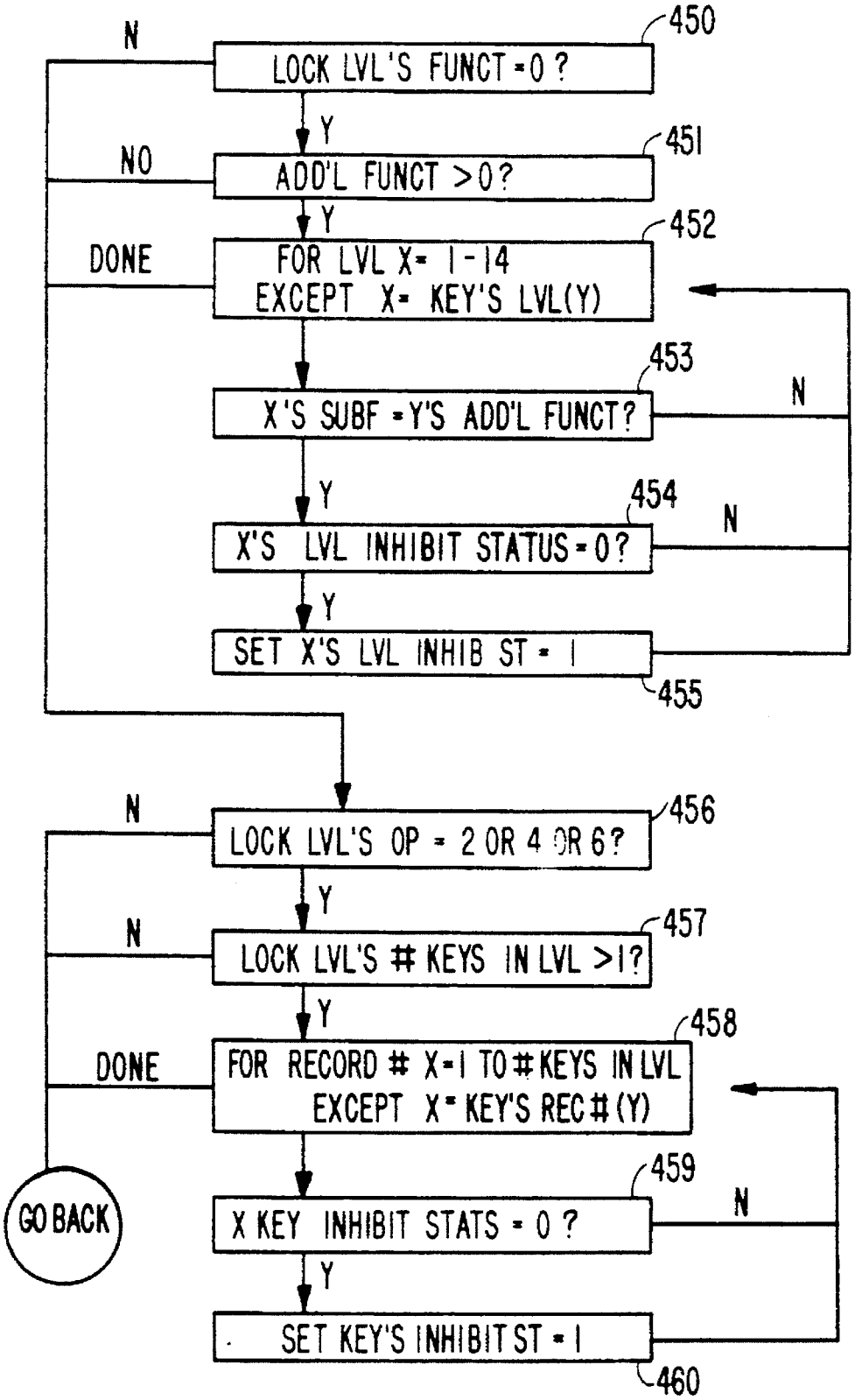
Figure 10H:
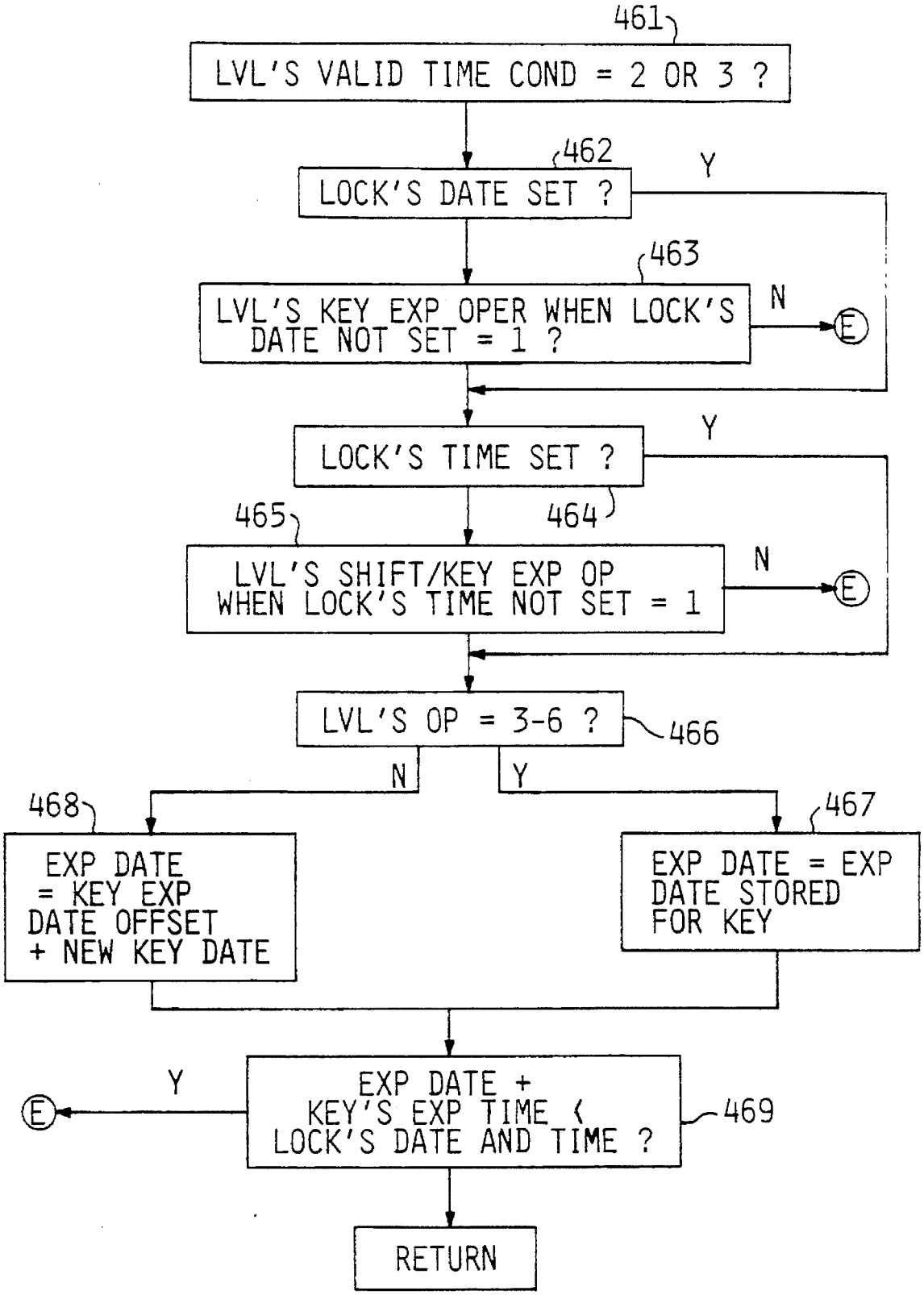
Figure 10I:
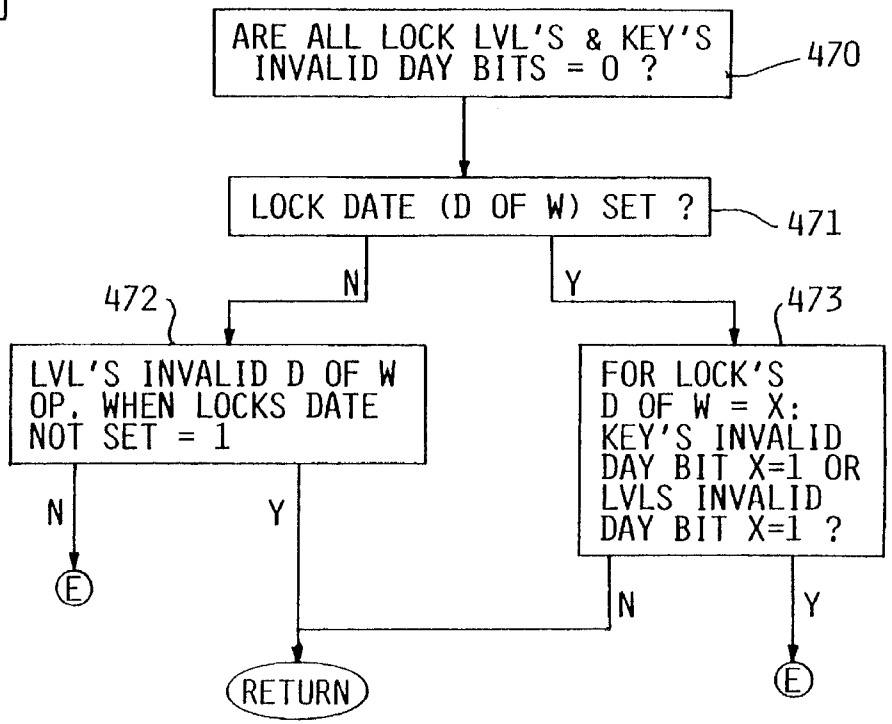
Figure 10K:
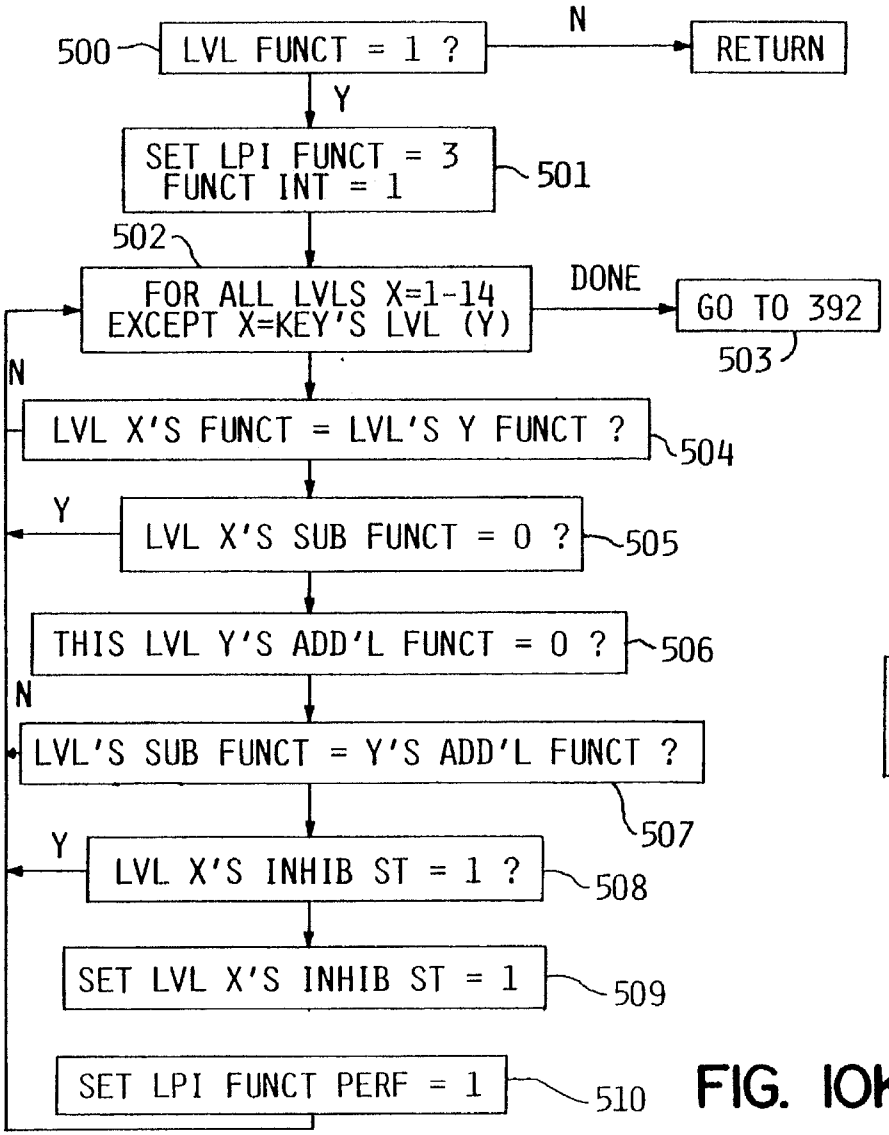
Figure 10J:
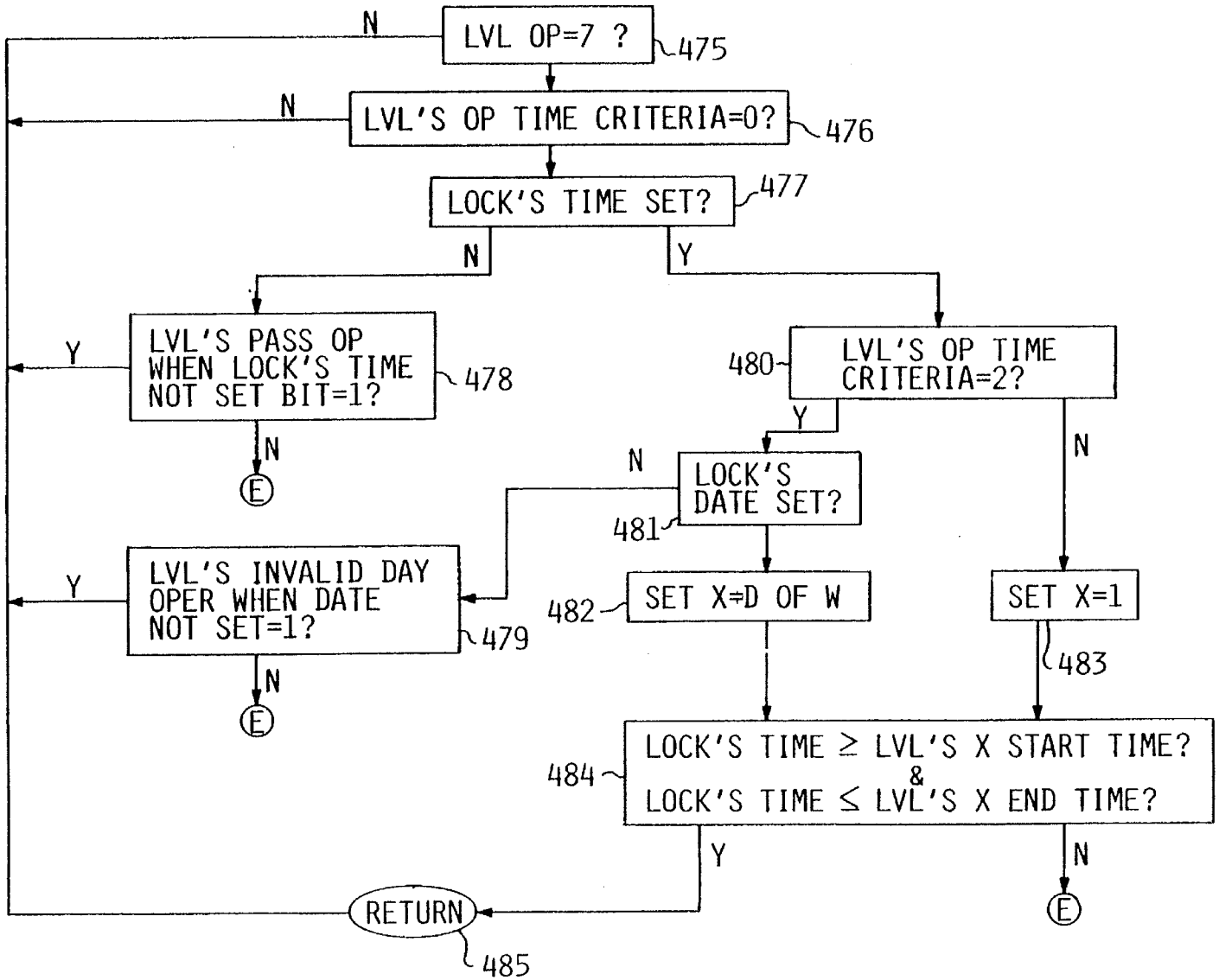
Figure 10L:
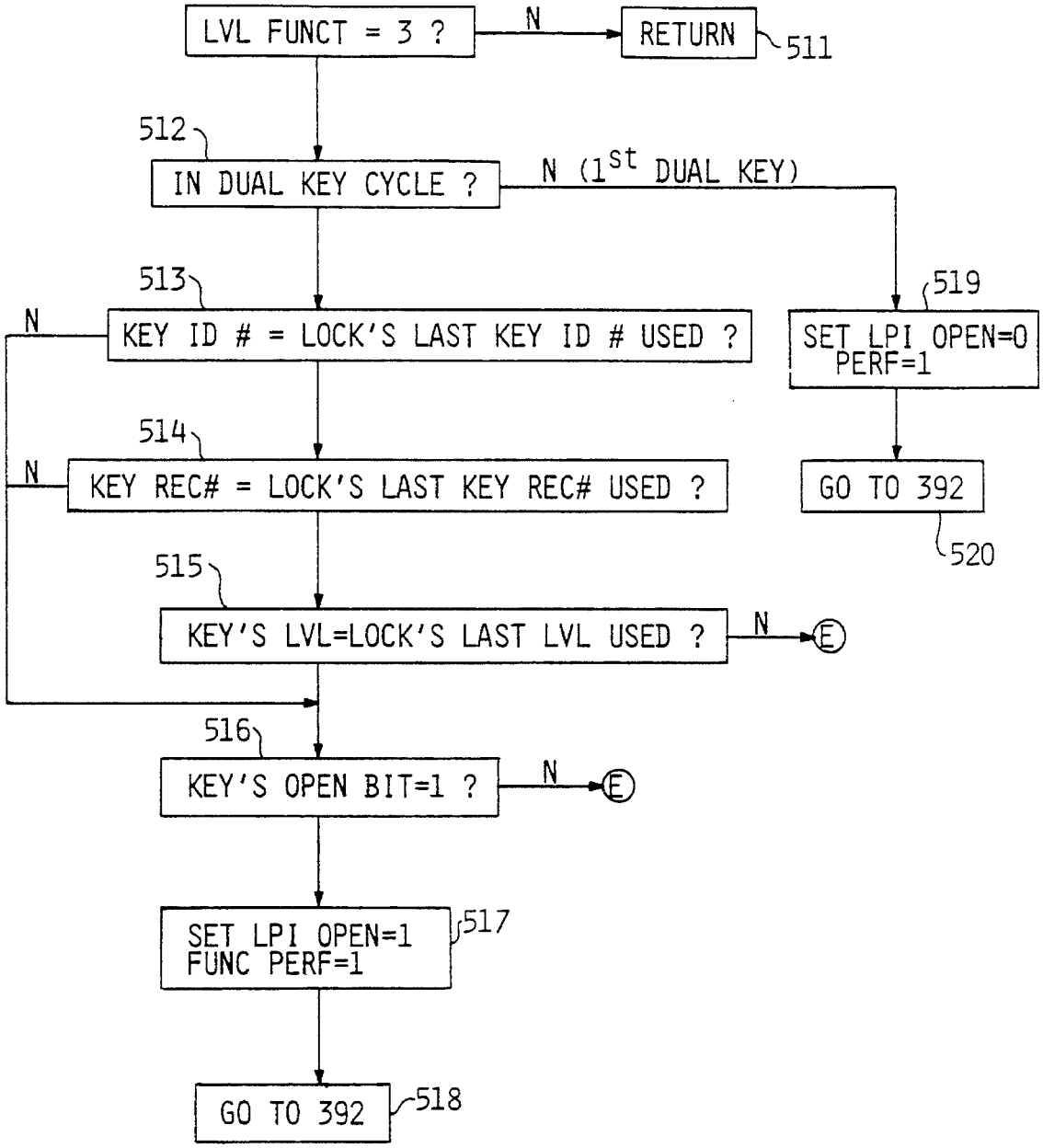
Figure 10M:
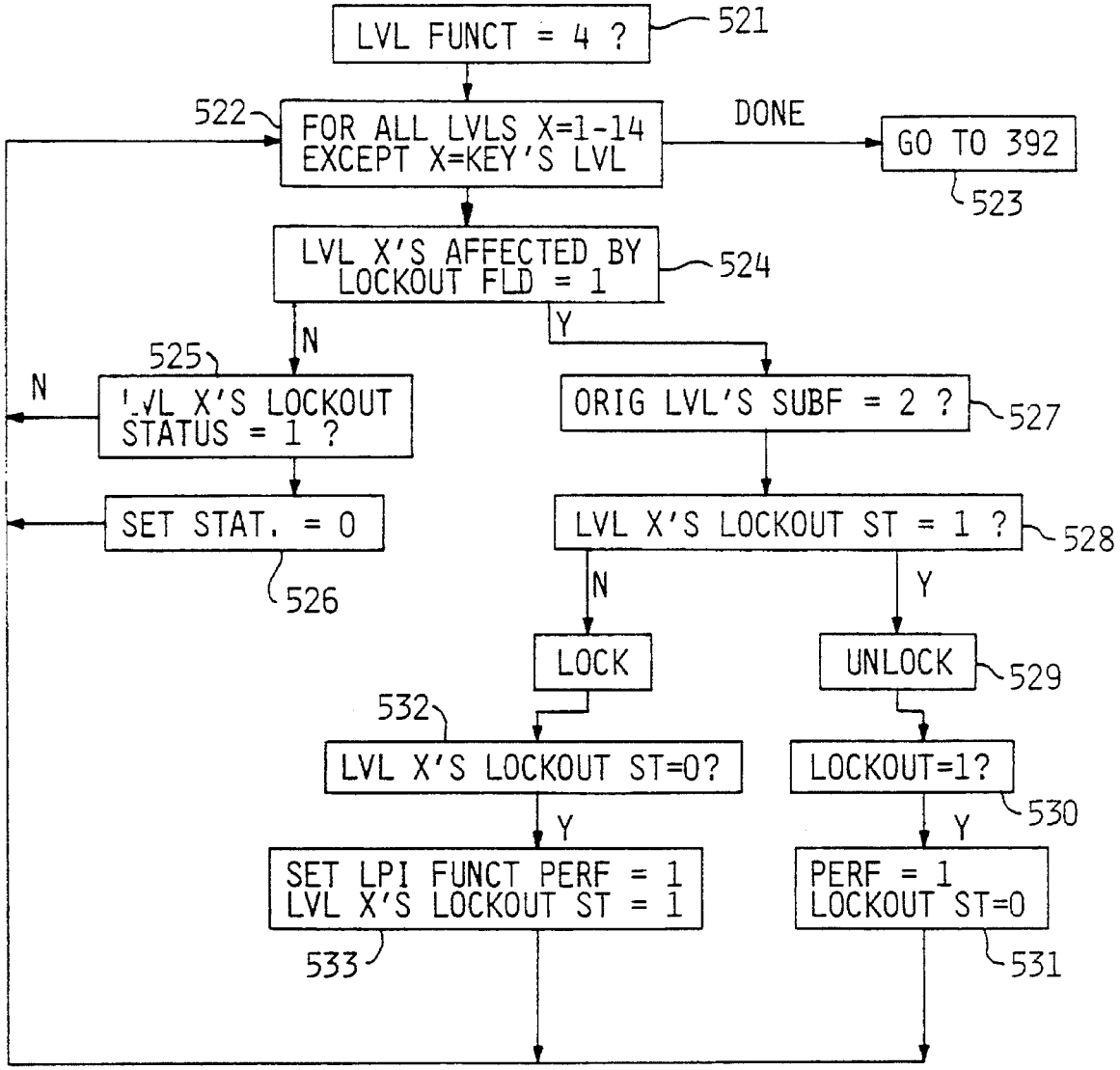
Figure 10N:
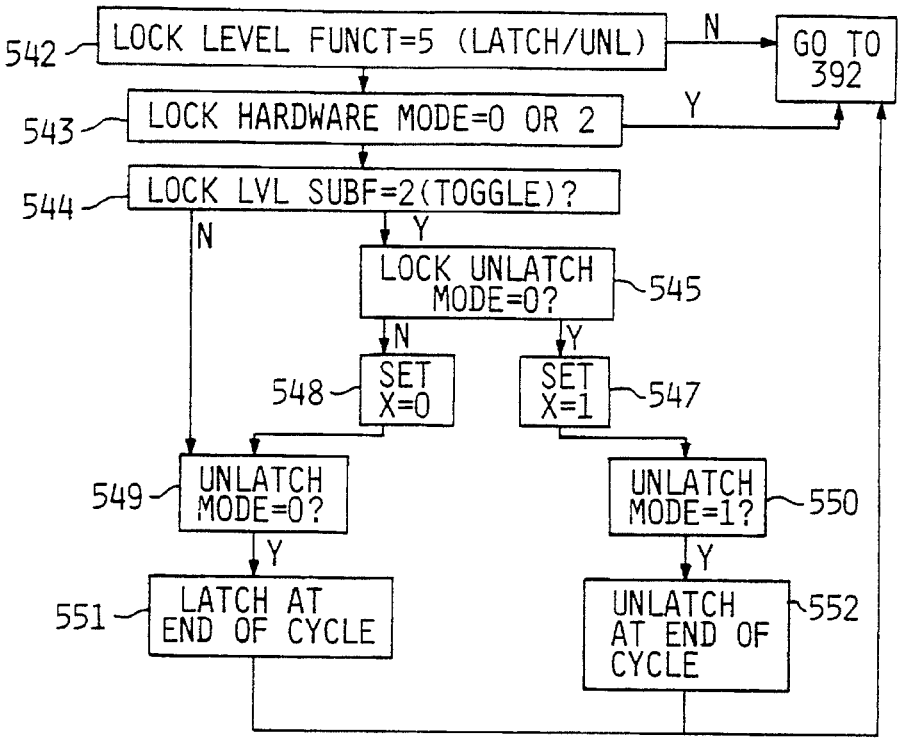
Figure 10O:
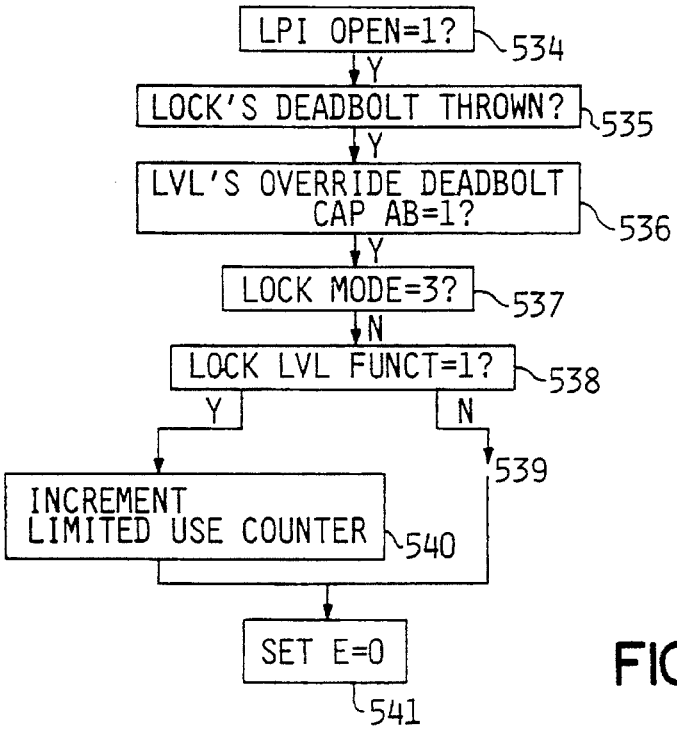

The routine for lock operation of the standard level key 0–D/0 is illustrated in FIG. 10*a–n*. The level recognition codes of 0–D and the key type of 0 indicates a standard level key. In general, the key is validates using fields stored in the basic lock information area 180, standard level information area 182, and the standard key information area 184. The lock operates according to information stored in each of these areas, but utilizes only information associated with the selected level 0–D in the standard level information area 182 and the associated key record number in the standard key information area.

Program block 324 checks the key to insure that the key's property number matches the lock's property number. If this match is valid, the keys record number, new key date and time, expiration, key identification number compared to insure it is not zero as indicated in block 326. Block 328 checks to see if the levels operation=0 indicating a nonoperation and therefore error. If the lock levels operation=7 indicating a pass key at block 330, the program branches to block 332. Otherwise, the program branches to block 334 to check to see if the key record number matches one of the lock level's record numbers.

Blocks 332, 336 and 338 check if there is a valid pass number indicated by the key. If the lock level pass criteria=1 then a pass number must match. Otherwise, the program advances to block 374 for checking the key expiration.

Block 340 determines whether the key is new, current or old based on the new key time and date. This occurs in routine branching 341. For a new key, if the level operation equals 5 or 6 indicating batch in block 342, the program branches in block 353 indicating the batch operation routine. Otherwise, the program advances to block 354 wherein the sequence numbers are checked to determine new, current, or old key in routine 353. If a current key is determined, the program branches to block 346 and if it is new key, the program branch is to block 348. Block 350 checks if override deadbolt for current key only bit is set to 1, and that the lock levels override deadbolt capability=1, and the deadbolt thrown indicating an error. Blocks 354–356 act on new batches, and block 360–362 act on current batches. For new non-batch keys, the key's new date and time and sequence. number are stored in the lock in blocks 364–366. The key inhibit status, level inhibit status, and limited use used key count are all cleared in block 358. If the operation=3 or 6, the lock level's expiration is set to the key's expiration offset and locks date in blocks 360–362. Thereafter, the inter and intra level inhibits are set utilizing the routine in blocks 364–365.

If the current key, block 367 checks to see if the limited use function exists. If so, it checks to see if expired for a current key as indicated in block 369.

Whether new or current key, block 374 validates the key's expiration by branching to a routine in block 375. The program branches in block 376–377 which checks the invalid days on the key and in the level. Block 378 checks the shift time to determine whether the key should operate. If the lock level's valid key time condition is 1 or 3, and the key's key (shift) start time=key's expiration (shift) end time, the key is validated. If the latter condition is negative, the following occurs. If the lock time is set and the lock's time is greater than or equal to the key's start time, and the lock's time is less than or equal to the key's expiration time, validation occurs.

The program then branches to block 380 which checks the pass operational times by branching in block 381. The program continues to block 382 wherein the inhibit and electronic lock out fields are checked. If either the level or key record is inhibited, or the lock's level is locked out, then an error occurs.

If the lock level's function=1, 3, 4 or 5, the associated functions are performed in blocks 384–390. Function=1 routine preforms the inhibit levels function and is indicated in FIG. 10*k* in blocks 500–510. Function=3 routine preforms dual key checks as in FIG. 101 and blocks 511–518. Block 388 performs the lock/unlock function=4 in FIG. 10*m* and blocks 521–533. Block 386 preforms the latch/unlatch function=5 in FIG. 10*n* and blocks 542–551.

Block 392 determines whether the key is an opening key or a nonopening key. In block 396, if the key is one of the following the hassles are checked: non-opening first dual by use, non-opening unlatch key, opening with no function performed, opening with special function performed. Otherwise, in block 394 the following skip the hassle checks:

opening second dual key use, non-opening keys with no function performed, non-opening keys with level inhibit or electronic lockout already performed.

Block 462 checks the clock reset hassle criteria and operates accordingly.

Block 404 determines whether the key is an opening key and checks the dead bolt statuses. The program continues to check the shutdown mode counter in block 408.

Block 418 causes storing of the last key used level and type in memory. The motor functions are performed in block 414 and the appropriate LEDs are displayed in block 416.

Validation of key based on date and time routine as indicated in blocks 420–427 in FIG. 10. The key's new date is checked to see if less than the lock level's new key date, if so an error occurs as indicated in block 420. If the key's new key date is not equal to the lock level's new key date, the new key is indicated in block 426, otherwise the program continues to block 422. If the lock level's valid time condition equals 02 indicating is not a shift time, program continues, if this condition is negative, a current key is indicated in block 425. If the new key time is less than the lock level's new key time, the program continues, otherwise error occurs. If the key's new key time equals the lock level's new key time then it is a current key, otherwise, the new key is indicated. The program returns to the main calling program in block 427.

The batch routine from block 353 includes blocks 430–437 in FIG. 10*e*. If a new key was indicated for the previous routine, the key sequence numbers check to see if greater than 32. If so, an error occurs, otherwise it is a new sequence number. If it is indicated a current key, the key sequence number is checked to see if between 132. If not, an error occurs. Thereafter, the key sequence number is checked to see if equal to the lock level sequence number and if so, a current sequence number is indicated, otherwise, the program continues to check the lock levels use sequence numbers corresponding to the key's sequence number as to whether it equals 1 indicating used. If yes, an error occurs, if no new sequence number is indicated in block 437.

Validation of the key based on the sequence number is indicated in blocks 440–445 in FIG. 10*f*. If the key's sequence number equals to the lock level sequence number the current sequence number is indicated. If this condition is not true, the lock level sequence range is checked to see if equal to 15 indicating unlimited. If this condition is no, the key sequence number is checked to see if less than the lock level sequence number. If yes, an error occurs, if no the key sequence number is checked to see if less than or equal to the lock sequence number plus the lock level sequence range. If no, there is an error, however, if yes, a new sequence number is indicated. If the sequence range is unlimited, the program checks to see if a current key is indicated based upon the date. If no, the new sequence number is indicated. If yes, the key sequence numbers check to see if less than the lock level sequence number. If no, new sequence numbers indicated and if yes, an error occurs.

To validate the key expiration, the routine of blocks 465–474 is utilized in FIG. 10*h*. First, the program checks to see if the lock level's valid time condition equals 2 or 3 indicating keys expired. If yes, the program checks to see if the lock's date is set and if no, check to see if the lock level expiration operation when lock's date not set equals 1. If no, an error is indicated. If the lock's time is not set, the lock level shift/key expiration when lock's time not set bit to see if equal 1 indicating is to operation any way. If the lock level's operation equals 3–6 indicating expiration based on when new key is used instead of the key's new key date., the expiration date is equal to the expiration date stored for the key in the lock level's record. Otherwise, the expiration date equals the key's expiration date offset plus the keys new key date. If the expiration date plus the keys expiration time is less than the lock's date and time, the key has expired. Otherwise, the main routine is returned to.

With regard to checking the invalid days on the key and in the level in FIG. 10*i* and blocks 470–474, first it is checked that all the lock levels and all the keys invalid days in valid days bits equals zero which indicates that all days are valid. If not, the program checks to see if the lock's date day of week is set. If not, the program checks to see if the lock level's invalid day of week validation when lock's date of week is not set equals 1 indicating operate into any way. If the day of week is set, for the lock's day of week for each of the seven days, the key's invalid day bit is checked to see if equaling 1 or if the lock level's invalid day bit equally 1 of the day. The main routine is then returned too.

The checking of the pass operation time routine is indicated in FIG. 10*j* and blocks 475–485. The pass operational times utilizes the lock level's operation time criteria equal to zero and whether the lock's time is set. Also the program utilizes the pass operation when lock's time not set bit and the lock operational time criteria, the date set, invalid days operation when lock state not set.

Figure 10P:
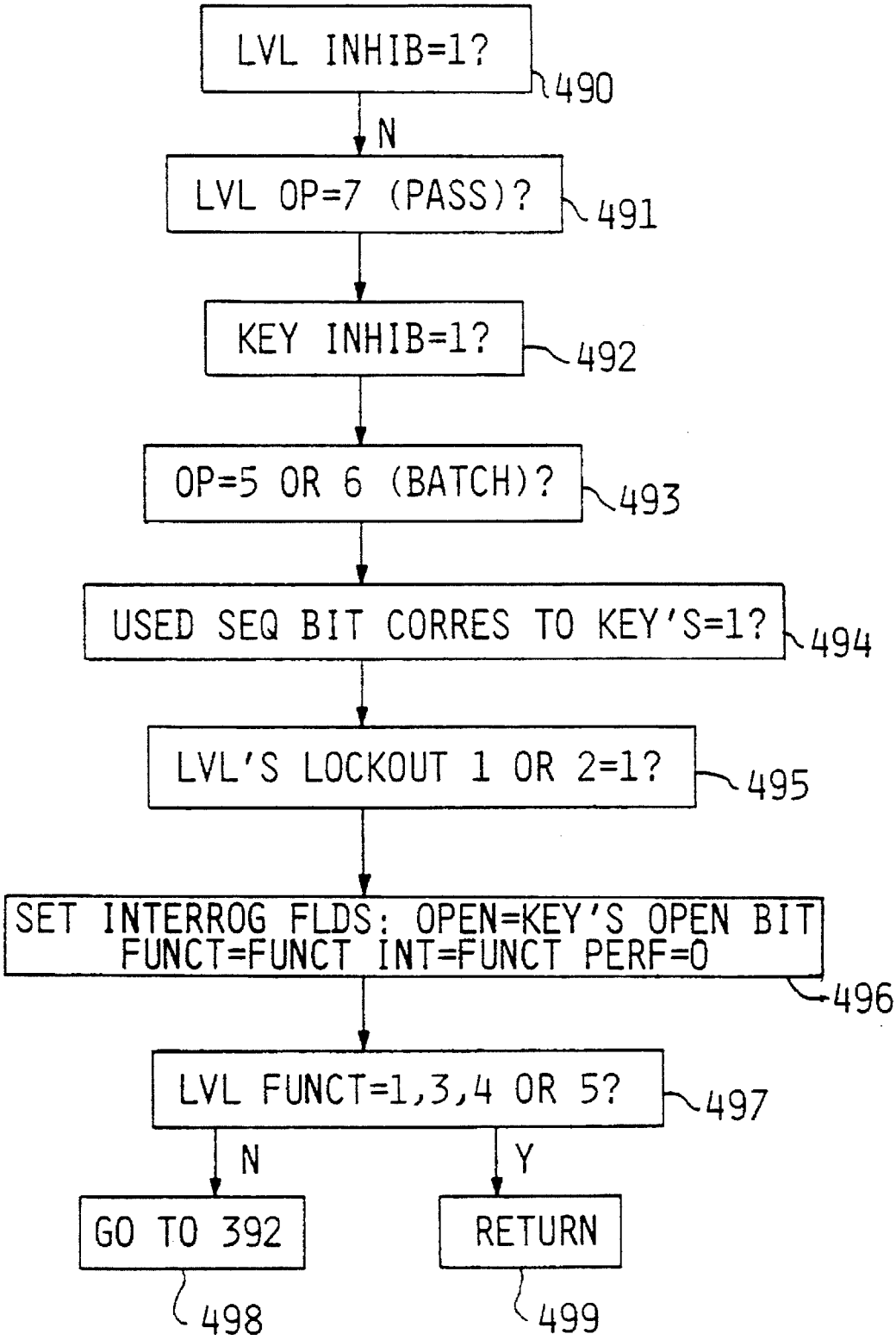

Subroutine for checking the inhibits in electronic lockouts are indicated in FIG. 10*p* and blocks 490–499. The level's inhibit status, key inhibit status, lock level's lockout status are utilizes to determine whether the key is inhibited or locked out. Subroutine for preforming the inhibit levels function equals 1, is illustrated in blocks 500–510 in FIG. 10*k*.

Time and Date Update Routine

Figure 11:
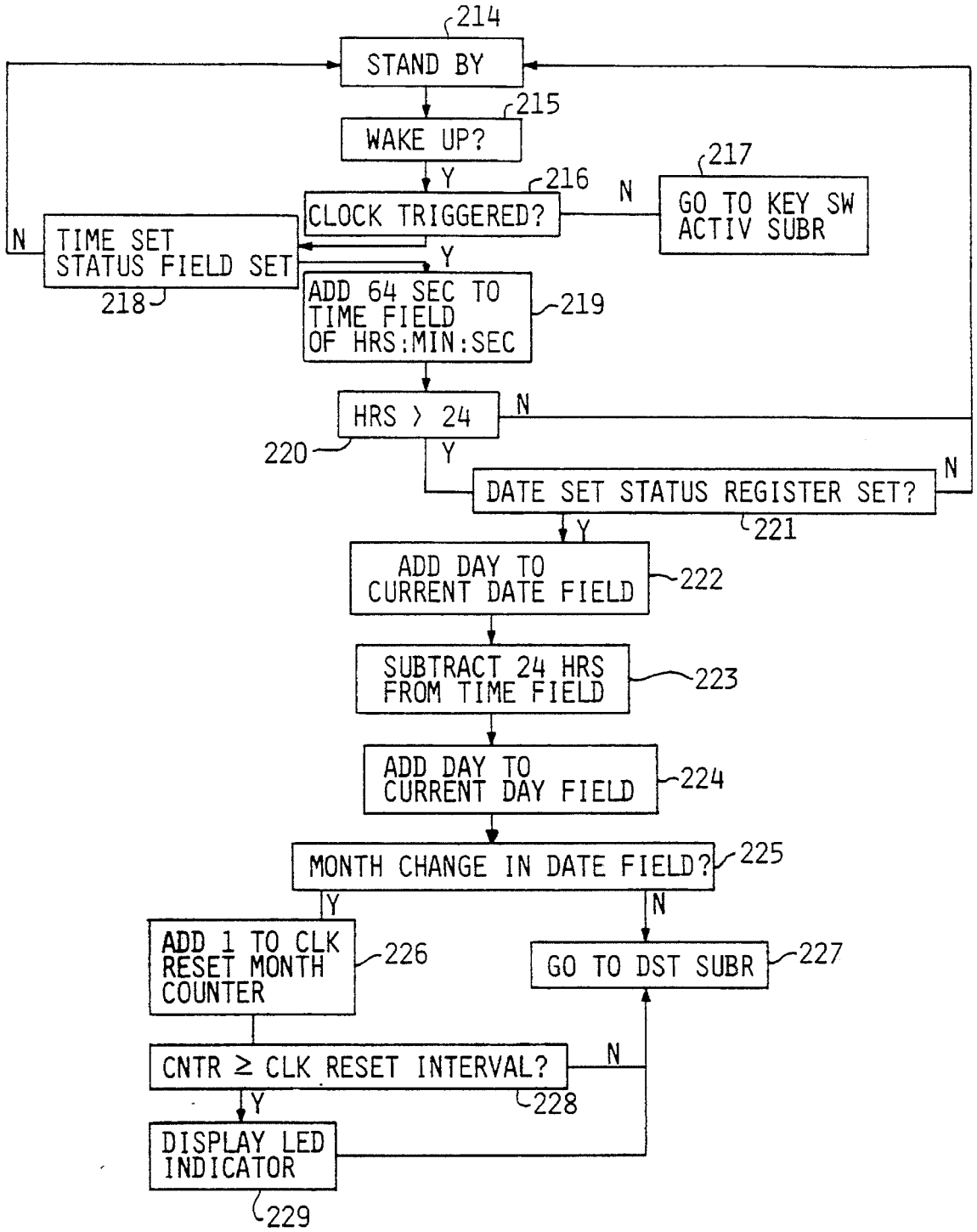

The routine for updating the clock time and date upon lock wake up every 64 seconds is more specifically illustrated in FIG. 11. If the wake up is due to the clock, the time set status field is checked as indicated in blocks 214–218. If it is set, 64 seconds is added to the current time field as in block 219. Thereafter, the date set status field is checked if 24 hours is passed upon the wake up. If so, the current date field is updated according to blocks 220–224. The reset month counter field and clock reset interval field are checked if a new month is entered in blocks 225–229.

Automatic Latching/Unlatching Routine

Figure 12:
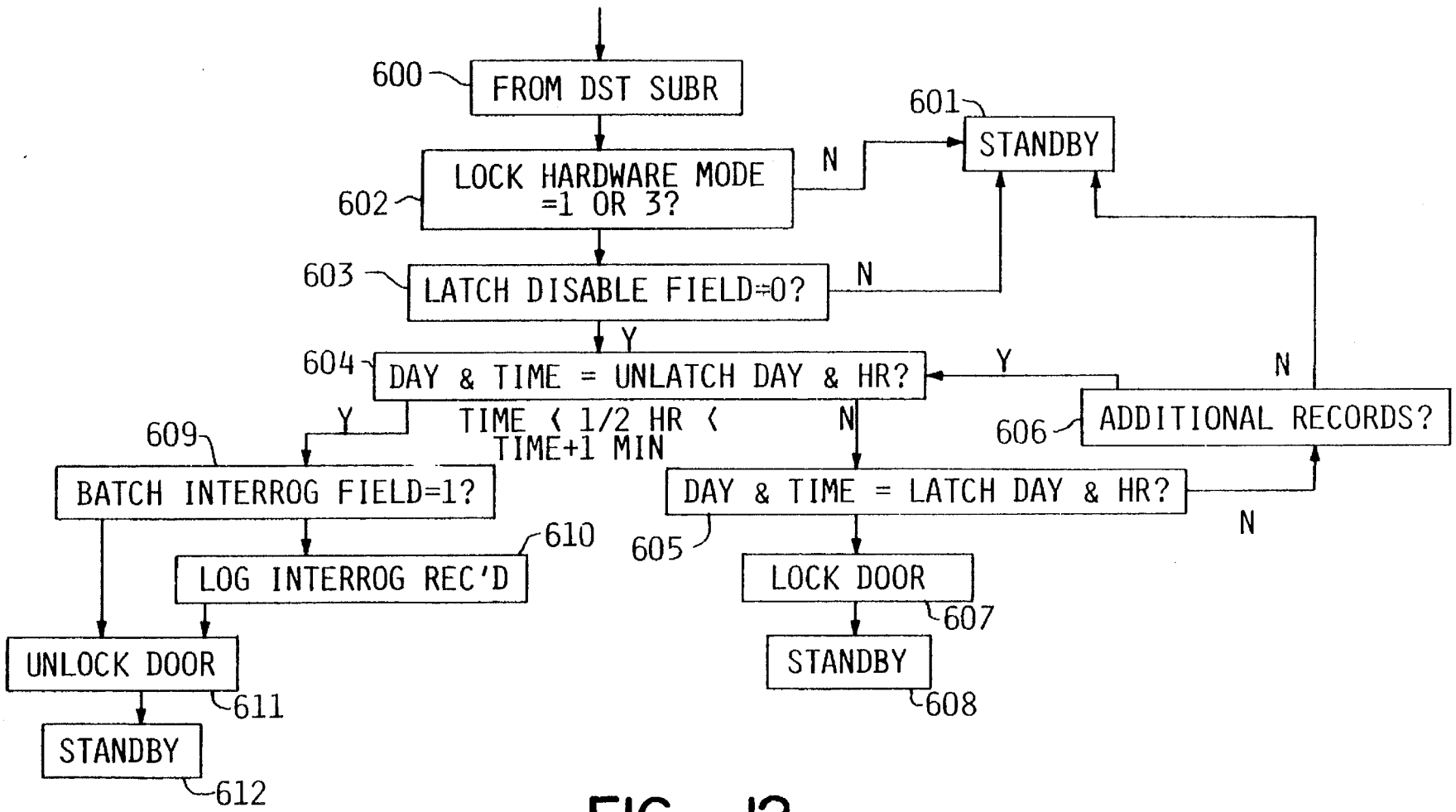

The routine for automatic latching and unlatching of the lock is more particularly illustrated in FIG. 12 blocks 600–612. The lock hardware mode is check to ensure a motorized lock. The latch disable field is checked to see if set or not. If it is set, the fist unlatch day and half hour are compared to the current day and time. If true, the interrogation field is checked to determine whether or not to log an interrogation record, the door is unlocked, and stand by entered. If the unlatch day and time are not accurate, the latch day and hour are checked. If the day and time match, the door is locked. Thereafter, if no match of the first record of unlatch and latch times, an additional record of latch and unlatch times and days is acquired for checking. Otherwise, stand by is entered.

Clock Updated—Check Dst Routine

Figure 13:
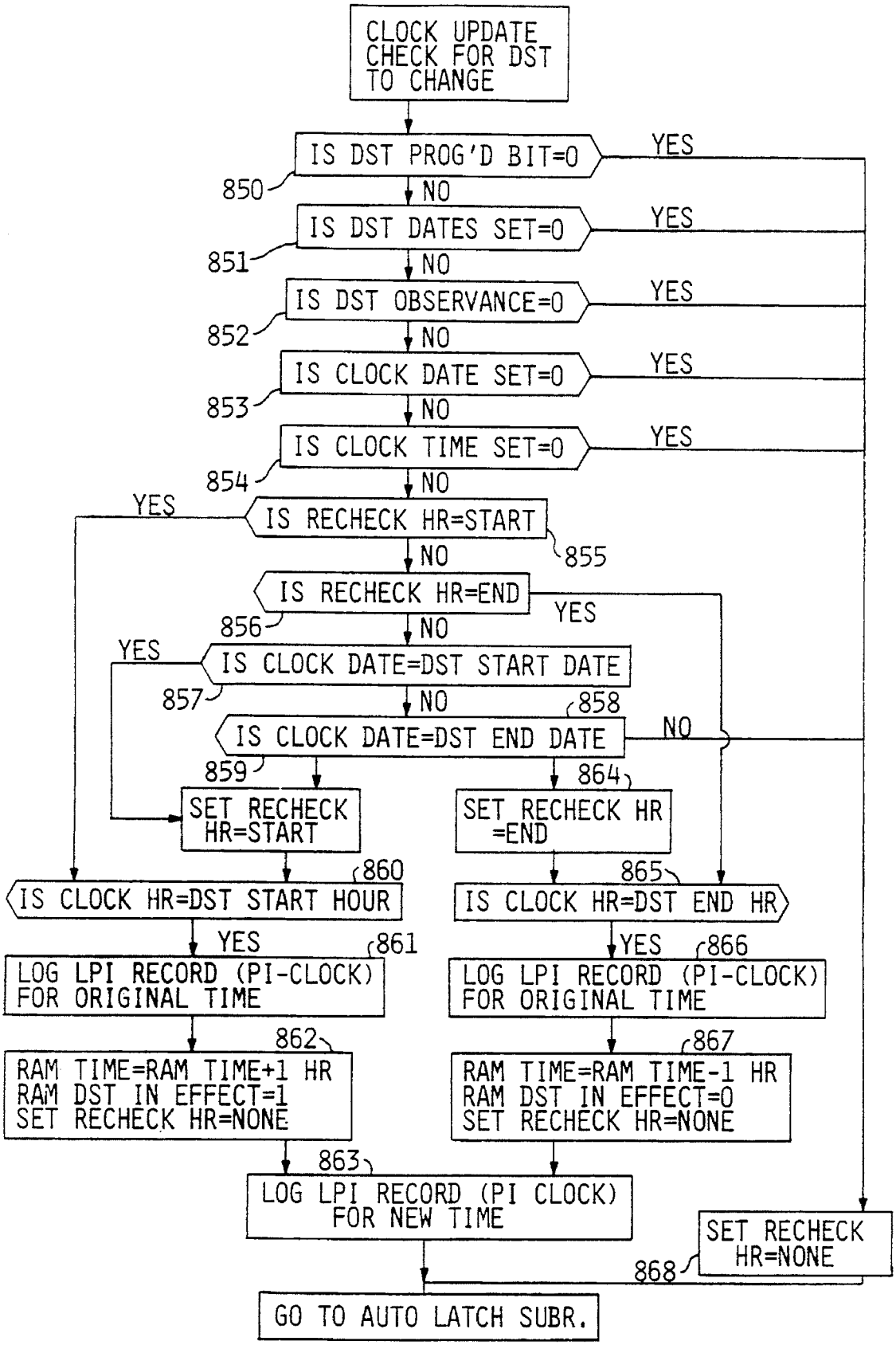
Figures 1, 14A:
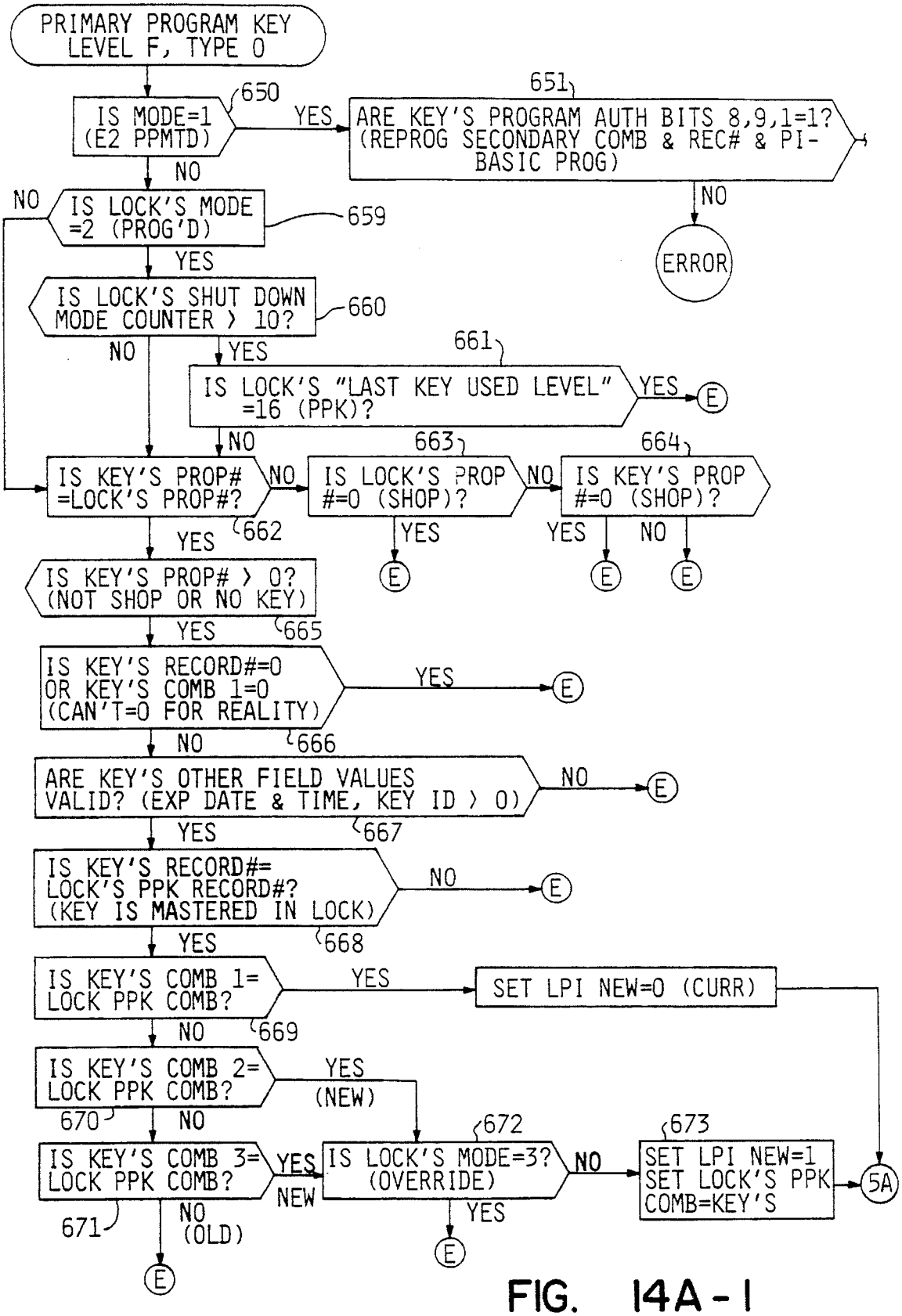
Figures 2, 14A:
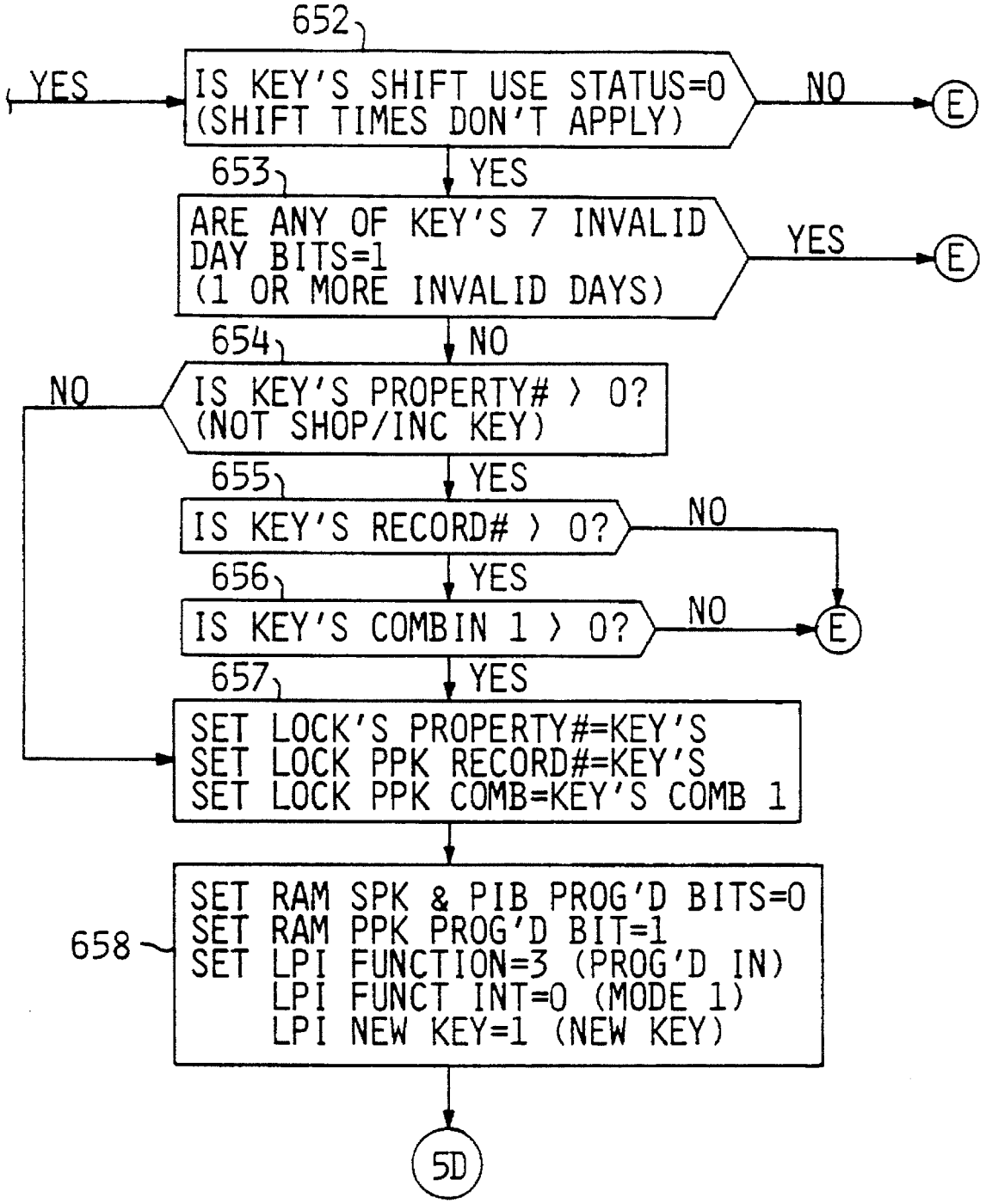
Figure 14B:
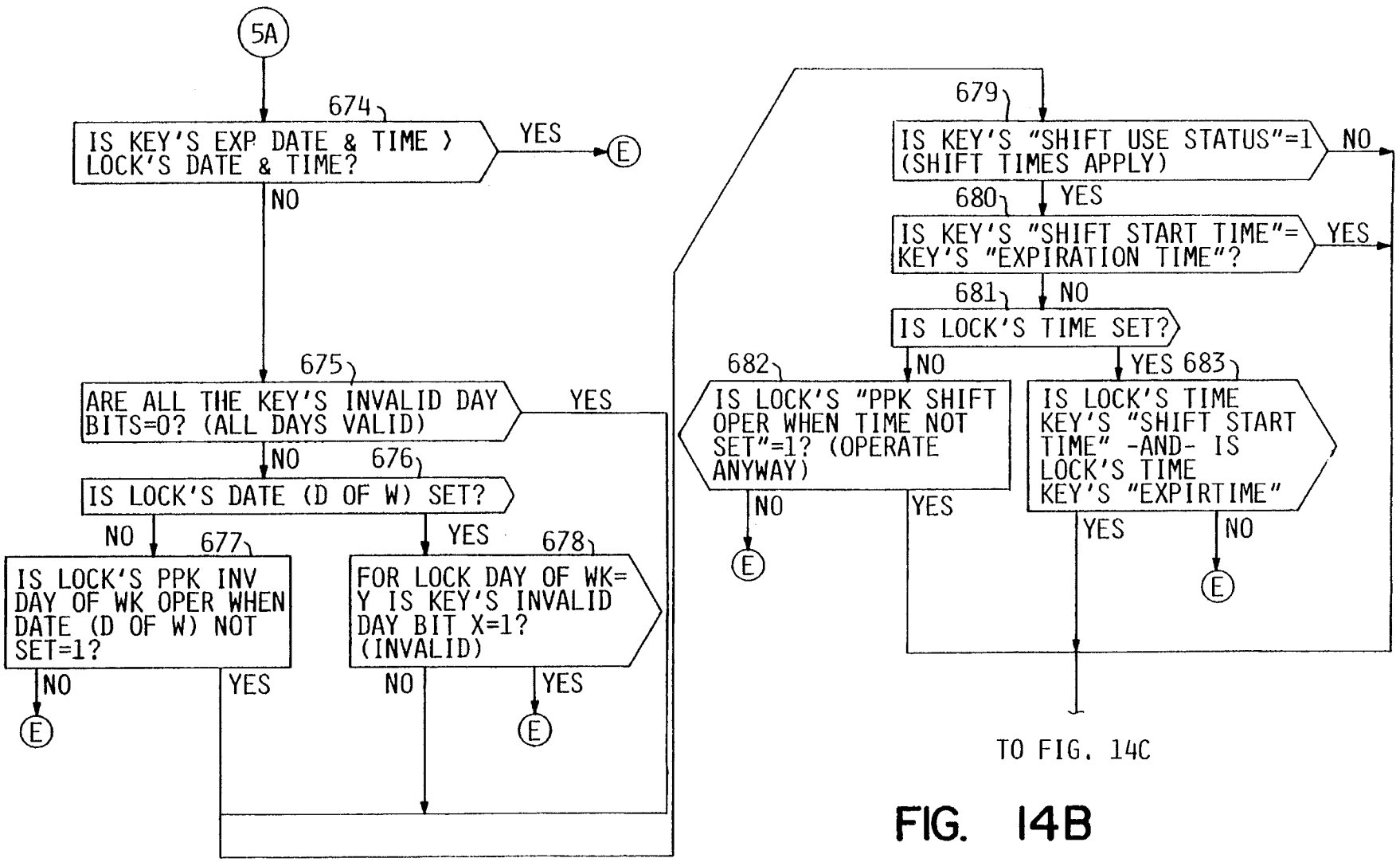
Figure 14C:
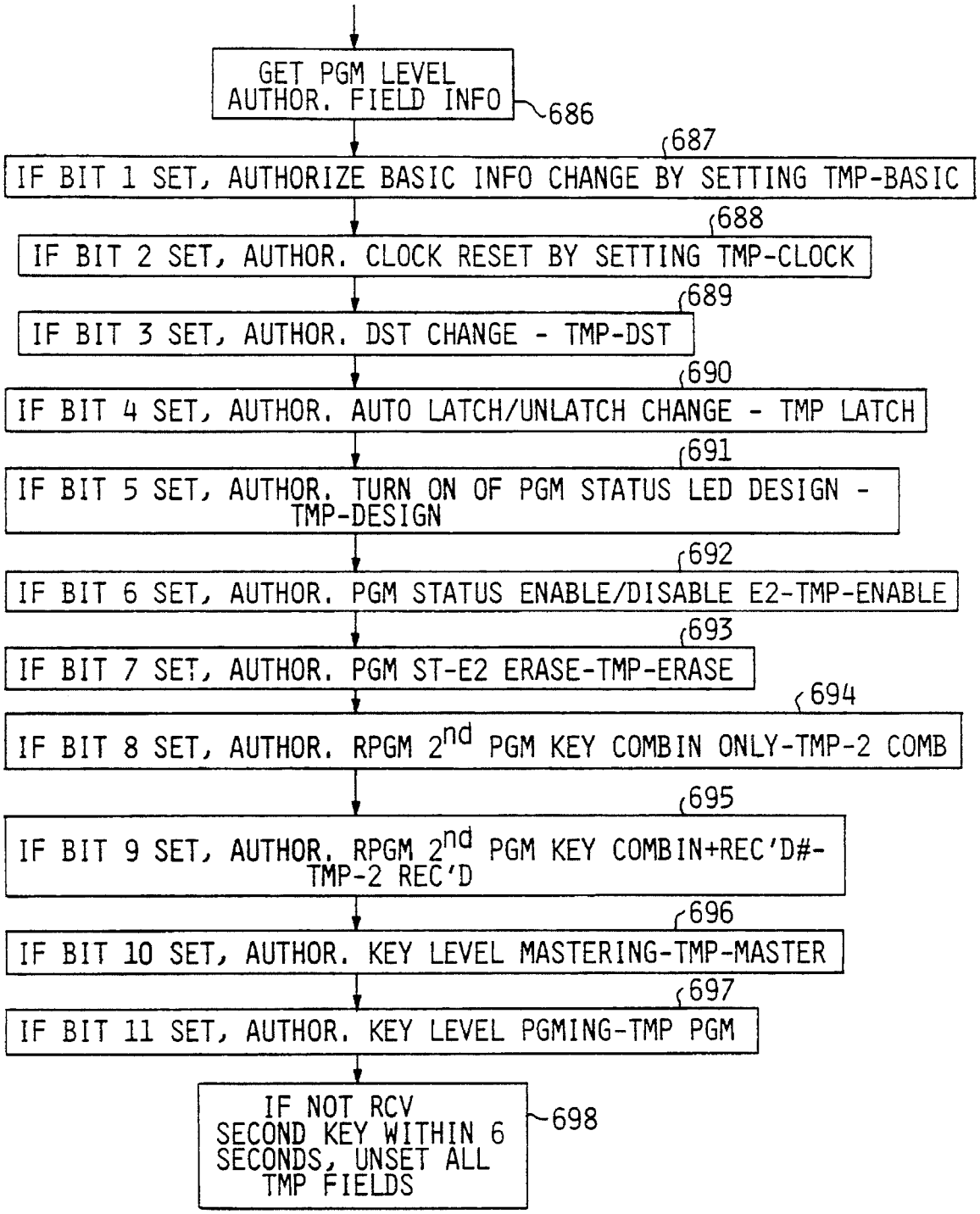

The routine indicated in FIG. 13 is utilized after the clock date is updated and after every clock hour update if the temporary field recheck is indicated. The program in blocks 850 through 854 determine whether daylight savings time is to be observed, and if so, if the date and time are set. If daylight savings time is initiated, the register storing time is incremented by one hour and fields are set as indicated in blocks 859–862. If DST is to be ended, blocks 864–867 decrease the time by an hour and reset the fields indicating DST is not in effect.

Motor Switch Routine

Any procedure which is designed to unlock or lock the door requires checks on the motor switch positions in the last motor switch position register 176. Lock to unlock state is indicated by any of the following bit combinations of unlock/lock switches 94, 96: 0/1, 0/0, 1/0. The following bit combination indicates unlocked to lock of the status of the switches unlock/lock switches: 1/0, 0/0, 0/1. When an instruction to the motor to lock from an unlocked state, lock switch 96 is monitored to ensure it is changing state during a cycle. As long as the switch changes states and is activated, then the motor successfully completed the lock instruction. If either of the two conditions is not met, then a possible open lock is indicated by setting the critical lock failure bit. When the critical locking failure bit is set, the next time the key is used, the lock will first try to relock the lock. If it is unsuccessful, the key validation will be aborted and special warning LEDs will be provided. If it successful, key validation and processing continues. Since the first switch 94 is not critical if it gets stuck, it will not result in a special procedure. If the lock switch 96 does not change states, it indicates that one or more switches 94, 96 are stuck and/or motor jamming or not working. The lock will automatically reattempt the motor command once more if it fails.

Primary Program Lock Fields

The Primary Program level fields 186 (level recognition code F) are stored in the EEPROM and is programmed with the following information pertinent to each level. Level key information fields are used to verify that a Primary Program key is valid and to identify whether the key is new, current or old. The key record number field includes 6 bits and indicates distinct record number assigned to the Primary Program key. The current combination code field includes 12 bits and stores the current combination code of the newest valid key it received. When a key is used, it compares the key's current combination to this field to determine whether the key is valid. Primary Program keys also contain the previous combination code and the one before that. The lock checks these codes if the key's current code does not match. If either of these combinations match and the key record number on the key also matches, the lock stores the key's current combination in this field since it recognizes that it is a new key.

The program enable status field includes indicates whether the Primary Program key can be used with Program Information keys to change the lock's programming. If the field is 0, programming is allowed. If the field is 1, programming is not allowed. The last key used diagnostics field includes five bits and indicates why the last key used did not allow the door to be opened. The following reasons would correspond to the diagnostic codes. They are listed in the order the conditions which are checked. The lock would store the first code that applied. If the field=0 then no problem with the last key. For invalid keys: if the field=1 then invalid checksum; if the field=2 then invalid property number; if the field=5 then invalid key record number (wrong room or master); if the field=8 then unrecognizable combination (too many new keys made and not used). For valid key but invalid conditions: if the field=9 then internal clock not set and invalid day of week per key; if the field=10 then internal clock is set and invalid day of week per key; if the field=11 then end date/time has expired and older than current lock time; if the field=12 then internal clock not set and shift key not allowed to work; if the field=13 then internal clock is set and shift key not used during shift hours; if the field=14 then programming disabled.

Primary Program Key

The primary program key allows reprogramming of the lock basic information area 180 in the EEPROM, the Secondary program key and remastering or programming of the regular standard levels. The keys are nonopening. Used alone, the primary program key does nothing except set the lock up to accept a program information or secondary program key. A valid program information or secondary program key must be used before the main program key times out, i.e. 6 seconds. The program key must have the same master number and combination. If the primary program key gets out of sequence, only the secondary program key can reprogram a new primary program key into the lock.

The following fields are included on a primary program key. The key/lock level recognition code equal to F and key type code field=0. The key record number field indicates a distinct record number for each key. The property number field is as defined as in other keys. The combination codes field contains three combination codes: the current code of the newest key generated by the computer, the previous code and the one before that. The duplicate key identification number field, and the program level authorization field indicates the types of Program Information keys that can be used with this key. Each bit corresponds to one of the following type of Program Information keys, status keys, or the Secondary Program key: Bit 1 indicates General Lock: Basic (Property Number, Lock Address & Door/Room Number); Bit 2 indicates General Lock: Clock (Clock, Day of Week, Clock Reset info); Bit 3 indicates General Lock: DST (DST Start and End Date and Time); Bit 4 indicates General Lock: Auto Latch/Unlatch (Interrogation Criteria and Latch/Unlatch records); Bit 5 indicates program status, LED Diagnostics; Bit 6 indicates program status—disable/enable EEPROM; Bit 7 indicates program status—erase EEPROM; Bit 8 indicates reprogram Secondary Program key—combination; Bit 9 indicates reprogram Secondary Program key—combination and key record number; Bit 10 indicates Key Level Mastering; Bit 11 indicates Key Level Programming. The new shift hour field only applies to the Primary Program key type=0. The new shift hour is only used in conjunction with the Shift Use Status bit to determine whether the program key should only work during certain hours of the day. The shift hour only applies if the Shift Use Status on the key is set to 1. The shift use status field indicates whether the lock should use the new and expiration hours on the key for the hours the key is allowed to work. The expiration date and time on the key will still be used to determine the last date the key can be used. The expiration date and time field is used to determine when the key has expired. The end time is also used to determine the end of the shift hours if the Shift Use Status bit is set. The invalid days field indicates the days of the week the key is not allowed to operate any locks. The random number field is a field introduced to ensure that even duplicate keys are very differently encoded. The random number is part of the checksum equation and is the same as for Standard Level keys.

Primary Program Key Routine

The routine for the primary program key is illustrated in FIGS. 14A-1 14A-2 14B and 14C. The key's property number is checked with the lock's property number indicated in block 659. Block 665 through 670 check the record number and three combination fields to determine if the key is valid. The program branches to block 674 to validate the key expiration. If the keys expiration date and time are not greater than the locks date and time, the program branches to block 675 to check the invalid days by a program block 675 through 698. If valid days occur, the program advances to block 679 which checks the shift times. If the shift times are valid by checking block 679 through 683. If the primary program key is the first key used in a cycle period of 6 seconds, the program sets temporary fields based on the key's program level authorization field. These fields remain set until a second key is received, or the cycle period times out in 6 seconds if no key is received. After each subsequent valid key use, the 6 second cycle is reinitiated.

Program Information Keys

The program information keys allow reprogramming of the basic lock information storage area 180, the standard level information area 182, and the standard key information area 184. The keys only work if a valid primary program key with appropriate authorization is used in the lock first and within 6 seconds. All keys include the following fields: level recognition code, key type code, property number, random number, checksum, and expiration date and time. Additional fields are included and depend on the type of fields to be programmed in the lock.

Program Information Key—level Mastering

The program information—level mastering keys are used to reprogram a lock's level for a particular room or master number. These keys program all four of the level's key data fields: key record number, sequence number, key combination, and new date and time. If the key is a change mastering key and the key level's operation is batch, the key would indicate a new packet of keys was being programmed in and the lock will also clear out all valid and used key sequence number information. The additional fields are: The key/lock level recognition code field is one of "0" through "D" and the key type code field has a field value of 3. The main function code field has possible code values of the following: if the field=0 then change an existing key's mastering information; if the field=1 then add new key's mastering information; if the field=2 then delete an existing key's mastering information; if the field=3 then delete all key's assigned to the level. The change effects field only applies if the key is a change key (Main function 1) and identifies what fields the key is allowed to change if the key is a change key. Each bit represents one of the fields the key is allowed to change and include the following bit assignments: field=0 then change an existing key's random combination; field=1 then change an existing key's start date and time; field=2 then change an existing key's sequence number. The key record number field identifies the particular room or master key that should be changed, added or deleted in the lock level. The new date and time field must match or be greater than the lock level's new date and time for the key record number identified. The sequence number/primary program combination code field is a function of a key's sequence number and the Primary Program level's current combination. It is similar in function to the Standard key's Sequence Number/Key Combination field except that the combination used is from the Primary Program level. This field is used differently dependent on the main function code field. If the key is Change or Add key, this value will be programmed into the level. If the key is a delete key, this field is irrelevant. The key combination/primary program combination code field is a function of a the key's combination and the primary program level's current combination. It is similar in function to the Sequence Number/Primary Program Combination field described above. This field is used differently depending on the Main Function Code. If the key is change or add key, this value will be programmed into the level. If the key is a delete key, this field is irrelevant—it does not have to match the key combination stored in the lock level for the key record number identified in order for the key to be considered valid.

Other program information keys

The system includes the other type of program information keys. The program information keys operate in a manner similar to that described herein above. The following fields may be changed using the program information key (0–D/3) for level programming: operation, function, subfunction, additional information, sequence range, valid key time criteria, invalid days, effective lock outs, override deadbolt, clock reset hassle, program group, key expiration operation with lock date not set, shift key operation with lock time not set and invalid days operation with date not set.

The program information keys for pass operation mastering (0–D/4) are used to reprogram information utilized during the pass operation and include the following fields: pass number validation criteria, time varying criteria, valid pass groups, days of week, time applies, operation start time, operation end time, and operation with time not set.

The Program Information—General Lock Programming keys (E/1-5) are used to reprogram information stored in the lock's general EEPROM and RAM and include the following field to be programmed into the lock: property number, lock address, lock room number, internal clock date, current day of week, clock set condition—set key operation, day of week set condition—invalid days operation, DST observance, DST start and end information, auto latch and unlatch records and status.

Program Information Keys Routine

Figure 15:
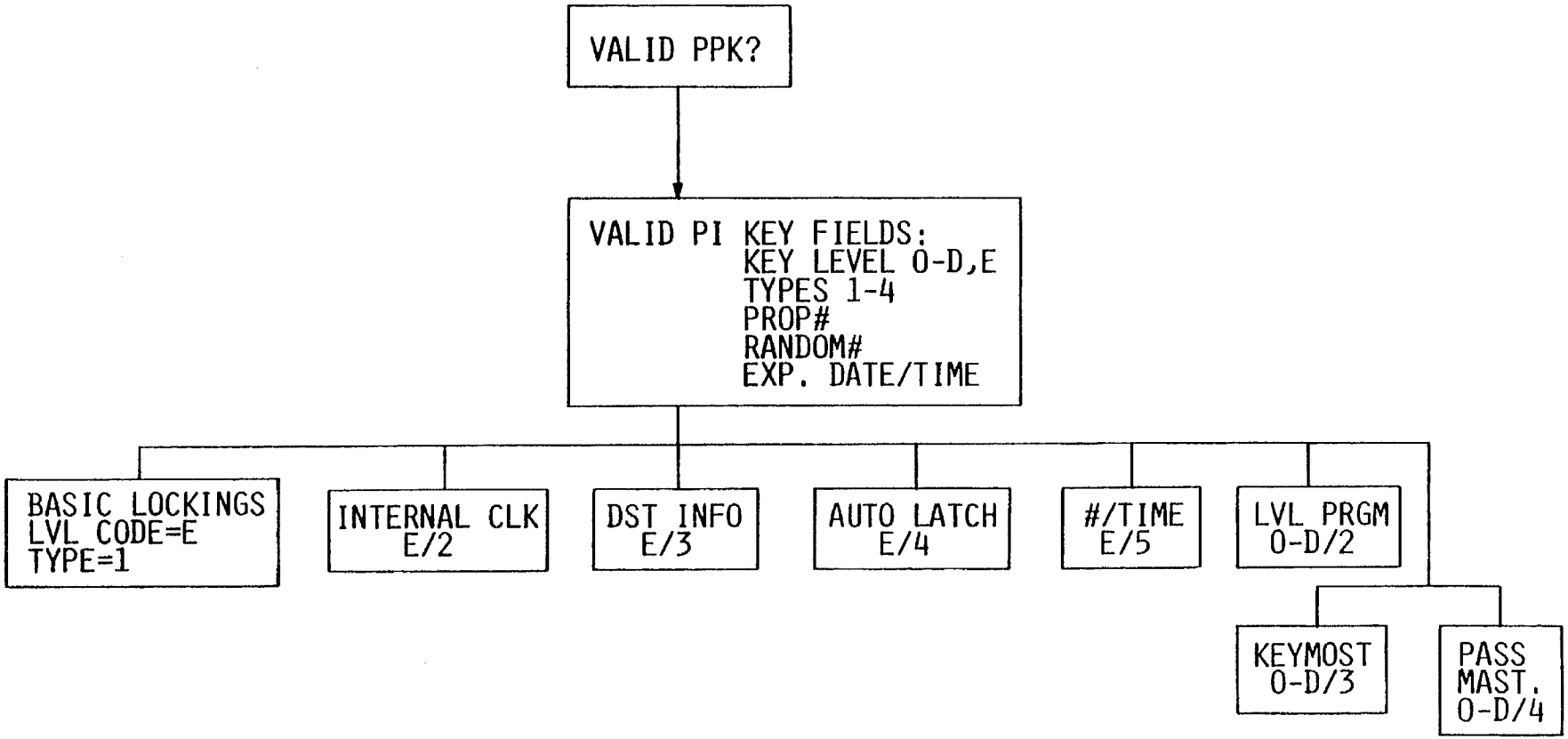

FIG. 15 generally illustrates the routine for the program information keys. Each of the fields of key level, recognition code, key type code, property number, random number and expiration date and time are validated and branched to their respective program information key relating to the level recognition code in the key type code as long as validation has occurred. Thereafter, the lock memory is changed to the information on the program information key under the condition that the primary program key initially authorized such a change to occur. The field which are allowed to be changed have been discussed prior with respect to the following program information keys: level program, key mastering, pass operation mastering, basic lock, internal clock, DST information, and automatic latch/unlatch.

The specific routine for the program information key for the clock is shown in FIG. 16*a*–c.

Secondary Program Lock Fields

The Secondary Program level fields 188 (level recognition code E) are stored in EEPROM. The lock is programmed with the following information pertinent to each level.

The general area 187 includes the current key combination field, key record number field, and last key used diagnostic field. The last key used diagnostics field includes 5 bits and indicates why the last key used did not allow the door to be opened and is logged as with the primary key. The lock stores the first code that applied. The codes for the secondary program key are as follows: if the field=0 then no problem with key. For invalid keys: if the field=1 then invalid checksum; if the field=2 then invalid property number; if the field=5 then invalid key record number (wrong room or master); if the field=8 then unrecognizable combination (too many new keys made and not used). For valid key but invalid conditions: if the field=11 then expiration date and time has expired and older than current lock time.

Secondary program key

The Secondary Program Key's sole purpose is to allow reprogramming of the Primary Program level. When this key is used, an Interrogation entry is logged with the key identification.

The following fields are included on a Secondary Program Key. The key record number field, property number field, combination codes as in the primary program, the duplicate key identification number field, and expiration date and time field are as previously discussed. The primary program re-mastering capability field indicates whether the Primary Program key's key record number will be programmed into the lock as well as the current combination. If the bit=1, it will be. If it is not, the Primary Program key used must have the same key record number as the lock in order for its combination to be accepted. The random number field is as described with the primary program key. The checksum and filler bits are as previously discussed.

Secondary Program Key Routine

The secondary program key is validated in a similar manner to the primary program key, except that there are no invalid days and shifts. The secondary program key must be inserted prior to inserting the primary program key. If the bit is set to 1, the record number in combination for the primary program key stored in RAM is enabled. If a primary program key is received within 6 seconds, the new record number and combination therefrom is stored in the EEPROM. If the remastering capability bit is set to 0, the combination is enabled for change. If primary program key is received within 6 seconds, the record number thereof is first checked to insure that the primary program key belongs to the lock, and if matched, sets the new combination to the combination stored on the key.

Special Level Keys

Special level keys allow reprogramming the lock's current sequence number if too many new keys are made and not used, or to inhibit or uninhibit a particular key associated with a key level that has multiple room/master keys associated with it.

The level recognition code field of a value between "0" and "D", corresponding to the 14 normal key levels and the key type code field=1 for special level keys. In the special level key, the main function code field include the following: if the field=0 then reprogram the sequence number; if the field=1 then inhibiting; if the field=2 then uninhibiting. The fields include: the duplicate key identification number field, the key record number field, the new date and time field, the expiration date and time fields, and the property number field. The sequence number/key combination code field is similar to the standard level. If the key is an inhibit or uninhibit key, and the key's sequence number matched the lock level's, the key would be valid otherwise it would not. If the key is a re-sequencing key, the key's sequence number would only be used to know what the lock level's sequence number should be changed to in the event the key is valid.

Special Keys Routine

The routine for the special keys, level 0–D, type 1, main function 0, 1 and 2 are illustrated in FIG. 20. The basic validation steps validate property number and key record number. Then the main function type is checked. If the main function=0, the new date, sequence number, invalid days, and key expiration are validated. Then, the new sequence data is stored. If main function=1 and operation is not 0, 5, 6 or 7, the new key date, sequence, key expiration and key is invalid days number are validated as in the standard keys. Depending on whether the key is new or current, the fields of new key date and time, sequence number and expiration date may be set as in the standard key. Thereafter if no errors, the key inhibit status is set to inhibited. Main function=2 utilizes the validation above but will uninhibit a key.

EXIT ROUTINE

Upon the completion of each routine above for validating a key and performing the functions in response thereto, the exit routine is executed, which is illustrated in FIG. 16. First, the status of the shutdown mode counter is checked to see if less than 10 in block 701. If the counter is less than 10, the diagnostic code, level, record number and type are stored in block 702. If the key is invalid, the level, type and record number are stored n the diagnostic code and last key used fields in block 704 and the counter is incremented in block 705. If the counter equal 10, an interrogation record is entered and the counter is set to 12 and shut down cycle is begun in blocks 706–708. If the key was valid in block 703, the shut down counter is set to 0, an interrogation record entered, and motor functions performed in blocks 709–711. If a no occurs in block 701, the counter is checked to determine if equal to 10 in block 711. If yes, and the key is valid, the diagnostic codes and last key used fields are stored in blocks 713–714, and the program goes to block 709 described above. If the key is invalid in block 713, the program goes to block 708. If the counter does not equal 10, the keys level and type are set to the last used key. If the key is determined to be valid in block 716, the program branched to block 714. If the key is invalid in block 716, the last key used field is reset in block 718. The shut down mode counter is set to 12 in block 719, and branches to end 723.

After blocks 708 and/or 711 are completed, if the LED diagnostic mode is turned on, the diagnostic codes are displayed by blocks 720 and 722. The normal LED operation are displayed if there is no error and diagnostic mode on.

Led Indication

The locks LEDs 44, 46, 48 may be used in a variety of situations to indicate a problem every time the lock wakes up, to provide normal validation and error signals after a key is used, to provide diagnostic signals after a key is used and to communicate with an interrogation unit.

Visual display means comprises the three available LEDs which colors are green 44, yellow 46 and red 48. The duration of the LEDs can be varied and displayed as a blip indicating 250 milliseconds, normal duration indicated by 500 milliseconds, long duration of 3 seconds, and full cycle of 6 seconds. The frequency of the LEDs is indicated as 1 flash per 0.5 second=frequency A, 1 flash per 1 second=frequency B, 1 flash per 2 seconds=frequency C, and 1 flash per 6 seconds=frequency D.

The normal operation of the LEDs when not in diagnostic mode is as follows. In standard key situations, if the key is valid but fatal warning of the following: low battery hassle with the first key use, the red LED 48 illuminates for 12 normal pulse durations at frequency B; low battery lock out illuminates the red LED 48 for 3 pulses having a long pulse duration at frequency D; clock reset hassle with the first key use, the red LED 48 is illuminated for 12 normal pulses at frequency B; clock reset lockout illuminates the red LED 48 for 3 pulses of long duration at frequency D. If the standard key is used and is valid, but includes invalid operating conditions because invalid day or shift, time out, inhibited, or limited key, the yellow LED 46 is operated for 8 blips at frequency D. If the standard key is used and is valid, but invalid opening for the following conditions: locked out or deadbolt, the yellow LED 46 is illuminated for 12 pulses for normal duration at frequency B; standard level nonopening, the yellow LED 46 is illuminated for 12 normal pulses at frequency B. For the standard key used and valid opening, the green LED 44 is illuminated twelve times at a normal duration frequency B.

For valid standard keys, the normal LEDs are operated in addition to the following: for low battery warning, the red LED is alternated twelve times along with normal LEDs; for clock reset warning, the red LED is simultaneously illuminated twelve times along with the normal LEDs; locking, inhibiting or latching lock key functions utilizes the red LED proceeding normal LED for one pulse; bad motor switch utilizes the yellow LED for one pulse after the normal LED operation.

If the keys are used and valid in operation and successful: for the special level keys, the yellow LED is illuminated for six pulses; for the primary program key and not during secondary cycle, the yellow LED is illuminated for six cycles of one second duration and one flash per two seconds; for the primary program key and during secondary cycle, the green and yellow LEDs are simultaneously illuminated for two pulses; for the program information key during primary/secondary cycle, the green and yellow LEDs are illuminated simultaneously for two pulses.

Other potential problems may be trouble-shot by the following occurrences. If any key produces 1 red blip, the key was inserted in-the lock and not removed within 6 seconds. If any key produces 2 red blips, the lock was unable to read anything from the key. If a key produces a one second red light when using a standard key, the lock is improperly programmed for solenoid or motor. If any standard key produces only flashing red lights, the lock's clock needs resetting or the batteries are low and the key being used is hassled. When any key produces 2 yellow and red blips, the lock was unable to read the entire card. When the key produces simultaneous flashing yellow and red lights, the lock's clock need resetting and the key is a standard non-opening. Other combinations of lights can indicate other preliminary errors.

When the appropriate and expected LEDs do not occur, further diagnosis of the problem may occur through LED diagnostic mode or interrogation or display keys, as subsequently discussed.

LED Diagnostic Mode

During the subroutines for validating and processing the keys, errors may occur. Upon the completion of the key use, a diagnostic code and last key use (level, type, record number) is stored in last key used diagnostic fields in RAM 126, previously discussed, when errors occur. Such codes are assigned in the software. Every error E (FIG. 10) indicated in the software has a number code which will be assigned when the specific error results, which error may be normal LED operation or diagnostic code. Code numbers will determine which type of error. Operation of the LEDs is determined by whether LED diagnostics is turned on and whether an error occurred.

The LED diagnostic mode is initiated and turned on for a predetermined time, such as two minutes, after insertion and validation of a primary program key (authorizations 5) and a diagnostic key (level recognition code F type 1). Thereafter, use of any subsequent key will cause the display via the LEDs of a code which indicates error or normal operation.

The microcomputer 110 stores a look-up table in the EEPROM in the diagnostic storage area 189 comprising a series of codes indicating LED illumination sequences and associated codes from the software errors wherein each error occurring during a subroutine points to one of the diagnostic codes. If the LED diagnostic mode is turned on, the LEDs will illuminate according to the proper code. Such codes have different illumination sequences from the codes previously described under normal LED operations.

If a key does not work in the lock, LED diagnostics can be turned on to visually display an error code indicating exactly why the key did not work, which code or designation is more specific than the normal LED operations. Once the LED diagnostics is turned on, the key that does not work can be used in the lock, and the lock will display the diagnostic error code using the LEDs. If no error occurs, the error code will be equal to zero and the normal LEDs for the key will be displayed. The LED diagnostic mode will turn off automatically after two minutes after the last key is used or can be turned off by reusing the LED diagnostics key. The primary program key and LED diagnostic keys must have the same property number as the lock for validation.

Figure 17:
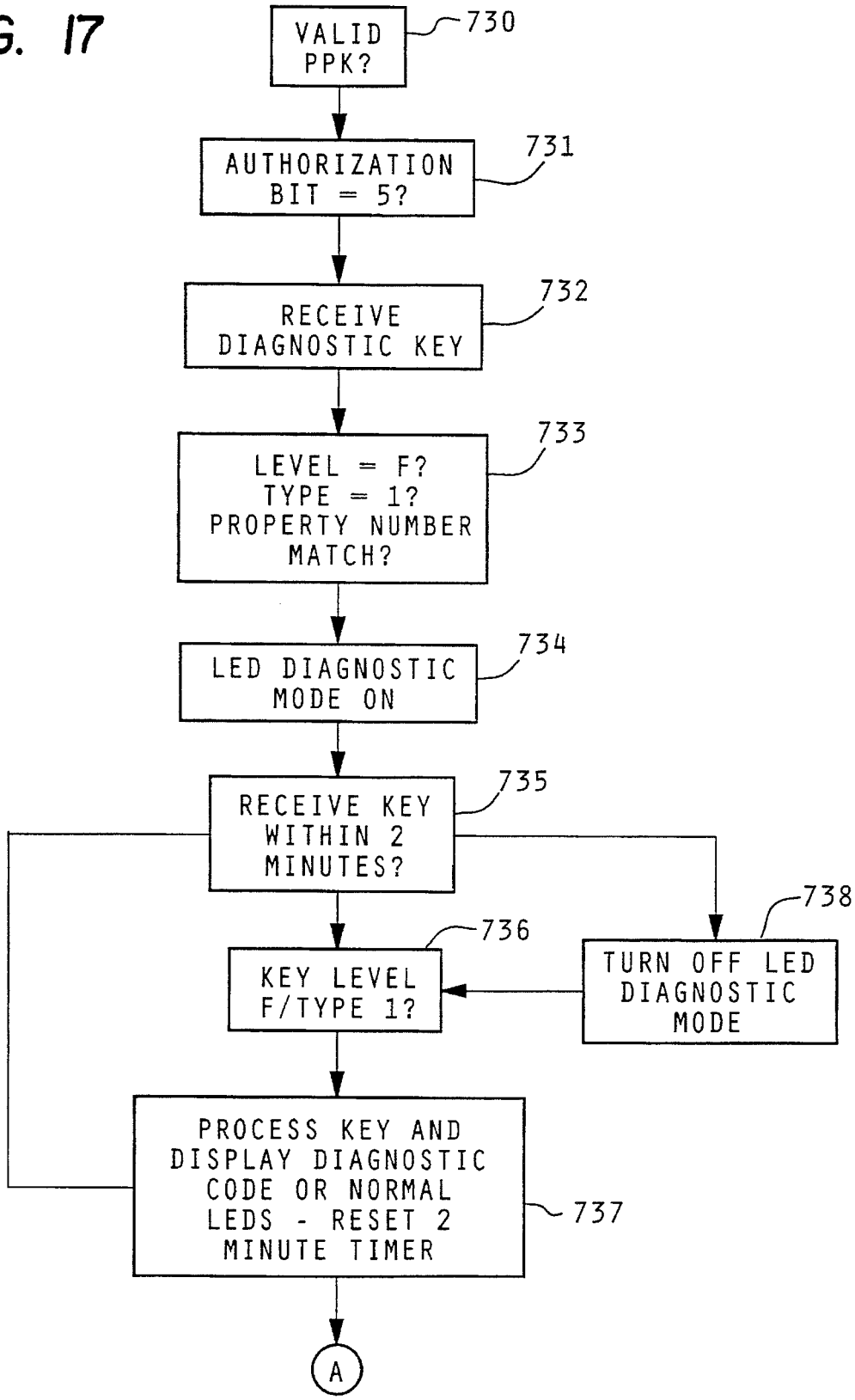

The flow chart of the diagnostic subroutine is illustrated in FIG. 17. In order to turn on the LED diagnostic mode, the primary program key (authorization 5) is used to get a slow flashing yellow light in block 730–731. While the yellow light is flashing, the diagnostics key is used. The program validates the diagnostic key by checking level=F type=1 and property number=locks in block 733. If the key is valid, several flashes of the green and yellow lights will occur and then all LEDs turn off. Otherwise, LED diagnostic mode has not been turned on. If two yellow and red flashes occur, the primary program key did not have authorization 5.

Thereafter, a key that did not work can be utilized in block 735. The program will execute the key as in the appropriate validating and operating subroutines as previously discussed, and when an error E is determined and the last key used diagnostic field updated, the program will display the appropriate LED sequences for the code in block 737. The number of times the different lights or LEDs flash will determine the diagnostics code number. The lights for keys with errors will always flash in the following pattern:

1) all lights come on;

2) a number of green flashes (0 to 2);

3) all lights come on;

4) a number of yellow flashes (0 to 9);

5) all lights come on;

6 ) a number of red flashes (0 to 9); or 7) all lights come on.

The green light represents 100's, the yellow represents 10's and the red represents the 1's in the diagnostic code number. If a working key is used, the lock will display the normal lights for the key instead of the code pattern.

All keys desired to be diagnosed may be sequentially inserted and LEDs read within two minutes of the last key. If longer, the LED diagnostic mode will time out.

The LED diagnostic mode may be turned off by using the LED diagnostic key a second time. Several flashes of the green and yellow lights will occur. If all the lights flash several times when you use the key, then LED diagnostic mode was already turned off.

As an example, if the green LED flashes once, the yellow LED flashes once, and then the red LED flashes six times, the code equals 116. The code may be looked up in a chart to determine the diagnosed problem, i.e., the code 116 indicate that the lock's property number does not equal the key's property number.

The diagnostic errors are assigned in the software when errors occur. In the flow chart illustrated in the FIG., each time an error E occurs, a specific code is assigned thereto. Upon an error condition, the program checks to determine if diagnostic mode has been turned on. If so, the lock displays the diagnostic or error code through the LEDs. The green LED is flashed the number of times indicated in the 100's digit of the code, the yellow LED is flashed the number of times indicated by the 10's digit, and the red LED is flashed the number times indicated by the 1's digit. If the diagnostic mode is not turned on, the diagnostics code is only stored in the appropriate last key used diagnostic field and normal LEDs are displayed.

Exemplary diagnostic codes are as follows which are stored in the last key used diagnostic field.

| CODE | DIAGNOSIS |
|---|---|
| 000 | no error - key is valid |
| 050 | program information clock key: the lock's DST information is not programmed in and must be before a program information clock key can be used |
| 060 | program information clock & program information number/time keys: the hour value is invalid (0–11 only, noon = 0) |
| 116 | all keys: lock's property number doesn't match key's property number - key is not for this property |
| 117 | standard, special, primary program and secondary program keys - lock is in shutdown cycle because 10 or more invalid keys were used |
| 118 | standard, special primary program and secondary program keys: key's record number = 0 (invalid) |
| 120 | all keys: key's expiration date & time or new key date & time contain invalid values for mo, date, hrs or mins (example: 25:00, 4/31, etc) |
| 121 | standard, special, primary and secondary program keys: key's identification number = 0 (invalid) |
| 122 | standard keys: lock level is non-operating for this key's level - key does not belong to this lock |
| 123 | standard & special keys: key's record number is not mastered into the lock level - key does not belong to this lock |
| 127 | standard key: key does not have one of the 12 valid pass numbers required of the pass level |
| 128 | standard & special keys: key is an old key - its new key date is earlier that the lock's key data |
| 129 | standard & special keys: key is an old key - its new key time is earlier that the lock's key date |

-continued

| CODE | DIAGNOSIS |
|---|---|
| 132 | special keys: key is an old key - its new key date and time is earlier than the lock's key data |
| 135 | standard and special keys: key is an old key - level has limited sequence range (1–15) but key's sequence number is older than the lock's key data |
| 136 | standard key: key is limited key and already used the max number times |
| 137 | standard key: the key is a new key but the door is dead bolted and new key cannot be accepted |
| 142 | standard, special and primary program keys: invalid day of week - the key is invalid on this day of week or the lock level is non-operating on this day of week (based on the lock's clock) |
| 176 | primary and secondary program keys: none of key's three combinations matched the lock's current combination. The key is either old or too many new keys were made and never used. Key must be reprogrammed into the lock |
| 179 | display key: key has an invalid function |
| 180 | interrogation request: key appears to be an interrogator request but lock is not in interrogation mode |
| 181 | interrogation request: key has an invalid interrogator function (not = 0 to 7, 128–131) |
| 189 | status key: LED diagnostic key - in an idle cycle, the LED diagnostic key was used when the lock was not in LED diagnostics cycle |

Such codes are exemplary of the codes which may be identified, a similar code is provided for each error E. Furthermore, different error codes may also be designated.

Interrogator Key

The interrogator key recognition code F type 7 is not a typical key but is associated with a key apparatus 35' (FIG. 3B), though is similarly configured and provides similar information. The interrogator key apparatus 35'comprises a key probe portion 33' which allows two-way communication between the lock and an external computer 37. The probe portion 33' includes magnetic coils 114' embedded on a circuit board 39' for transmitting information to the lock microcomputer through the read head. Coded pulses are transmitted therethrough. The apparatus 35' also includes a receiver/transmitter 41' connected to the circuit board and 39' coil 114' which receives information from the red LED. The lock microcomputer strobes out the information in series of pulses through the red LED. The interrogator computer 37 is capable of reprogramming and receiving the interrogation records and other information from each of the locks in the above provided manner through the key apparatus 35'. The interrogator unit including the computer 37 and the probe key apparatus 35' is commonly available from the assignee as the LPI unit (lock programmer/interrogator).

The interrogator probe 35' communicates the following "fields" (transmitted by the coils): level code=F, key type=7, and function. Therefore, basic validation occurs by ensuring it has level F and type 7. Most functions require this minimal validation, however, other functions can require other fields for validation.

The function of the key selectively designates the information to be dumped to the computer 37. For example, the following functions may be utilized: function 0—lock to stay awake for communication; function 1—dump EPROM version; function 2—dump RAM contents; function 3—dump general EEPROM information; function 4—dump information on autolatch and unlatch; function 5—dump interrogation records; function 7 interrogation complete, go into standby; function 8—dump level program groups; etc.

The computer 37 generates the interrogator key and sends the function and other fields to the lock, which in turn responds by dumping the requested information by probing the red LED.

Display Keys

Display keys enable the status of many of the lock's features to be checked. When these keys are used, a variety of light combinations flash to indicate the current status of the feature being tested. Display keys are normally used for diagnostics and troubleshooting.

Each LED has a different value, the same as those used in the LED diagnostic. The green light has a value of 100, the yellow light has a value of 10 and the red light has a value of 1. To interpret the response, the number of times that each LED flashes must be counted and multiplied by its value.

Each display key is capable of providing several elements of information, and the elements that will be displayed are dependent on the display key utilized. When the display key is used, the response will begin and end with a delimiter that consists of all three LEDs flashing at one time. This delimiter is also used to separate the responses to each element.

The display keys include the following fields: level=F, type=5, property number, function (0–10). The following functions cause display of the following information: 0—EEPROM version; 1—time; 2—date; 3—autolatch status; 4—last key entry record; 5—knob turn switch status; 6—dead bolt switch status; 7—motor switch and intended latch status; 8—low battery status; 9—clock input test; 10—LED test.

Figure 18:
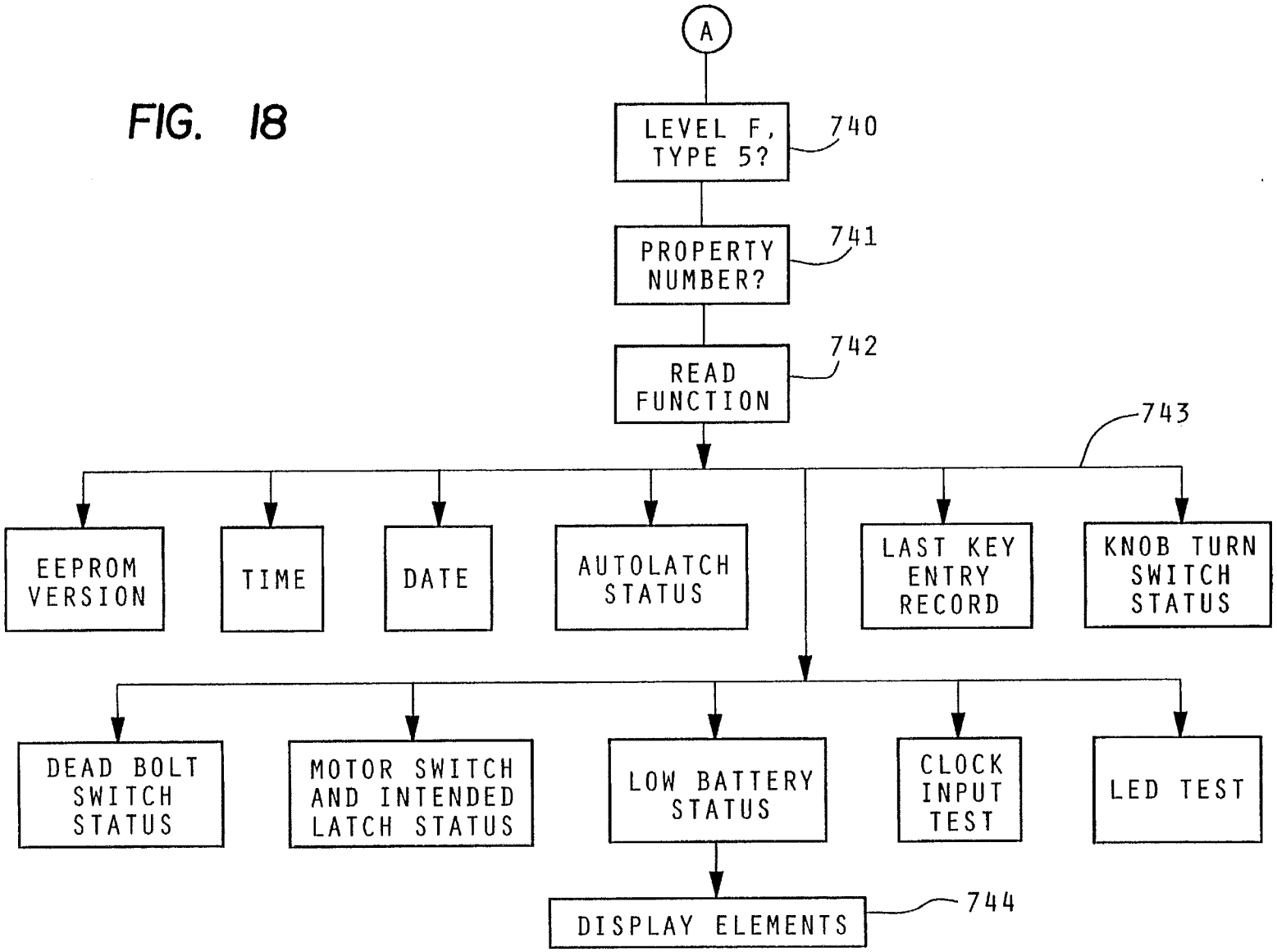

FIG. 18 illustrates the flow chart for display keys, validation and operation. The level and type are checked to ensure level=F and type=5 in block 740. Thereafter, the property number is checked to ensure associated with the property in block 741. If a valid display key, the function is read as 0–10, and the associated operation and LED display performed, as subsequently discussed with regard to each function.

The clock time function (1) tests for a "clock not set" problem and displays the lock's current time. The time includes DST or standard status, the hour and minutes, as follows: Delimiter; Date/Time/DST problem code (0–4); Delimiter; DST Status (0=Not DST, 1=DST); Delimiter; Hours (0–23 ) (military time); Delimiter; Minutes (0–59.); Delimiter. The problem code is defined by: 0=No Problem; 1=The lock is in mode 0 or 1 and the date/time is not programmed; 2=The lock needs new dst information programmed in; 3=The lock has lost the time for some reason; 4=Clock has not been reset within 12 months.

As an example, when using the display clock time key, the delimiter is first flashed. After this delimiter is followed by a response to the first element (Date/Time/DST code). If there is a date, time or DST problem, the red LED will flash from 1–3 times. If there is no date, time or DST problem, the red LED will not flash. The delimiter will then flash one time. Thereafter, the response to the second element (DST Status) will appear. If the red LED flashes one time, the DST Status is one, indicating that the lock's clock is running on Daylight Savings Time. If lock's clock is not running on Daylight Savings Time, the red LED will not flash. The delimiter will then flash one time. Thereafter, the response to the third element (hours) will appear. This response will consist of yellow and/or red LEDs to indicate the hours of the day. For example, if the lock's clock is now at 2 PM, the hours will be represented by 1 yellow LED flash (value of 10) and 4 red LED flashes (value of 4)(10+4=14 hours or 2 PM military time). The delimiter will then flash one time. Thereafter, the response to the final element (minutes) will appear. This response will also consist of yellow and/or green LEDs to indicates the minutes of the hour. For example, if the lock's clock is now at 43 minutes, the minutes will be represented by 4 LED yellow flashes (value of 10×4) and 3 red LED flashes (value of 1×3). The delimiter will then flash one time.

The autolatch function (3) will indicate whether or not there is a problem with the lock's automatic unlatch and latch feature, as follows: Delimiter; Autolatch Status (0–5); and Delimiter.

The autolatch status code is defined as follows: 0=AutoUnlatch latch is operational; 1=The lock is not function properly or is not programmed (mode 0 or 1); 2=The lock cannot perform unlatch autolatch because it has no motor; 3=The lock is not programmed to perform autolatch/unlatch; 4=Lock should perform unlatch autolatch be cannot because its DST information needs reprogramming; 5=Lock should perform autolatch/unlatch but cannot because its clock date/time need to be reset.

The last entry function (4) provides information on the two most recent key entries as follows: delimiter; 1st key level (0–14); delimiter; 1st key identification number (0–255); delimiter; 1st key number times opened (0–15); delimiter; 2nd key level (0–14); delimiter; 2nd key identification number (0–255); delimiter; 2nd key number times opened (0–15); and delimiter.

Only the two most recent interrogation records with opening capabilities will be displayed. If the lock has no interrogation records or less than two records, the values above for the missing fields will be zero (no lights).

The knob turn switch function (5) tests the operation of the knob/handle switch, wire harness and connectors. This key should be used with the door in the open position so that the knob can be turned from inside before using the key. With the door open, turn the inside handle and hold it. Use the display key. The delimit should occur, followed by one red flash, followed by the delimiter. Release the handle. Use the display key again. This time the delimiter should flash twice. A red flash should not appear.

If the proper lights do not appear during both tests, the knob/handle turn switch is not working properly, and the exterior housing should be replaced. The circuit board can be reused unless it exhibits the same problem in another lock. The following sequence will occur: delimiter; knob turn switch state (0–1); (0=not turned, 1=turned); and delimiter.

The deadbolt function (6) tests the operation of the deadbolt/privacy switch, wire harness and connectors. This key should be used with the door in the open position so that the deadbolt switch can be set. With the door open, the thumbturn is placed in the privacy position or press the privacy button. Then use the display knob turn switch key. The delimiter should flash, followed by one red flash, followed by the delimiter. Release the deadbolt or privacy button by turning the inside handle. Use the display key again. This time the delimiter should flash twice. A red flash should not appear.

If the proper lights do not appear during both tests, the deadbolt/thumbturn spindle, cam or thumbturn, is improperly installed or the deadbolt/privacy switch is not working properly. The sequence of lights occurs as follows:

delimiter; deadbolt switch state (0–1); (0=not turned, 1=turned); and delimiter.

The motor switches function (7) indicates whether or not the lock is programmed for a motor. It also displays the current status of the motor's switches and whether the lock should be latched or unlatched.

The following sequence occurs: delimiter; hardware mode programming; (0=no motor, 1=motor); delimiter; motor switch status (0–3); delimiter; intended latch state; (0=unlatch, 1=latch); and delimiter.

If the hardware mode programming indicates a single red flash, the lock has been programmed for a motor. If no flash appears, the lock has no motor. If the proper lights do not appear, the lock is improperly programmed.

If the lock has a motor, and the motor switch status indicates 1 red flash, the lock is unlatched. If it indicates 2 red flashes, the lock is latched. If it indicates no red flashes or 3 red flashes, there is a problem with the lock. if the lock has no motor, and the motor switch status indicates no red flashes, the lock is latched and there is no problem. If it indicates 1, 2 or 3 red flashes, there is a problem with the lock.

If the problem lights appear, the lock's harness is improperly connected to the circuit board, or for locks with motors, the motor is jammed or the motor switches are not working properly.

If the intended latch indicates no red flashes, the lock is supposed to be unlatched. If it indicates one red flash, the lock is supposed to be latched.

The following determines the meaning of

| Motor Switch Status | |
|---|---|
| Lock With Motor | Lock With No Motor |
| 0 = Problem | OK (Latched) |
| 1 = OK (Unlatched) | Problem |
| 2 = OK (Latched) | Problem |
| 3 = Problem | Problem |

This battery status function (8) tests for low battery indication and condition. If the lock's batteries are low and a normal key is used, the red light will flash alternately with the normal green or yellow lights. After the batteries are changed, this light pattern will continue until the lock has been opened once. The next time a key is used, the low battery indicator lights should not appear.

The following light sequence appears: delimiter; low battery flag (0=good, 1=low); delimiter; low battery input (0=good, 1=low); and delimited. The low battery flag indicates whether the low battery condition occurred recently. The lower battery input indicates whether the lock batteries are currently low. If the low battery flag indicates one red flash, and the low battery input indicates no red flash, the batteries were recently low, but are no longer low. Use a master key to get a green (and red) flashing lights. Then, try the display key again. If the low battery indicates one red flash, the batteries are beginning to get low and should be replaced. If no red lights occur with the low battery flag or low battery input, the batteries are fine.

The clock run test function (9) indicates whether or not the lock's clock is working, as follows: delimiter; indicates process is running (steady yellow light) (1–64 Sec); delimiter; clock working status (0–1); and delimiter. If the clock working status does not indicate one red flash, the lock's clock is not working and he circuit board should be replaced.

This LED test function (10) is used to indicate whether or not all of the LEDs are working properly as follows: delimiter; display 111; and delimiter.

If the display 111 causes the green, yellow and red lights to flash, the LEDs are working properly. If any or all of the lights do not flash, the circuit board should be replaced.

It is to be understood that other codes and checks may be performed by any of the abovedescribed keys or error codes.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended claims the invention may be practiced otherwise than as specifically described.

What is claimed is:

1. In a locking system of the type comprising:

a lock including a lock means to place the lock in a locked or unlocked condition, a microcomputer including memory, a plurality of keys of different types, each key having a key code stored thereon, said memory having a control program stored therein for program control of said microcomputer, a key reader coupled with said microcomputer and being adapted to coact with any one of said keys to read the key code stored thereon into said microcomputer, and an electrically controlled actuator for said locking means coupled with an output of said computer, the improvement comprising:

said plurality of keys including a selected key having a valid day code stored thereon indicative of which days of the week the selected key will be operative to unlock said locking means independent of the remaining keys, said lock including clock means for producing a clock signal indicative of real time, and said memory means including a timing register for storing real time and day based on said clock means, said microprocessor operating under program control for receiving said valid day code from said selected key and for comparing same with said timing register to allow operation of said lock means when said valid day code has a predetermined relation to the day stored in said timing register and to prevent operation of said lock means when said valid day code does not have the predetermined relation to said day stored in said timing register such that the selected key designates valid days of operation allowing different keys to designate and operate on different days.

2. A system as set forth in claim 1 wherein said memory includes a level storage area having a plurality of records identified by lock level code for storing operational information for a lock level associated with said selected keys, and a key storage area having a plurality of lock key records each identified by a lock record number and associated with at least one of said lock levels for storing key information associated with said record number, each of said lock key records including said lock record number and said current key time, said microcomputer operating under program control for validating said selected key by reading and comparing said key level code to said lock level code, and upon a match, comparing said key record number to one of said lock record numbers identified with said lock level code, and if said key record number matches one of said lock record numbers, performing said operational information stored with said lock level.

3. A system as set forth in claim 2 wherein said lock includes a valid time range field associated with said lock record number register for storing a time range defining a period within which said lock means will operate, said microcomputer operating under program control for obtaining said time range and for determining whether said time range has a predetermined requisite relationship to said stored real time and if it does, said microcomputer being operative under program control operating said lock.

4. A system as set forth in claim 3 wherein said memory means includes an invalid days field for storing information indicative of invalid days of week of which said lock means may not be operated by said selected key, said microcomputer operated under program control for obtaining said invalid days of week and for determining whether said invalid days of week has a predetermined relationship to said day stored in the timing register and if it dos, said microcomputer being operative under program control of said main program for operating said lock means.

5. A system as set forth in claim 4 wherein said key storage area includes a lock code stored in each of said lock key records and associated with one of said lock record numbers, said selected key includes a key code, said microcomputer operating under program control for reading said key code from said selected key and for determining whether the key code on said selected key has a predetermined requisite relationship to said lock code identified with said lock record number and lock level associated with said key record number and key level, and if it does, said microcomputer being operative under program control for performing the operational information stored in said level storage area.

6. A system as set forth in claim 5 wherein said key comprises a new key time stored thereon, said lock key code stored in said memory means having stored a current key time, said microcomputer operating under program control for reading and comparing said new key time to said current key time associated with said lock record number and lock level code identified by said key level code and said key record number for invalidating the key when said new time is less than the current key time and for validating the key and replacing said current key time with said new key time when said new key time is greater than said current key time.

7. A system as set forth in claim 6 wherein said memory means includes a day register for storing the current day of week based on said clock means and a valid day field for storing valid days of week, said microcomputer operating under program control for comparing said current day of week to said valid days of week and for allowing operation of said lock when said current day of week equals one of said valid days of week and for preventing operation of said lock when said current day of week is not equal to any of said valid days of week.

8. In a locking system of the type comprising:

a lock including a locking means to place the lock in a locked or unlocked condition, a microcomputer including memory, a plurality of keys of different types, each key having a key code and a key level code stored thereon, said memory having a control program stored therein for program control of said microcomputer, a key reader coupled with said microcomputer and being adapted to coact with any one of said keys to read the key code and level code stored thereon into said microcomputer, and an electrically controlled actuator for said locking means coupled with an output of said computer, the improvement comprising:

said keys including a selected key having a key offset time stored thereon and a key time stored thereon indicative of a time of issuance, said lock including clock means for producing a clock signal indicative of real time, and said memory means including a timing register for storing the real time based on said clock means and an expiration field for storing an expiration time based on said key expiration time, said microcomputer operating under program control for reading said key offset time and key time to calculate said expiration time by summing said key expiration time with said key time and for operating said lock when said real time is less than said expiration time and for inhibiting operation of said lock when said real time is greater than said expiration time.

9. A system as set forth in claim 8 wherein said keys include a selected key having a key record number stored thereon and said key code comprising a new key time, said memory storing a lock record number and a current key time, said microcomputer operating under program control for comparing said key record number with said lock record number, and upon a match, comparing said new key time with said current key time for invalidating said selected key when said new time is less than said current key time, and validating said selected key and replacing said current key time with said new time when said new key time is greater than said current key time.

10. A system as set forth in claim 9 wherein said memory includes a level storage area having a plurality of records identified by lock level code for storing operational information for a lock level associated with said selected keys, and a key storage area having a plurality of lock key records each identified by a lock record number and associated with at least one of said lock levels for storing key information associated with said record number, each of said lock key records including said lock record number and said current key time, said microcomputer operating under program control for validating said selected key by reading and comparing said key level code to said lock level code, and upon a match, comparing said key record number to one of said lock record numbers identified with said lock level code, and if said key record number matches one of said lock record numbers, performing said operational information stored with said lock level.

11. A system as set forth in claim 10 wherein said lock including a valid time range field associated with said lock record number register for storing a time range defining a period within which said lock means will operate, said microcomputer operating under program control for obtaining said time range and for determining whether said time range has a predetermined requisite relationship to said stored real time and if it does, said microcomputer being operative under program control operating said lock.

12. In a locking system of the type comprising:

a lock including a lock means to place the lock in a locked or unlocked condition, a microcomputer including memory, a plurality of keys of different types, each key having a key level code stored thereon, said memory having a control program stored therein for program control of said microcomputer, a key reader coupled with said microcomputer and being adapted to coact with any one of said keys to read the stored thereon into said microcomputer, and an electrically controlled actuator for controlling said locking means and coupled with an output of said microcomputer, the improvement comprising:

said keys including a selected key having a function thereon, said memory including an information code area for storing a plurality of codes identifying different occurrences of said lock, said lock including a plurality of light means for visually displaying a plurality of codes by change in combination or repetition of said light means, said microcomputer operating under program control for reading said selected key and said function and for obtaining one of said information codes based on said function to display said information code by illuminating said light means in a predetermined combination or repetition.

13. A system as set forth in claim 12 wherein said plurality of light means includes at least two light emitting components of a different color for indicating said information codes under program control based upon repetition of illumination.

14. A system as set forth in claim 13 wherein said information code is stored in memory by at least a two digit number, said microcomputer associating each of said digits with one of said light emitting component for operating under program control to control the repetition of each of said light emitting components to the number in the associated digit.

15. A system as set forth in claim 14 wherein said light means comprises three light emitting components of a different color.

16. A system as set forth in claim 15 wherein said memory includes a diagnostic time register for storing a predetermined time-out time, said lock includes clock means for producing a clock signal indicative of real time, said microcomputer operating under program control for monitoring the time duration of said lock operating in diagnostic mode and comparing same with said diagnostic time register for turning off said diagnostic mode when said time-out time is obtained.

17. In a locking system of the type comprising:

a lock including a lock means to place the lock in a locked or unlocked condition, a microcomputer including memory, a plurality of keys of different types, each key having a key level code stored thereon, said memory having a control program stored therein for program control of said microcomputer, a key reader coupled with said microcomputer and being adapted to coact with any one of said keys to read the stored thereon into said microcomputer, and an electrically controlled actuator for controlling said locking means and coupled with an output of said microcomputer, the improvement comprising:

said keys including a display key having a function field thereon for designating conditions in said lock to be monitored, said memory including code storage area for storing a plurality of codes to identify different lock conditions occurring in said lock, said lock including a plurality of light means for visually displaying a plurality of codes by change in combination or repetition of said light means, said microcomputer operating under program control for reading said display key and said function field to monitor the lock conditions identified by said function field and status thereof in said lock, and for displaying the condition by control of the light means.

18. A system as set forth in claim 17 wherein said lock includes clock means for producing a clock signal indicative of real time, said memory means including a timing register for storing the real time based on said clock means, said display key including time fields thereon indicative of a request for clock time monitoring, said microcomputer operating under program control for reading said display key and said timing register and for displaying the real time in said lock by control of said light means.

19. A system as set forth in claim 18 wherein said plurality of light means includes at least two light emitting components of different colors for displaying different information of conditions and status based upon each repetition number of each light emitting component.

20. A system as set forth in claim 19 wherein said conditions and status is stored in at least two digits, said microcomputer associating each of said digits with one of said light emitting components for operating under program control to control the repetition of said light emitting components to the number presented in each associated digit.

21. In a locking system of the type comprising:

a lock including a locking means to place the lock in a locked or unlocked condition, a microcomputer including memory, a plurality of keys of different types, each key having a key level code stored thereon, said memory having a control program stored therein for program control of said microcomputer, a key reader coupled with said microcomputer and being adapted to coact with anyone of said keys to read the stored thereon into said microcomputer, and an electrically controlled actuator for controlling said locking means and coupled with an output of said microcomputer, the improvement comprising:

said keys including a selected operation key for operating said lock and a diagnostic key for operating a diagnostic mode of said lock to provide error information, said memory including an information code area for storing a plurality of error codes identifying different errors potentially occurring in said lock in response to reading any keys, said lock including a plurality of light means for visually displaying a plurality of codes by change in combination or repetition thereof, said microcomputer operating under program control for reading said diagnostic key to set said lock in diagnostic mode and for reading said operation key to determine an error in execution thereof, and for obtaining one of said plurality of error codes based on said error in execution to display said code by said light means when said lock is in diagnostic mode.

22. A system as set forth in claim 21 wherein said plurality of light means includes at least two light emitting components of a different color for indicating said information codes under program control based upon repetition of illumination.

23. A system as set forth in claim 22 wherein said information code is stored in memory by at least a two digit number, said microcomputer associating each of said digits with one of said light emitting component for operating under program control to control the repetition of each of said light emitting components to the number in the associated digit.

24. In a locking system of the type comprising:

a lock including a locking means to place the lock in a locked or unlocked condition, a microcomputer including memory, a plurality of keys of different types, each key having a key level code stored thereon, said memory having a control program stored therein for program control of said microcomputer, a key reader coupled with said microcomputer and being adapted to coact with anyone of said keys to read the stored thereon into said microcomputer, and an electrically controlled actuator for controlling said locking means and coupled with an output of said microcomputer, the improvement comprising:

said keys including a selected operation key for operating said lock, an interrogation card for communicating between said memory and an external computer and for operating in interrogation mode of said lock to receive lock information and including a function field to identify one of at least two different types of memory information to be received, said memory including an interrogation storage area for storing a plurality of interrogation records identifying the previous operation and status of the selected operation keys, said microcomputer operating under program control for reading and validating said operation key to store information regarding the operation thereof in said lock in said interrogation records, and for receiving said interrogation card to set said lock in interrogation mode and reading said function field to communicate information from said interrogation storage area through said interrogation card to the computer of memory information designated by said function field.

25. In a locking system of the type comprising:

a lock including a locking means to place the lock in a locked or unlocked condition, a microcomputer including memory, a plurality of keys of different types, each key having a key level code stored thereon, said memory having a control program stored therein for program control of said microcomputer, a key reader coupled with said microcomputer and being adapted to coact with anyone of said keys to read the stored thereon into said microcomputer, and an electrically controlled actuator for controlling said locking means and coupled with an output of said microcomputer, the improvement comprising:

said keys including a selected operation key for operating said lock, an interrogation card having a validation field thereon and an information transmitter and receiver for two-way communication between said memory and an external computer with information stored in said memory for said selected operation, and for operating in interrogation mode of said lock to provide lock information to modify said memory, said microcomputer operating under program control for reading and validating said operation key based on information stored in said memory to operate of said lock based on said key, and for receiving said interrogation card to set said lock in interrogation mode to communicate information to and from said memory through said interrogation card to the computer.

* * * * *